US005324625A

United States Patent [19]

Hirabayashi et al.

[11] Patent Number: 5,324,625

[45] Date of Patent: Jun. 28, 1994

[54] SILVER HALIDE COLOR PHOTOGRAPHIC LIGHT-SENSITIVE MATERIAL

[75] Inventors: Shigeto Hirabayashi, Hachioji; Yasushi Usagawa, Hino; Yasuhiko Kawashima; Nobuaki Kagawa, both of Iruma, all of Japan

[73] Assignee: Konica Corporation, Tokyo, Japan

[21] Appl. No.: 909,667

[22] Filed: Jul. 7, 1992

[30] Foreign Application Priority Data

Jul. 24, 1991 [JP] Japan ..... 3-207399

[51] Int. Cl.[5] ..... G03C 1/46

[52] U.S. Cl. ..... 430/503; 430/507; 430/517; 430/519; 430/522; 430/552; 430/557

[58] Field of Search ..... 430/507, 517, 519, 522, 430/552, 557, 503

[56] References Cited

U.S. PATENT DOCUMENTS

| | | | |
|---|---|---|---|
| 2,611,696 | 9/1952 | Keyes et al. | 430/522 |
| 2,719,088 | 9/1955 | Herz et al. | 430/507 |
| 2,956,881 | 10/1960 | Van Lare | 430/594 |
| 3,471,293 | 10/1969 | Ohlschlager et al. | 430/522 |
| 3,480,436 | 11/1969 | Wilson | 430/522 |
| 5,019,490 | 5/1991 | Kobayashi et al. | 430/557 |

FOREIGN PATENT DOCUMENTS

| | | | |
|---|---|---|---|
| 0663801 | 9/1965 | Belgium | 430/522 |
| 0225476 | 9/1990 | Japan . | |
| 1077049 | 7/1967 | United Kingdom | 430/522 |

*Primary Examiner*—Thomas R. Neville

*Attorney, Agent, or Firm*—Finnegan, Henderson Farabow, Garrett & Dunner

[57] ABSTRACT

A silver halide color photographic light-sensitive material is disclosed. The light-sensitive material comprises a support having thereon a blue-sensitive silver halide emulsion layer, a green-sensitive silver halide emulsion layer and a red-sensitive silver halide emulsion layer, and at least one of the silver halide emulsion layers contains a silver salt of dye. The light-sensitive material has a raised sharpness, lowered fog and improved storage stability.

3 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, more specifically a silver halide color photographic light-sensitive material having high sharpness, high sensitivity with little fogging and good storage stability.

BACKGROUND OF THE INVENTION

It is a well-known fact that a colored layer such as an anti-halation layer or a filter layer is provided to improve the image sharpness of a silver halide photographic light-sensitive material. Such a colored layer often contains a water-soluble dye. Most of the known dyes used for this purpose are not completely photochemically inert, thus often having adverse effects on the light-sensitive layers of photographic materials, i.e., increased fogging and reduced sensitivity.

In the photographic industry, there has recently been increasing demand for silver halide color photographic light-sensitive materials offering high image quality. Particularly in the so-called color negative-positive system, wherein a photograph is taken using a silver halide photographic light-sensitive material for color negative film, and a negative image on the film is printed on a silver halide photographic light-sensitive material for color printing paper to obtain a finished image, silver halide photographic light-sensitive materials for color printing paper pose a problem of poorer image quality, particularly lower sharpness in comparison with silver halide photographic light-sensitive materials for color negative films.

Thus, attempts have been made to improve image sharpness by adding a large amount of water-soluble dye; however, experiments by the present inventors revealed that such attempts result in considerably reduced sensitivity of the emulsion layer, greatly increased fogging density and deteriorated storage stability and have only a little improving effect on image sharpness.

On the other hand, there has recently been demand for rapidly processable silver halide color photographic light-sensitive materials in the photographic industry.

Specifically, silver halide color photographic light-sensitive materials are subjected to a continuous processing using an automatic developing machine installed in each laboratory; with the requirement for improved service for customers, there is demand for development and return to the customer within the day of reception. More recently, there has been demand for return to the user even within several hours after reception. Accordingly, there has been increasing demand for the development of a more rapidly processable silver halide color photographic light-sensitive material.

As a technical means of obtaining such a rapidly processable silver halide color photographic light-sensitive material, the use of an emulsion incorporating silver chloride, for instance, is known.

In recent years, it has become common to use an emulsion incorporating silver chloride for the purpose of rapidly processing silver halide color photographic light-sensitive materials for color printing paper.

However, the use of an emulsion incorporating silver chloride poses a problem of high fogging, though it allows rapid processing. In addition, it is evident, as stated above, that increasing the water-soluble dye content for improving image sharpness results in more increased fogging.

SUMMARY OF THE INVENTION

The object of the present invention is to provide a silver halide color photographic light-sensitive material having high sharpness, high sensitivity with little fogging and good storage stability.

The object of the present invention described above is accomplished by a silver halide color photographic light-sensitive material comprising a support having thereon photographic structural layers including a blue-sensitive silver halide emulsion layer, a green-sensitive silver halide emulsion layer and a red-sensitive silver halide emulsion layer, wherein at least one of said silver halide emulsion layers contains a silver salt of dye. In the above light-sensitive material, it is preferable that the blue-sensitive emulsion layer contains the silver salt of dye and a yellow dye forming coupler represented by the following Formula Y-I, the green-sensitive emulsion layer contains the silver salt of dye and a magenta dye forming coupler represented by the following Formula M-I, or the red-sensitive emulsion layer contains the silver salt of dye and a cyan dye forming coupler represented by the following Formula C-I. Further it is preferable that the silver halide emulsion layer containing the silver salt of dye comprises silver halide emulsion having a silver chloride content of not less than 90 mol %.

Formula Y-I

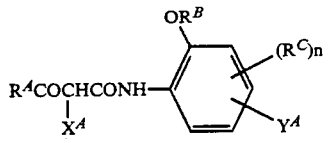

wherein $R^A$ represents an alkyl group or a cycloalkyl group; $R^B$ represents an alkyl group, a cycloalkyl group, an aryl group or an acyl group; $R^C$ represents a group capable of substituting the benzene ring; n represents 0 or 1; $X^A$ represents a group capable of splitting off upon coupling with the oxidation product of a developing agent; $Y^A$ represents an organic group.

Formula M-I

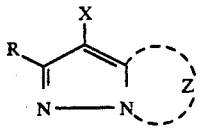

wherein R represents a hydrogen atom or a substituent; Z represents a group of non-metallic atoms necessary to form a nitrogen-containing heterocyclic ring, which ring may have a substituent.

Formula C-I

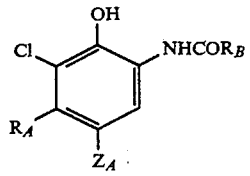

wherein $R_A$ represents an alkyl group having 2 to 6 carbon atoms; $R_B$ represents a ballast group; $Z_A$ represents a hydrogen atom or an atom or group capable of splitting off upon reaction with the oxidation product of a developing agent.

DETAILED DESCRIPTION OF THE INVENTION

First, the silver salt of dye of the present invention is described below.

In the present invention, the silver salt of dye means a silver salt or silver complex formed upon reaction of a dye and a silver ion, wherein the dye is an organic compound having an absorption in the visible spectral band (380 to 700 nm).

Some preferred dyes capable of forming a silver salt of dye used for the present invention are described below, which are not to be construed as limitative on the invention.

Examples of such dyes include those represented by the following formulas I through V.

Formula I

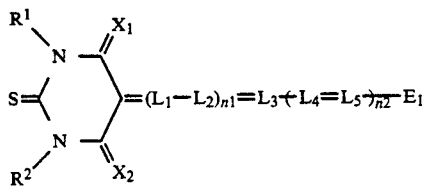

wherein $R^1$ and $R^2$ independently represent a hydrogen atom, an alkyl group, an alkenyl group, an aryl group or a heterocyclic group; $X_1$ and $X_2$ independently represent an oxygen atom or a sulfur atom; $L_1$ through $L_5$ each represent a methine group; $n_1$ and $n_2$ independently represent an integer of 0 to 2; $E_1$ represents a group having an acidic nucleus.

Formula II

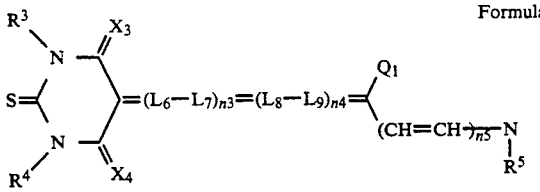

wherein $R^3$ and $R^4$ have the same definitions as $R^1$ and $R^2$ in formula I; $X_3$ and $X_4$ have the same definitions as $X_1$ and $X_2$ in formula I; $L_6$ through $L_9$ each represent a methine group; $n_3$ through $n_5$ independently represent an integer of 0 to 2; $R^5$ represents an alkyl group or an alkenyl group; $Q_1$ represents a group of non-metallic atoms necessary to form a 5- or 6-membered heterocyclic ring.

Formula III

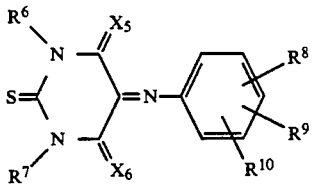

wherein $R^6$ and $R^7$ have the same definitions as $R^1$ and $R^2$ in formula I; $X_5$ and $X_6$ have the same definitions as $X_1$ and $X_2$ in formula I; $R^8$ through $R^{10}$ independently represent a hydrogen atom, an alkyl group, an alkenyl group, an aryl group, a heterocyclic group, a halogen atom, a cyano group, a sulfo group, $-COR^1$, $-CON(R^{11})(R^{12})$, $-N(R^{11})(R^{12})$, $-OR^{11}$, $-SOR^{11}$, $-SO_2R^{11}$, $-SO_2N(R^{11})(R^{12})$, $-N(R^{11})COR^{12}$, $-N(R^{11})SO_2R^{12}$, $-N(R^{11})CON(R^{12})(R^{13})$, $-SR^{11}$ or $-COOR^{11}$; $R^{11}$ through $R^{13}$ independently represent a hydrogen atom, an alkyl group, an alkenyl group, an aryl group or a heterocyclic group.

Formula IV

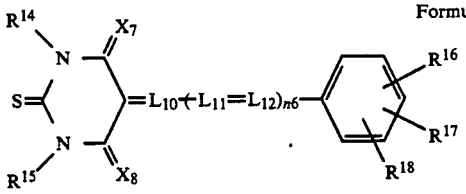

wherein $R^{14}$ and $R^{15}$ have the same definitions as $R^1$ and $R^2$ in formula I; $X_7$ and $X_8$ have the same definitions as $X_1$ and $X_2$ in formula I; $L_{10}$ through $L_{12}$ each represent a methine group; $n_6$ represents an integer of 0 to 2; $R^{16}$ through $R^{18}$ have the same definitions as $R^8$ through $R^{10}$ in formula III.

Formula V

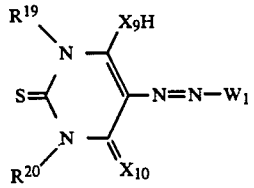

wherein $R^{19}$ and $R^{20}$ have the same definitions as $R^1$ and $R^2$ in formula I; $X_9$ and $X_{10}$ have the same definitions as $X_1$ and $X_2$ in formula I; $W_1$ represents an aryl group or a heterocyclic group.

With respect to the formulas given above, examples of the alkyl groups represented by $R^1$ and $R^2$ include a methyl group, an ethyl group, a propyl group, an isopropyl group, an n-butyl group, a tert-butyl group, a cyclopentyl group and a cyclohexyl group. These alkyl groups may have been substituted by a hydroxyl group, a cyano group, a sulfo group, a carboxyl group, a halogen atom such as a fluorine atom, a chlorine atom or a bromine atom, an alkoxy group such as a methoxy group or an ethoxy group, an aryloxy group such as a phenoxy group, a 4-sulfophenoxy group or a 2,4-disulfophenoxy group, an aryl group such as a phenyl group, a 4-sulfophenyl group or a 2,5-disulfophenyl group, an alkoxycarbonyl group such as a methoxycarbonyl group or an ethoxycarbonyl group, an aryloxycarbonyl group such as a phenoxycarbonyl group, or another substituent.

Examples of the aryl groups represented by $R^1$, $R^2$ and $W_1$ include a phenyl group and a naphthyl group. These groups may be substituted by the alkyl groups represented by $R^1$ and $R^2$ and by the same substituents as those specified for the alkyl groups.

Examples of the heterocyclic groups represented by $R^1$, $R^2$ and $W_1$ include a pyridyl group, a thiazolyl group, an oxazolyl group, an imidazolyl group, a furyl group, a pyrrolyl group, a pyrazinyl group, a pyrimidinyl group, a pyridazinyl group, a purinyl group, a selenazolyl group, a sulfolanyl group, a piperidinyl group, a pyrazolyl group and a tetrazolyl group. These groups may be substituted by the alkyl groups represented by $R^1$ and $R^2$ and by the same substituents as those specified for the alkyl groups.

Examples of the alkenyl groups represented by $R^1$ and $R^2$ include a vinyl group and an allyl group. These groups may be substituted by the alkyl groups represented by $R^1$ and $R^2$ and by the same substituents as those specified for the alkyl groups.

Examples of the groups having an acidic nucleus, represented by $E_1$ in formula I, include the groups having the skeletons described in lines 20, page 11, through line 15, page 14, of Japanese Patent Publication Open to Public Inspection (hereinafter referred to as Japanese Patent O.P.I. Publication) No. 281235/1986, and the groups represented by the following formulas 1 through 4.

Formula 1

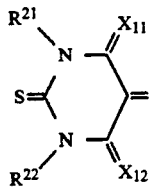

wherein $R^{21}$ and $R^{22}$ have the same definitions as $R^1$ and $R^2$ in formula I; $X_{11}$ and $X_{12}$ have the same definitions as $X_1$ and $X_2$ in formula I.

Formula 2

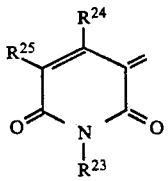

wherein $R^{23}$ has the same definition as $R^1$ and $R^2$ in formula I; $R^{24}$ and $R^{25}$ have the same definitions as $R^8$ through $R^{10}$ in formula III.

Formula 3

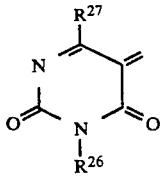

wherein $R^{26}$ has the same definition as $R^1$ and $R^2$ in formula I; $R^{27}$ has the same definition as $R^8$ through $R^{10}$ in formula III.

Formula 4

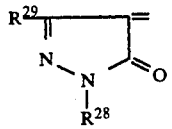

wherein $R^{28}$ has the same definition as $R^1$ and $R^2$ in formula I; $R^{29}$ represents an alkyl group, an aryl group, alkenyl group, a heterocyclic group, a cyano group, $COR^{30}$, $—CON(R^{30})(R^{31})$, $—N(R^{30})(R^{31})$, $—OR^{30}$, $—SOR^{30}$, $—SO_2R^{30}$, $—SO_2N(R^{30})(R^{31})$, $—N(R^{30})COR^{31}$, $—N(R^{30})SO_2R^{31}$, $—N(R^{30})CON(R^{31})(R^{32})$, $—SR^{30}$ or $—COOR^{30}$; $R^{30}$ through $R^{32}$ have the same definitions as $R^{11}$ through $R^{13}$ in formula III.

Examples of the alkyl groups, alkenyl groups, aryl groups and heterocyclic groups described above include the same groups as those specified for $R^1$ and $R^2$ above.

Although all the groups having an acidic nucleus, represented by $E_1$, have been shown in the keto configuration above, it is chemically evident that they can take the enol configuration by mutual variability.

Examples of the 5- or 6-membered heterocyclic ring formed by $Q_1$ in formula II include the following heterocyclic rings.

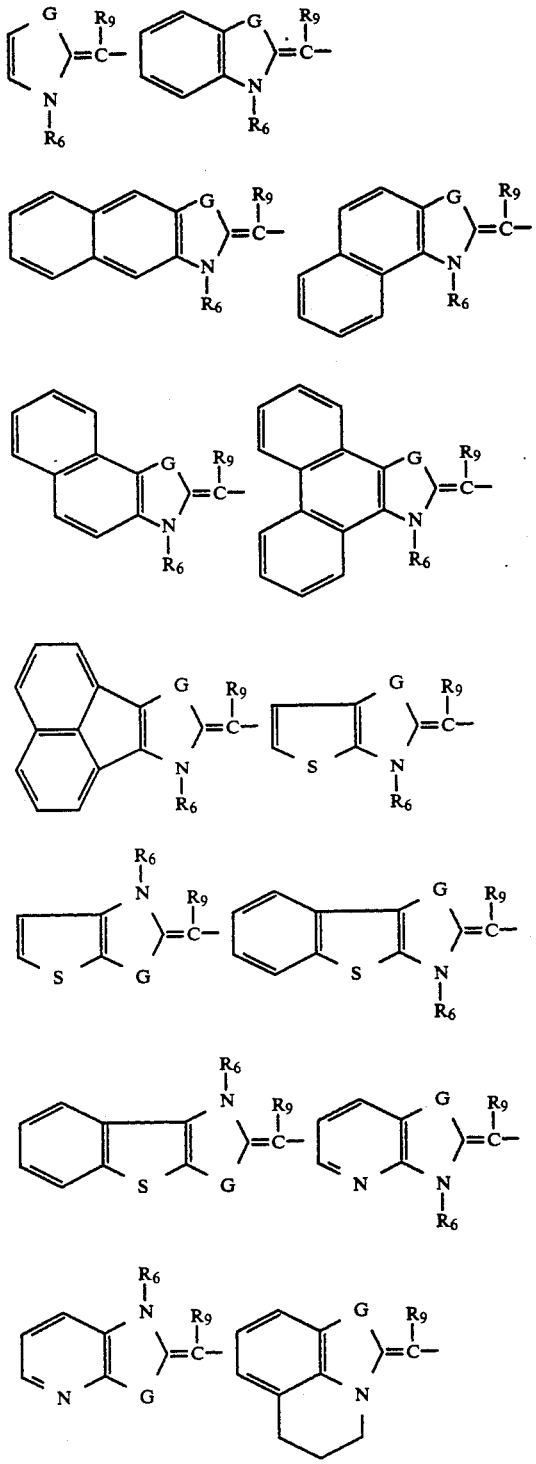

-continued

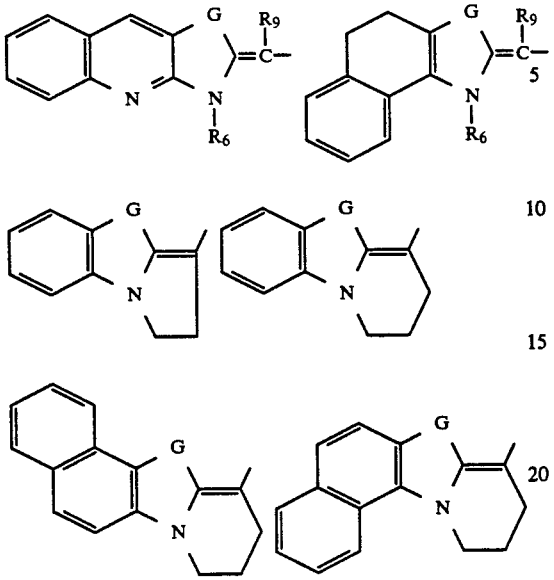

in the above, G is a sulfur atom, an oxygen atom or a selenium atom; and $R_6$ an $R_9$ are each a hydrogen atom or a substituent.

The heterocyclic rings further include represented by the following Formula 5.

Formula 5

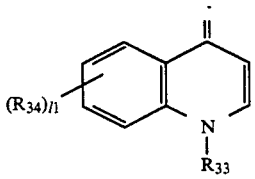

wherein $R^{33}$ has the same definition as $R^1$ and $R^2$ in formula I; $R^{34}$ has the same definition as $R^8$ through $R^{10}$ in formula III; $l_1$ represents an integer of 0 to 3.

Typical examples of the compounds represented by formulas I through V are given below.

I-1

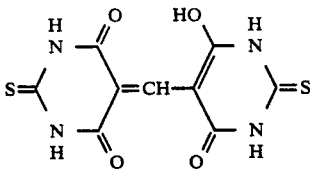

I-2

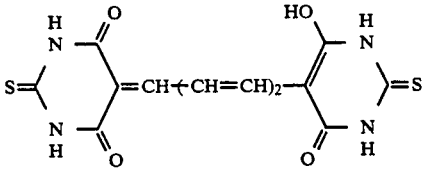

I-3

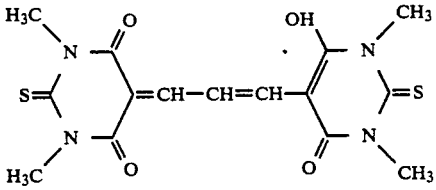

-continued

I-4

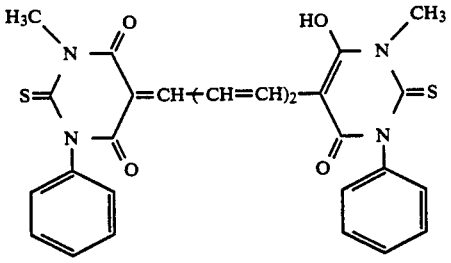

I-5

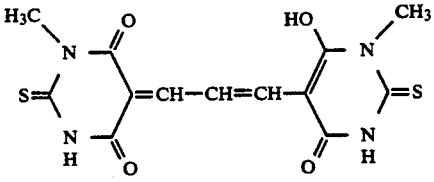

I-6

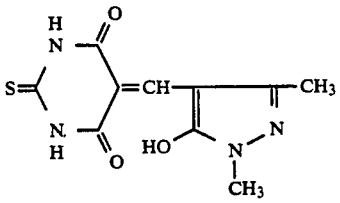

I-7

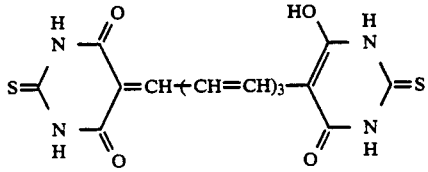

I-8

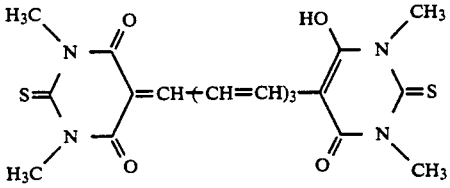

I-9

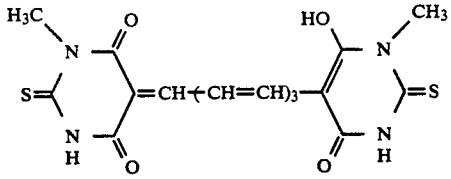

I-10

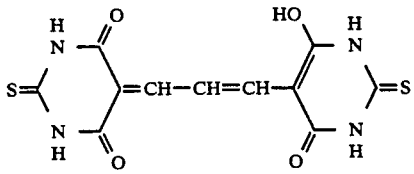

I-11

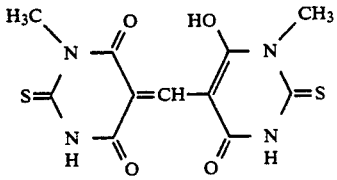

-continued
I-12
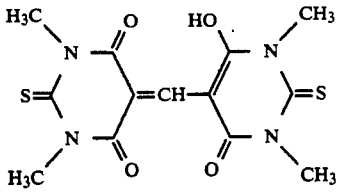
I-13
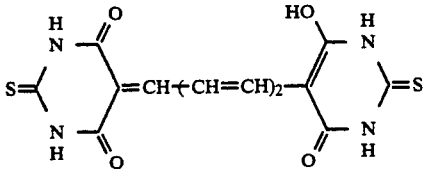
I-14
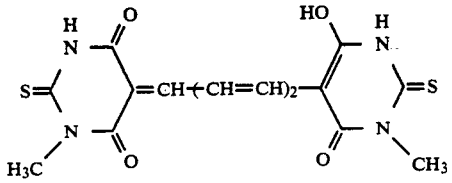
I-15
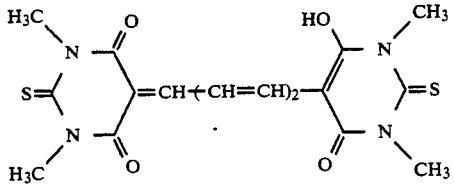
I-16
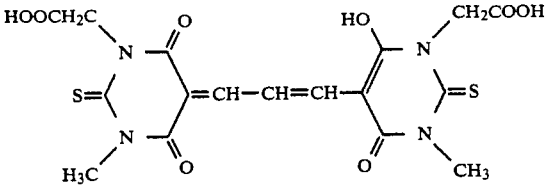
I-17
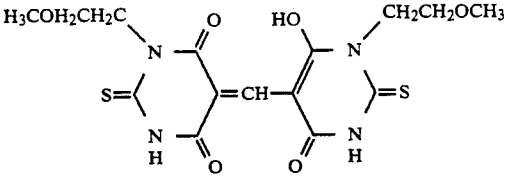
II-1
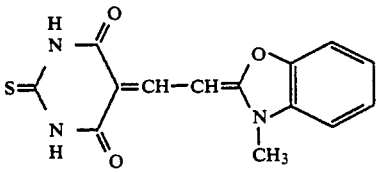
II-2
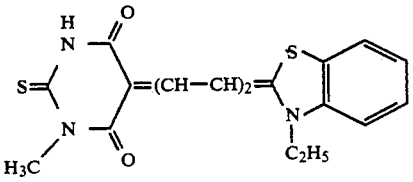
-continued
II-3
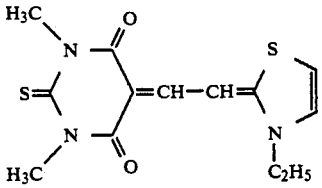
II-4
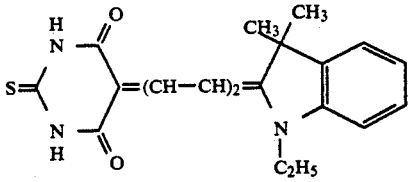
II-5
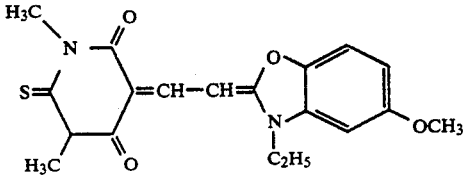
III-1
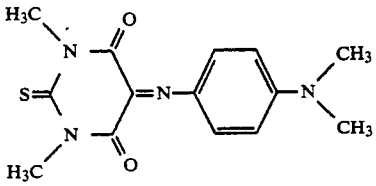
III-2
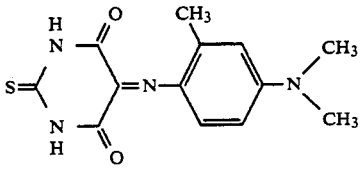
III-3
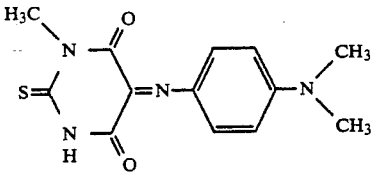
III-4
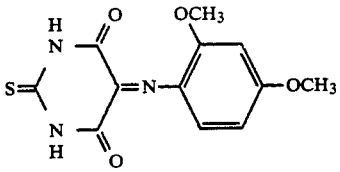
III-5
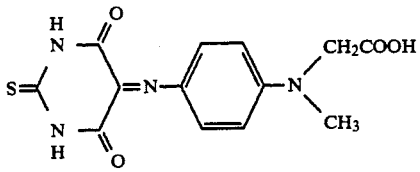
III-6
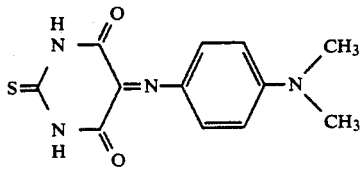

-continued

III-7

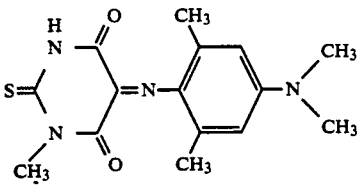

IV-1

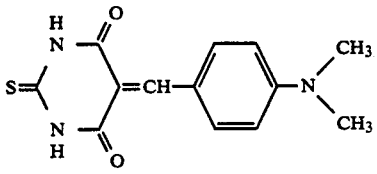

IV-2

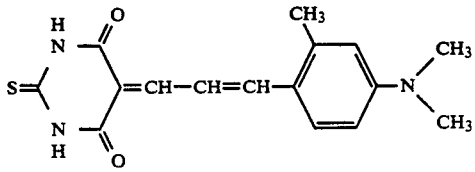

IV-3

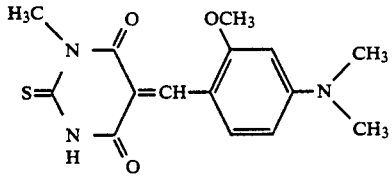

IV-4

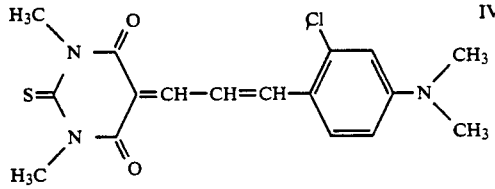

IV-5

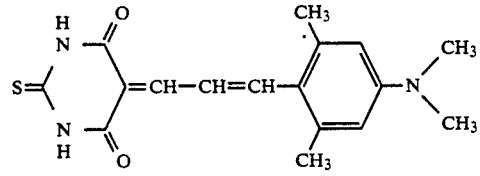

IV-6

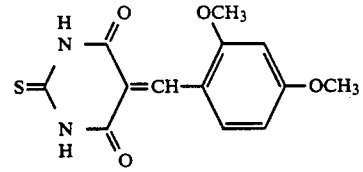

V-1

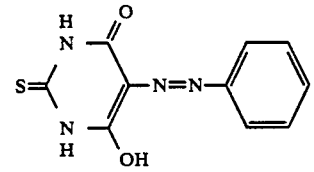

V-2

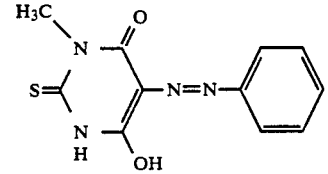

-continued

V-3

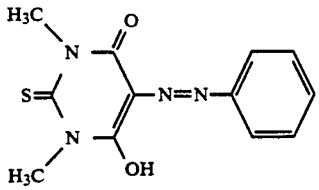

V-4

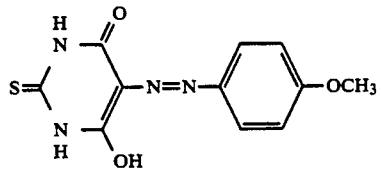

V-5

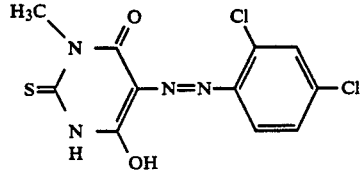

Examples of the dyes used for the present invention include those represented by the following formulas I' through V'.

$$A{=}L{-}(L{=}L)_{n7}{-}E \qquad \text{Formula I'}$$

Formula II'

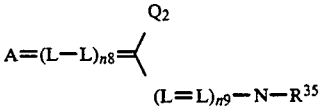

Formula III'

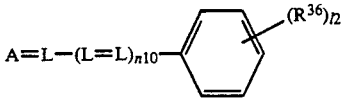

Formula IV'

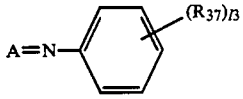

$$A'{-}N{=}N{-}W_2 \qquad \text{Formula V'}$$

wherein $R^{35}$ represents an alkyl group or an alkenyl group; $R^{36}$ and $R^{37}$ independently represent an alkyl group, an alkenyl group, an aryl group, a heterocyclic group, a halogen atom, a cyano group, a sulfo group, $-COR^{38}$, $-CON(R^{38})(R^{39})$, $-N(R^{38})(R^{39})$, $-OR^{38}$, $-SOR^{38}$, $-SO_2R^{38}$, $-SO_2N(R^{38})(R^{39})$, $-N(R^{38})COR^{39}$, $-N(R^{38})SO_2R^{39}$, $-N(R^{38})CON(R^{39})(R^{40})$, $-SR^{38}$ or $-COOR^{38}$; $R^{38}$ through $R^{40}$ independently represent a hydrogen atom, an alkyl group, an alkenyl group, an aryl group or a heterocyclic group and; $n_7$ and $n_8$ independently represent an integer of 0 to 3; $n_9$ and $n_{10}$ independently represent an integer of 0 to 2.

A represents a group represented by one of the following formulas $A_1$ through $A_4$; A' represents a group represented by one of the following formulas $A'_1$ through $A'_4$.

Formula $A_1$

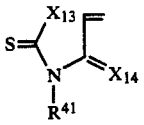

Formula $A_2$

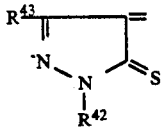

Formula $A_3$

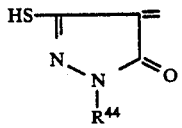

Formula $A_4$

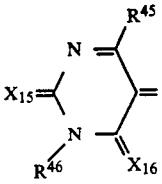

Formula $A'_1$

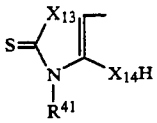

Formula $A'_2$

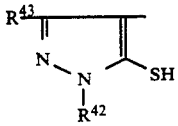

Formula $A'_3$

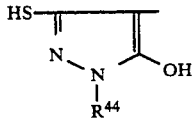

Formula $A'_4$

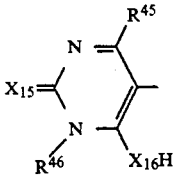

wherein $R^{41}$, $R^{42}$, $R^{44}$ and $R^{46}$ independently represent a hydrogen atom, an alkyl group, an alkenyl group, an aryl group or a heterocyclic group; $R^{43}$ represents an alkyl group, an alkenyl group, an aryl group, a heterocyclic group, a cyano group, $-COR^{47}$, $-CON(R^{47})(R^{48})$, $-N(R^{47})(R^{48})$, $-OR^{47}$, $-SOR^{47}$, $-SO_2R^{47}$, $-SO_2N(R^{47})(R^{48})$, $-N(R^{47})COR^{48}$, $-N(R^{47})SO_2R^{48}$, $-N(R^{47})CON(R^{48})(R^{49})$, $-SR^{47}$ or $-COOR^{47}$; $R^{47}$ through $R^{49}$ independently represent a hydrogen atom, an alkyl group, an alkenyl group, an aryl group or a heterocyclic group; $R^{45}$ has the same definition as $R^{36}$ and $R^{37}$; $X_{13}$ represents an oxygen atom, a sulfur atom, a selenium atom or $=N-R^{50}$, $R^{50}$ has the same definition as $R^{41}$; $X_{14}$, $X_{15}$ and $X_{16}$ independently represent an oxygen atom or a sulfur atom.

L represents a methine group; E represents a group having an acidic nucleus; $Q_2$ represents a group of nonmetallic atoms necessary to form a heterocyclic ring: $W_2$ represents an aryl group or a heterocyclic group; $l_2$ and $l_3$ independently represent an integer of 0 to 3.

The compounds represented by formulas I' through V' are described below.

Examples of the alkyl groups represented by $R^{35}$ through $R^{50}$ include a methyl group, an ethyl group, a propyl group, an isopropyl group, an n-butyl group, a tert-butyl group, a cyclopentyl group and a cyclohexyl group. These alkyl groups may have been substituted. Example of the substituent includes a hydroxyl group, a cyano group, a sulfo group, a carboxyl group, a halogen atom such as a fluorine atom, a chlorine atom or a bromine atom, an alkoxy group such as a methoxy group or an ethoxy group, an aryloxy group such as a phenoxy group, a 4-sulfophenoxy group or a 2,4-disulfophenoxy group, an aryl group such as a phenyl group, a 4-sulfophenyl group or a 2,5-disulfophenyl group, an alkoxycarbonyl group such as a methoxycarbonyl group or an ethoxycarbonyl group, an aryloxycarbonyl group such as a phenoxycarbonyl group.

Examples of the aryl groups represented by $R^{36}$ through $R^{50}$ and $W_2$ include a phenyl group and a naphthyl group. These groups may be substituted by the alkyl groups represented by $R^{35}$ through $R^{50}$ and by the same substituents as those specified for the alkyl groups.

Examples of the heterocyclic groups represented by $R^{36}$ through $R^{50}$ and $W_2$ include a pyridyl group, a thiazolyl group, an oxazolyl group, an imidazolyl group, a furyl group, a pyrrolyl group, a pyrazinyl group, a pyrimidinyl group, a pyridazinyl group, a purinyl group, a selenazolyl group, a sulfolanyl group, a piperidinyl group, a pyrazolyl group or a tetrazolyl group. These groups may be substituted by the alkyl groups represented by $R^{35}$ through $R^{50}$ and by the same substituents as those specified for the alkyl groups.

Examples of the alkenyl groups represented by $R^{35}$ through $R^{50}$ include a vinyl group and an allyl group. These groups may be replaced by the alkyl groups represented by $R^{35}$ through $R^{50}$ and by the same substituents as those specified for the alkyl groups.

Examples of the groups having an acidic nucleus, represented by E in formula I', include the groups having the following skeletons.

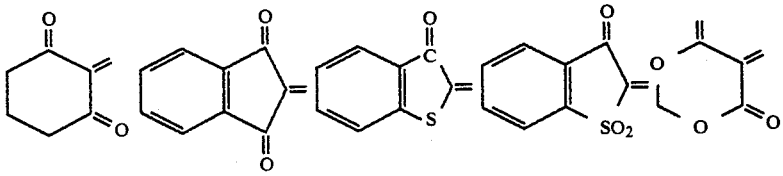

-continued
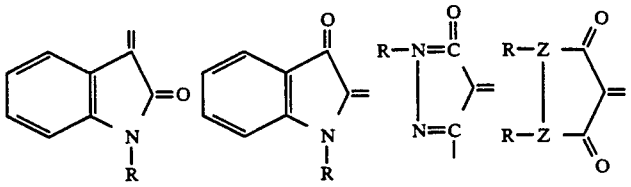
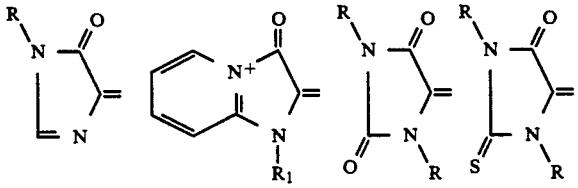
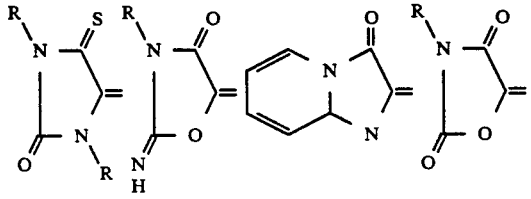
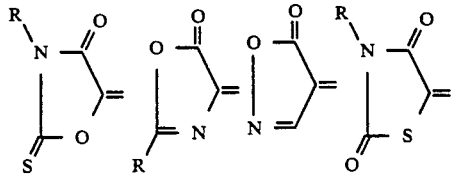
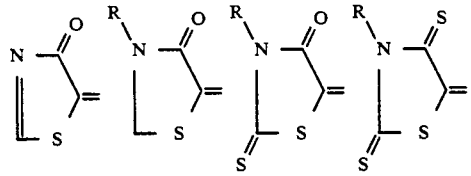
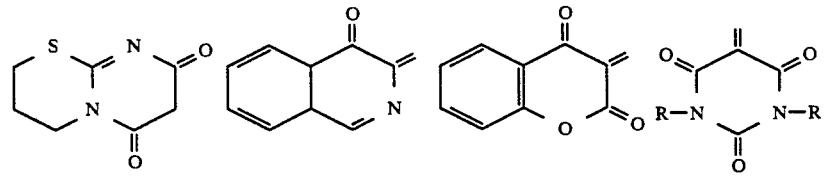
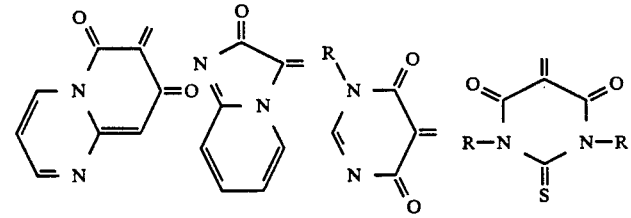
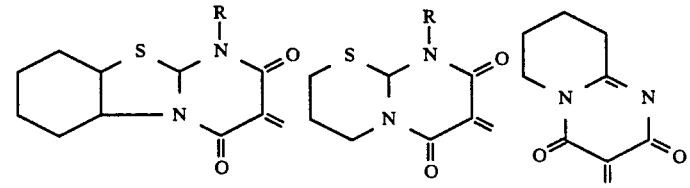

-continued

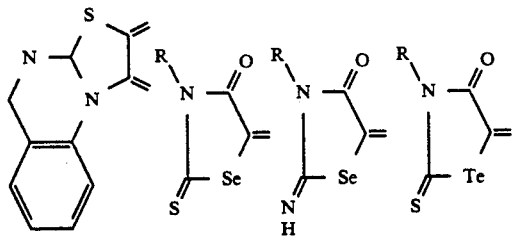

in the above R is a hydrogen atom or a substituent.

Examples of group having an acidic nucleus represented by E in formula I' further include the groups having the nuclei represented by formulas $A'_1$ through $A'_4$, and the groups represented by the following formulas 6 through 8.

Formula 6

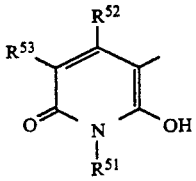

wherein $R^{51}$ has the same definition as $R^{41}$; $R^{52}$ and $R^{53}$ independently represent a hydrogen atom or a group specified for $R^{36}$ above.

Formula 7

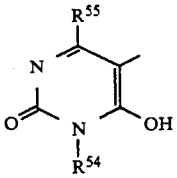

wherein $R^{54}$ has the same definition as $R^{41}$; $R^{55}$ represents a hydrogen atom or a group specified for $R^{36}$ above.

Formula 8

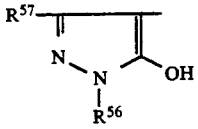

wherein $R^{56}$ has the same definition as $R^{42}$; $R^{57}$ has the same definition as $R^{43}$.

Examples of the heterocyclic ring formed by $Q_2$ in formula II' include the heterocyclic rings the same as fore-mentioned concerning $Q_1$ in formula I'.

The heterocyclic rings represented by the following formula 9.

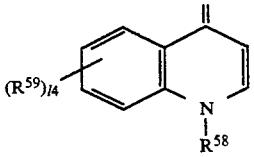

wherein $R^{58}$ has the same definition as $R^{41}$; $R^{59}$ has the same definition as $R^{36}$; $l_4$ represents an integer of 0 to 3.

Typical examples of the compounds represented by formulas I' through V' are given below.

I'-1

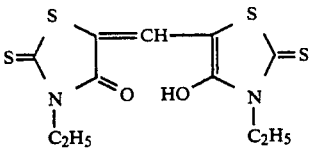

I'-2

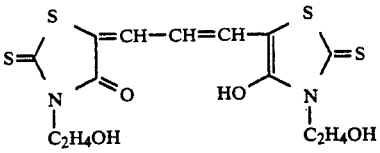

I'-3

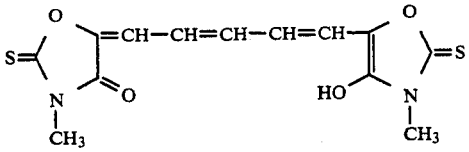

I'-4

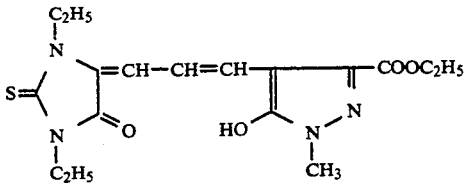

I'-5

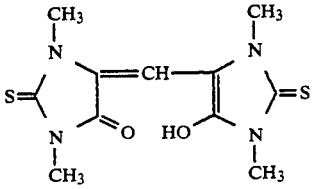

I'-6

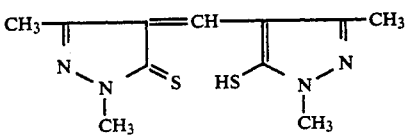

-continued
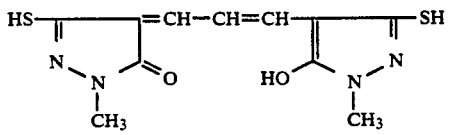
I'-7
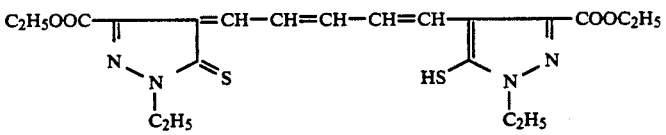
I'-8
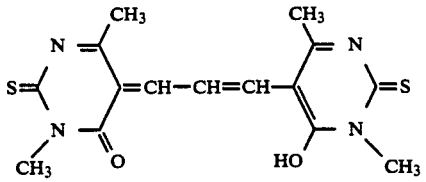
I'-9
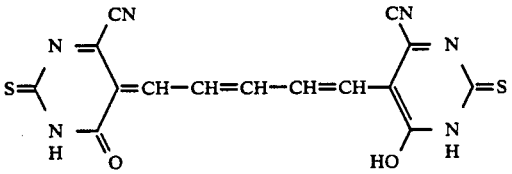
I'-10
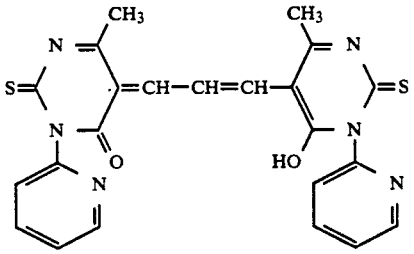
I'-11
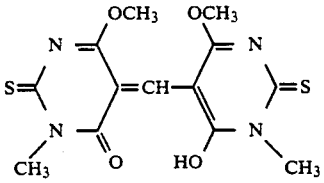
I'-12
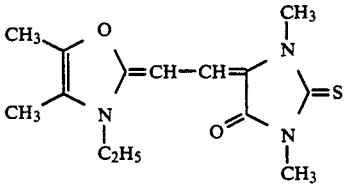
II'-1
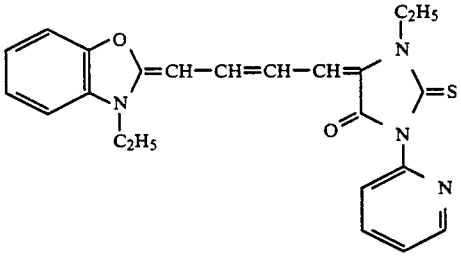
I'-2
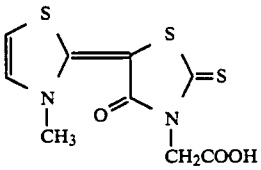
II'-3
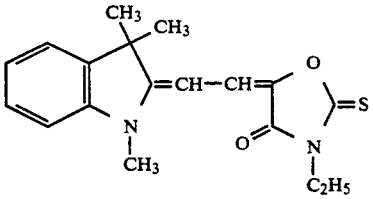
II'-4
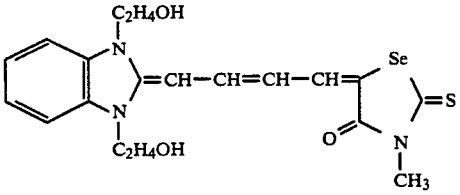
II'-5
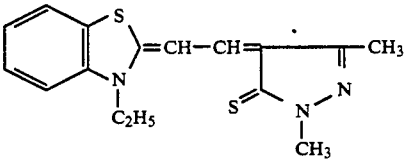
II'-6
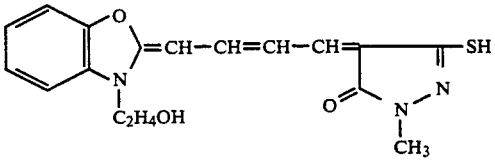
II'-7

-continued
II'-8
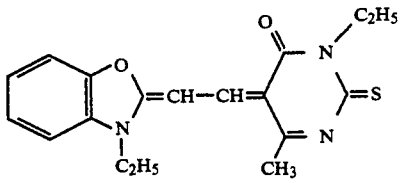
II'-9
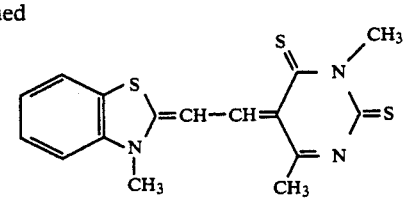
III'-1
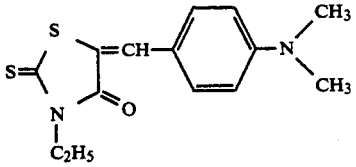
III'-2
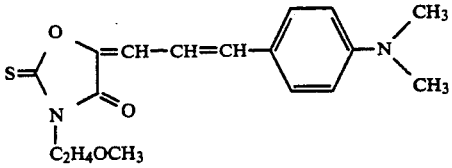
III'-3
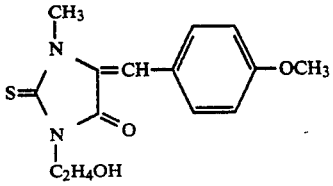
III'-4
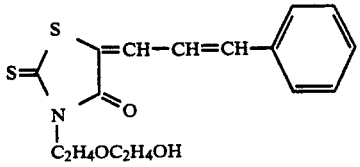
III'-5
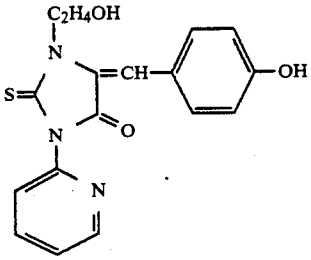
III'-6
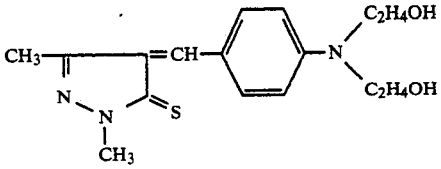
III'-7
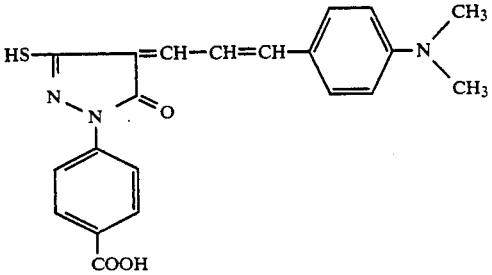
III'-8
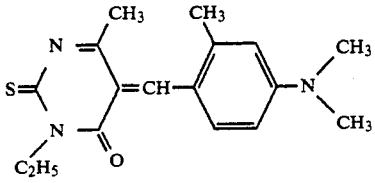
III'-9
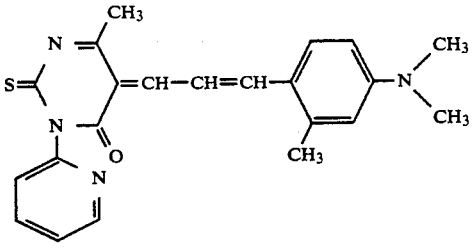
IV'-1
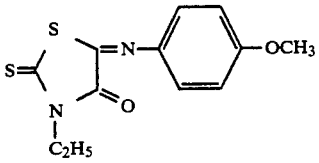
IV'-2
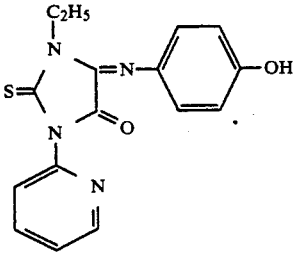
IV'-3
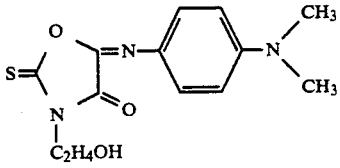

-continued

IV'-4

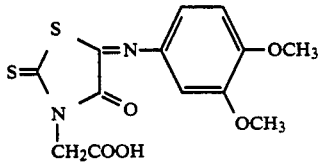

IV'-5

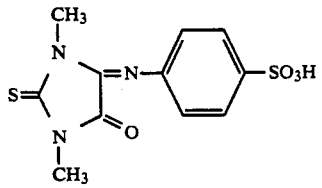

IV'-6

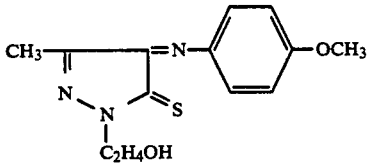

IV'-7

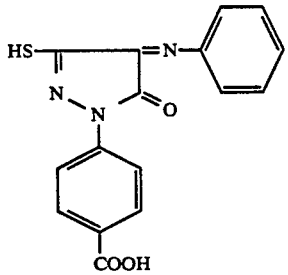

IV'-8

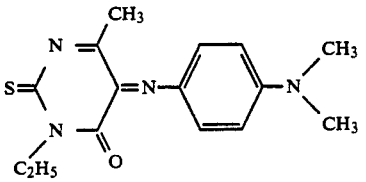

IV'-9

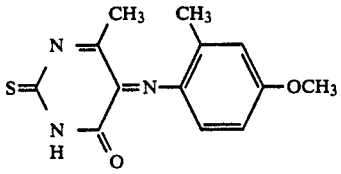

V'-1

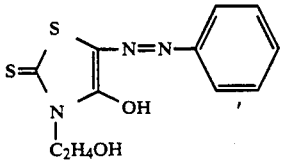

V'-2

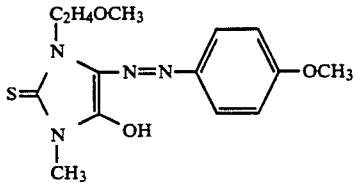

V'-3

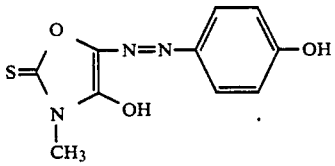

V'-4

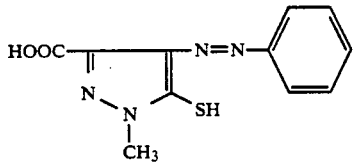

V'-5

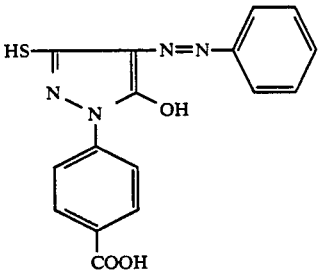

V'-6

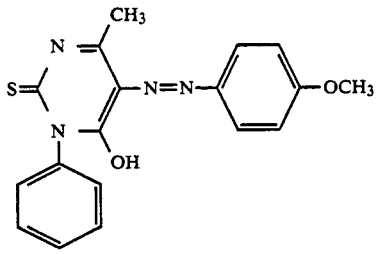

Examples of the dyes used for the present invention also include the dyes represented by the following formula VI, hereinafter referred to as methine compounds.

$$(\text{Dye})l_5[-(J)_{m1}-\text{Sal}]_{n11} \qquad \text{Formula VI}$$

wherein Dye represents a group of atoms having a methine dye structure; J represents a divalent binding group based on one or more atoms selected from the group comprising a carbon atom, a nitrogen atom, an oxygen atom and a sulfur atom; Sal represents a group forming a sparingly soluble salt with silver ion; $l_5$ represents 1 or 2; $m_1$ represents 0 or 1; $n_{11}$ represents 1, 2, 3 or 4.

With respect to formula VI, the group represented by Dye is a group of atoms having a methine dye structure. Examples of such groups include those having a dye structure having a covalently double bound methine chain, such as cyanine, merocyanine, merostyryl, styryl, oxonol and triarylmethane. Examples of these dyes include the cyanine dyes described in Japanese Patent O.P.I. Publication No. 202665/1988 and USSR Patent No. 653,257, the merocyanine dyes described in Japanese Patent O.P.I. Publication Nos. 29727/1977, 60825/1977, 135335/1977, 27146/1981, 29226/1981, 10944/1984, 15934/1984, 111847/1984 and 34539/1988 and U.S. Pat. Nos. 2,944,896 and 3,148,187, the merostyryl dyes described in Japanese Patent O.P.I. Publication Nos. 211041/1984, 211042/1984, 135936/1985, 135937/1985, 204630/1986, 205934/1986, 56958/1987, 70830/1987, 92949/1987 and 185758/1987, the oxonol dyes described in Japanese Patent O.P.I. Publication Nos. 145125/1975, 33103/1980, 120660/1980, 161233/1980, 185755/1987, 139949/1988, 231445/1988 and 264745/1988, U.S. Pat. No. 4,187,275, British Patent No. 1,521,083 and Belgian Patent No. 869,677 and the triarylmethane dyes described in Japanese Patent O.P.I. Publication Nos. 55437/1984 and 228250/1984, and U.S. Pat. Nos. 4,115,126 and 4,359,574. Further, those described in "Theory of Photographic Process", edited by T. H. James (1977), published by Macmillan, "Heterocyclic Compounds Cyanine Dyes and Related Compounds", written by F. M. Harmer, John Wiley & Sons (New York, London) (1964), "The Chemistry of Heterocyclic Compounds", written by D. M. Sturmer, ed. A. Weissberger and E. C. Taylor (1977), and "The Chemistry of Synthetic Dyes", Academic Press (New York, London), Vol. II (1952) and Vol. IV. (1971).

The group for J is preferably a divalent binding group having not more than 20 carbon atoms comprising one or more groups selected from alkylene groups such as a methylene group, an ethylene group, a propylene group and a pentylene group, arylene groups such as a phenylene group, alkenylene groups such as an ethylene group and a propylenylene group, a sulfonyl group, a sulfinyl group, an ether group, a thioether group, a carbonyl group, an —N(R60)— group, wherein $R^{60}$ represents a hydrogen atom, a substituted or unsubstituted alkyl group or a substituted or unsubstituted aryl group, an —N= group, heterocyclic divalent groups such as a triazine-2,4-diyl group, a pyrimidine-2,4-diyl group, a thiazole-2,4-diyl group and a benzoxazole-2,5-diyl group, which may have a substituent. Examples of the substituent include ordinary substituents, which are optionally selected from the group comprising halogen atoms such as a fluorine atom, a chlorine atom and a bromine atom, alkyl groups such as a methyl group, an ethyl group, an isopropyl group and a butyl group, aralkyl groups such as a benzyl group and a phenethyl group, alkoxy groups such as a methoxy group and an ethoxy group, alkoxycarbonyl groups such as an ethoxycarbonyl group, alkylthio groups, hydroxyl groups, carboxyl groups, sulfo groups, sulfonyl groups such as a methanesulfonyl group and a p-toluenesulfonyl group, carbamoyl groups such as an N-methylcarbamoyl group and a morpholinocarbonylamino group, acyl groups such as an acetyl group and a benzoyl group, acylamido groups such as an acetamido group, sulfonamido groups such as a methanesulfonamido group and a butanesulfonamido group, cyano groups, amino groups such as an ethylamino group and a dimethylamino group and ureide groups.

$l_5$ represents 1 or 2; $m_1$ represents 0 or 1; $n_{11}$ represents 1, 2, 3 or 4. Sal represents a group forming a sparingly soluble salt with silver ion. Examples of such groups include a mercapto group, an acetylene group, a thiocarbonyl group, a thioamide group, a thiourethane group, a thioureide group, e.g., 3-ethylthioureide group, 3-phenylthioureide group and a saturated or unsaturated 5- to 7-membered heterocyclic residue having at least one nitrogen atom in the ring thereof. Examples of preferable groups for Sal include the groups represented by the following formulas 10 to 16.

In the following formulas, each substituent may have a substituent such as an alkyl group, an alkenyl group, an aryl group, a hydroxyl group, a carboxyl group, a sulfo group, a nitro group, a cyano group, a halogen atom, an alkoxy group, an aryloxy group, an alkoxicarbonyl group, an acyl group, an acylamino group, a sulfonamino grouop, a carbamoyl group and a sulfamoyl group.

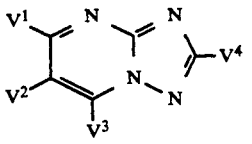

Formula 10

Wherein $V^1$, $V^2$, $V^3$ and $V^4$ each represents a hydrogen atom; a substituted or unsubstituted alkyl group such as methyl, ethyl, propyl, butyl, hydroxyethyl, trifluoromethyl, benzyl, sulfopropyl, diethylamino, cyanopropyl, adamantyl, p-chlorophenethyl, ethoxyethyl, ethylthioethyl, phenoxyethyl, carbamoylethyl, carboxyethyl, ethoxycarbonylmethyl and acetylaminoethyl group; a substituted or unsubstituted alkenyl group such as allyl and styryl group; a substituted or unsubstituted aryl group such as phenyl, naphthyl, p-carboxyphenyl, 3,5-dicarboxyphenyl, m-sulfophenyl, p-acetoamidophenyl, 3-caprylamidophenyl, p-sulfamoylphenyl, m-hydroxyphenyl, p-nitrophenyl, 3,5-dichlorophenyl, p-anisyl, o-anisyl, p-cyanophenyl, p-N'-methylureidophenyl, m-fluorophenyl, p-tolyl and m-toyl group; a substituted or unsubstituted heterocyclic residue such as pyridyl, 5-methyl-2-pyridyl and thienyl group; a halogen atom such as chlorine, bromine and fluorine atom; a mercapto group; a cyano group; a carboxyl group; a sulfo group; ahydroxyl group; a carbamoyl group; a sulfamoyl group; an amino group; a nitro group; a substituted or unsubstituted alkoxy group such as methoxy, ethoxy, 2-methoxyethoxy and 2-phenylethoxy group; a substituted or unsubstituted aryloxy group such as phenoxy, p-methylphenoxy and p-chlorophenoxy group; an acyl group such as acetyl and benzoyl group; an acylamino group such as acetylamino and caproylamino group; a sulfonyl group such as methanesulfonyl and benzenesulfonyl group; a sulfonylamino group such as methanesulfonylamino and benzenesulfonylamino group; a substituted amino group such as diethylamino and hydroxyamino group; an alkyl- or aryl-thio group such as methylthio, carboxyethylthio, sulfobutylthio and phenylthio group; an alkoxycarbonyl group such as methoxycarbonyl group; or an arylcarbonyl group such as phenoxycarbonyl group; provided that one of $V_1$ to $V^4$ represents a single bond.

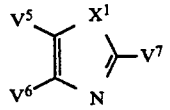

Formula 11

Wherein $X_1$ represents an oxygen atom, a sulfur atom or a N—$R^1$ group, in which $R^1$ is a hydrogen atom, a substituted or unsubstituted alkyl group, a substituted or unsubstituted aryl group or a substituted or unsubstituted heterocyclic group; $V^5$, $V^6$ and $V^7$ each represents a group the same as that represented by $V^1$ to $V^4$ in formula 10; provided that one of $V^5$ to $V^7$ represents a single bond. $V^5$ and $V^6$ may be bonded to form a condensed benzene or naphthalene ring. The benzene ring, naphthalene ring and the group represented by $R^1$ may have a group the same as represented by $V^5$ to $V^7$ as a substituent.

Formula 12

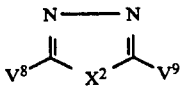

Wherein $X^2$ is an oxygen atom, a sulfur atom or a $N—R^2$ group, in which $R^2$ is the same as $R^1$ in formula 11; and $V^8$ and $V^9$ each represents a group the same as that represented by $V^1$ to $V^4$ in formula 10; provided that one of $V^8$ and $V^9$ is a single bond.

Formula 13

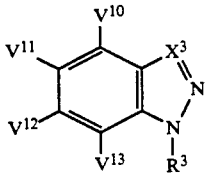

Wherein $X^3$ represents a nitrogen atom or a $C-R^4$ group; $R^3$ and $R^4$ each represents a group the same as that represented by $R^1$ in formula 11; and $V^{10}$ to $V^{13}$ each represents a group the same as that represented by $V_1$ to $V^4$ of formula 10, provided that one of $V^{10}$ to $V_{13}$ is a single bond.

Formula 14

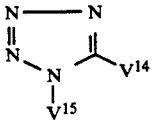

Wherein $V^{14}$ and $V^{15}$ each represents a group the same as that represented by $V^1$ to $V^4$ of formula 10, provided that one of $V_{14}$ and $V_{15}$ is a single bond.

Formula 15

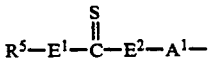

Formula 16

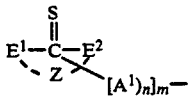

Wherein $A^1$ is a divalent linking group; one of $E^1$ and $E^2$ is a $—N(R^6)—$ group and the other is an oxygen atom, a sulfur atom or a $—N(R^7)—$ group, in which $R^6$ and $R^7$ are each a hydrogen atom, a substituted or unsubstituted aliphatic group or a substituted or unsubstituted aromatic group; Z is a group of atoms necessary to form a 5- or 6-member ring linking with $E^1$ and $E^2$, thus formed ring may be condensed with an aromatic ring, m is 1, 2 or 3 and n is 0 or 1.

As thioamido groups represented by formula 15 include thiourea, thiourethane and ester of dithiocarbamic acid. Five or six-member rings formed by Z in formula 16 include ones regarded as an acidic nuclei contained in a merocyamine dye such as 4-thiazoline-2-thion, thiazolidine-2-thion, 4-oxazoline-2-thion, oxazolidine-2-thion, 2-pyrazoline-5-thion, 4-imidazoline-2-thion, 2-thiohydantoin, rhodanine, isorhodanine, 2-thio-2,4-oxazolidinedithion, thiobarbituric acid, tetrazoline-5-thion, 1,2,4-triazoline-3-thion, 1,3,4-thiazolidine-2-thion, 1,3,4-oxadiazoline-2-thion, benzimidazoline-2-thion, benzoxazoline-2-thion, benzothiazoline-2-thion, and benzoselenazoline-2-thion. Among them, tetrazoline-5-thione and 1,3,4-thiazoline-2-thion are preferable, and tetrazoline-5-thion is most preferable.

Examples of the methine compound relating to the present invention are given below.

VI-1
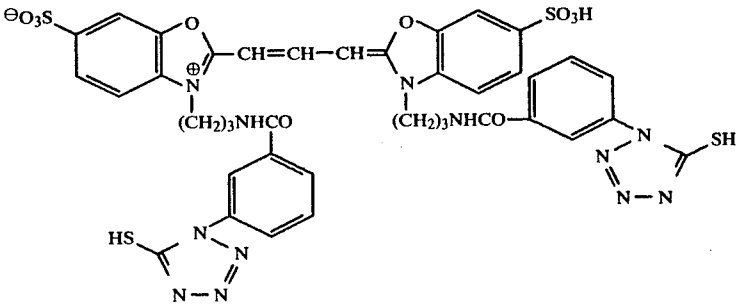
VI-2
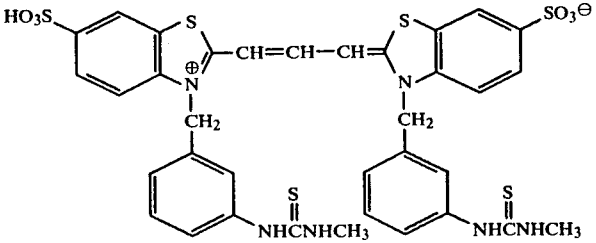
VI-3
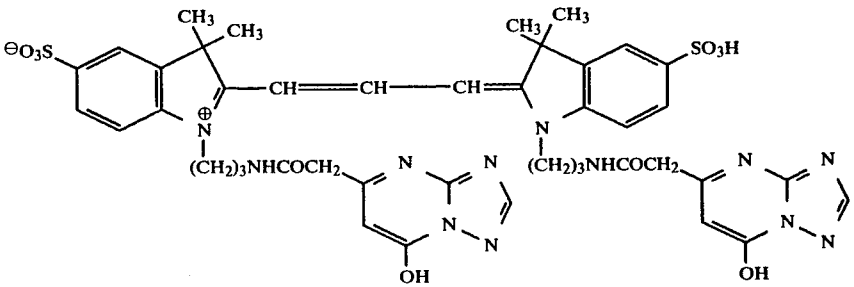
VI-4
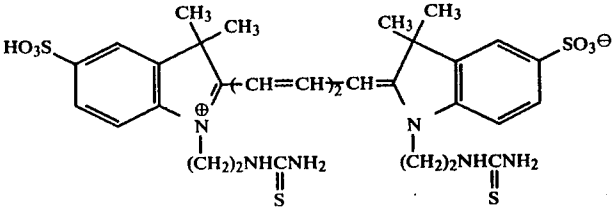

-continued
VI-5
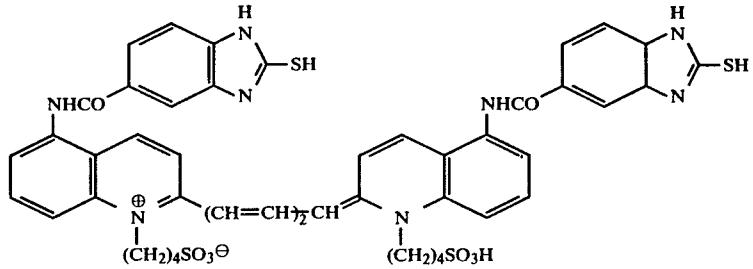
VI-6
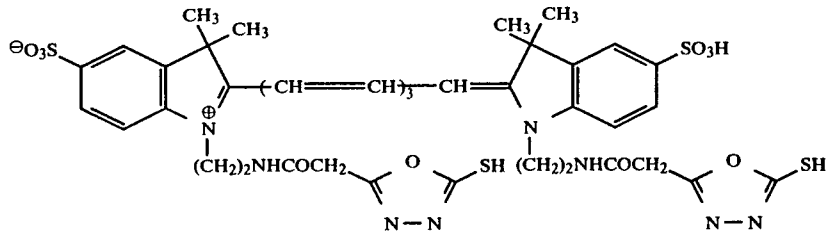
VI-7
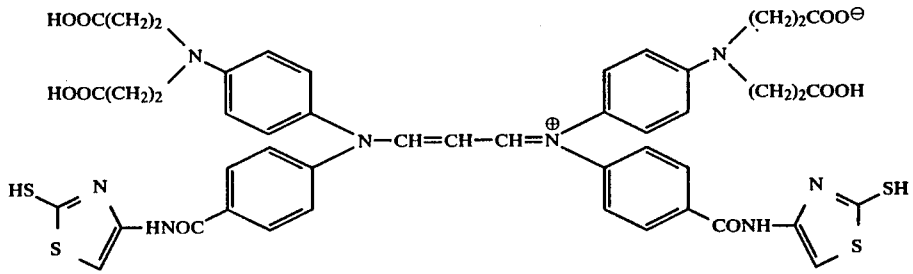
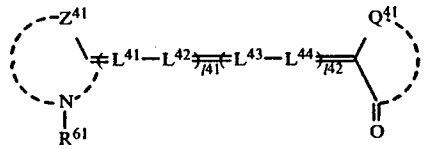

-continued
| No. | 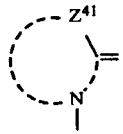 | $R^{61}$ | $(L^{42}—L^{42})_{l41}$ | $(L^{43}—L^{44})_{l42}$ | 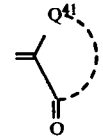 |
|---|---|---|---|---|---|
| VI-8 | 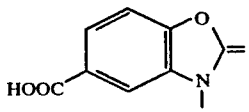 | 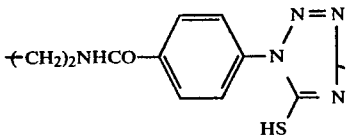 | =CH—CH= | — | 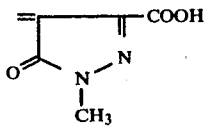 |
| VI-9 | 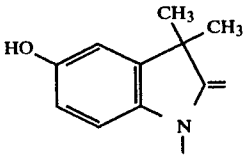 | 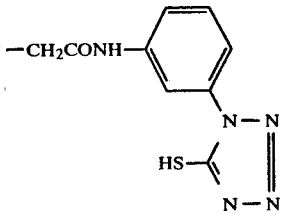 | =CH—CH= | — | 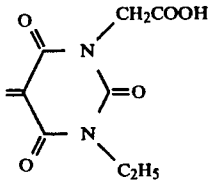 |
| VI-10 | 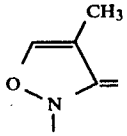 | 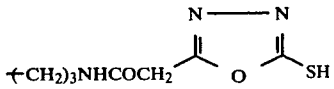 | =CH—CH= | — | 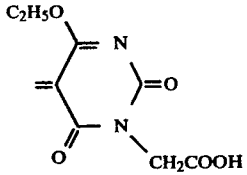 |
| VI-11 | 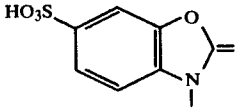 | 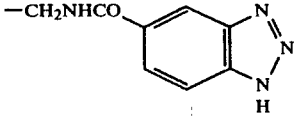 | =CH—CH= | =CH—CH= | 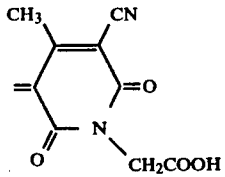 |
| VI-12 | 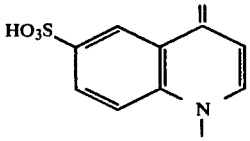 | $—(CH_2)_2NHCSNHCH_3$ | =CH—CH= | =CH—CH= | 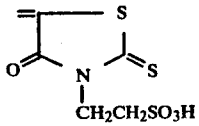 |

-continued
| | | | | | |
|---|---|---|---|---|---|
| VI-13 | 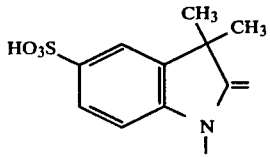 | 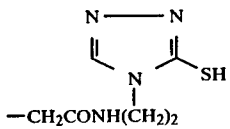 | =CH—CH= | =CH—CH= | 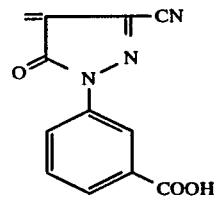 |
| VI-14 | 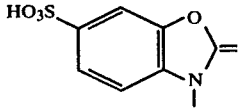 | $-C_2H_5$ | 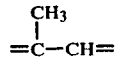 | — | 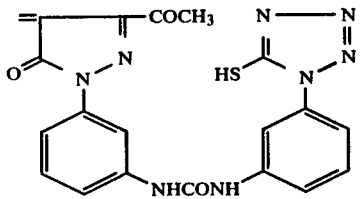 |
| VI-15 | 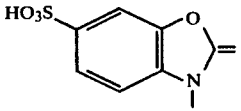 | $-C_2H_5$ | 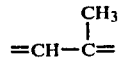 | — | 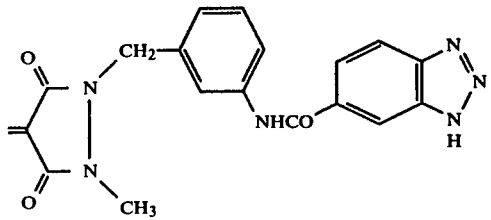 |
| VI-16 | 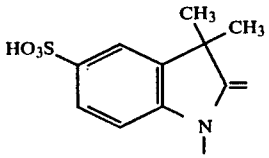 | $+(CH_2)_4SO_3H$ | =CH—CH= | 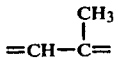 | 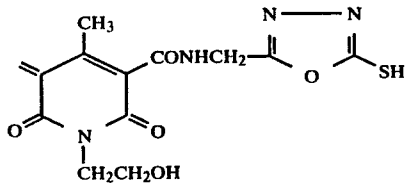 |
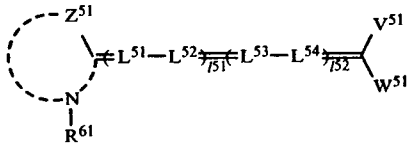

-continued
| No. | 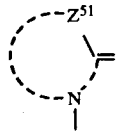 | $R^{61}$ | $V^{51}$ | $W^{51}$ | $(L^{51}-L^{52})_{l51}$ | $(L^{53}-L^{54})_{l52}$ |
|---|---|---|---|---|---|---|
| VI-17 | 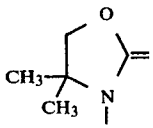 | $-C_2H_4COOH$ | $-CN$ | 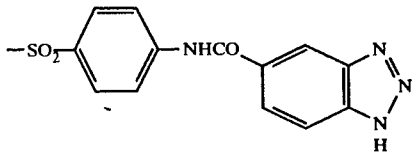 | $=CH-CH=$ | — |
| VI-18 | 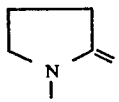 | $-C_2H_5$ | $-CN$ | 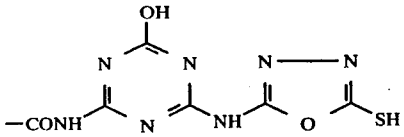 | $=CH-CH=$ | — |
| VI-19 | 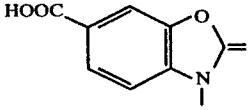 | 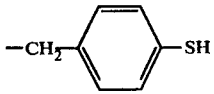 | $-CN$ | $-COO(CH_2CH_2O)_3CH_3$ | $=CH-CH=$ | $=CH-CH=$ |
| VI-20 | 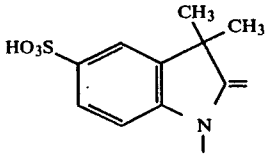 | 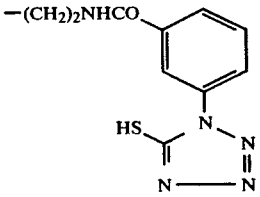 | $-COCH_3$ | $-CONH(CH_2CH_2O)_3CH_3$ | $=CH-CH=$ | $=CH-CH=$ |
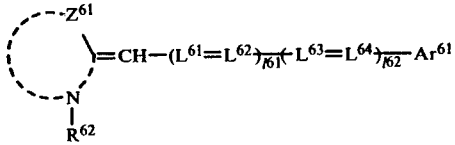

-continued
| No. | 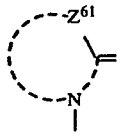 | $R^{62}$ | $Ar^{61}$ | $(L^{61}=L^{62})_{l61}$ | $(L^{63}=L^{64})_{l62}$ |
|---|---|---|---|---|---|
| VI-21 | 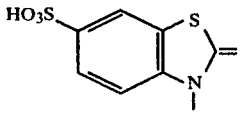 | 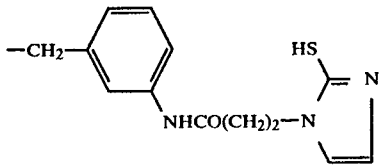 | 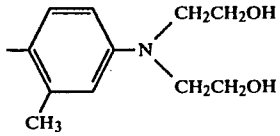 | —CH=CH— | — |
| VI-22 | 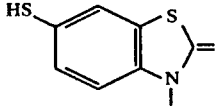 | $-CH_2COOH$ | 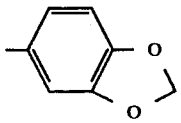 | —CH=CH— | — |
| VI-23 | 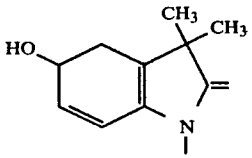 | 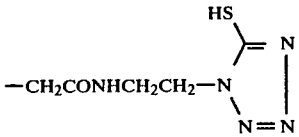 | 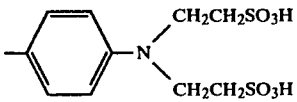 | —CH=CH— | — |
| VI-24 | 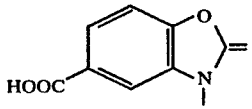 | 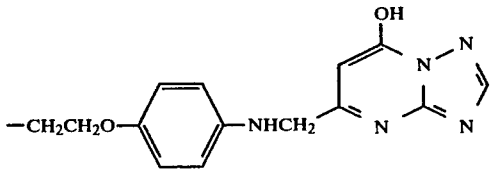 | 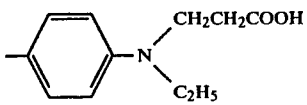 | —CH=CH— | —CH=CH— |
$E^{71}=L^{71}-(L^{72}=L^{73})_{m1}-Ar^{71}$
| No. | $E^{71}$ | $Ar^{71}$ | $=L^{71}-(L^{72}=L^{73})_{m1}-$ |
|---|---|---|---|
| VI-25 | 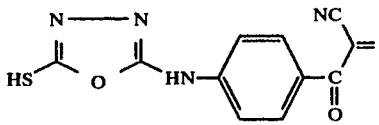 | 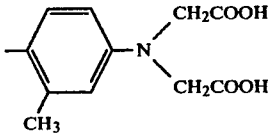 | =CH— |

-continued
| | | | |
|---|---|---|---|
| VI-26 | 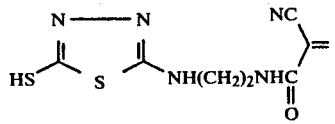 | 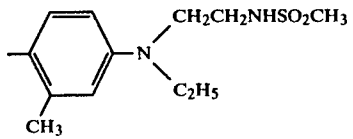 | =CH— |
| VI-27 | 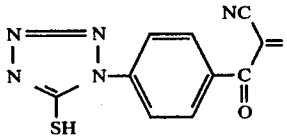 | 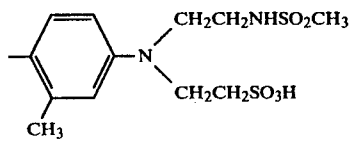 | =CH— |
| VI-28 | 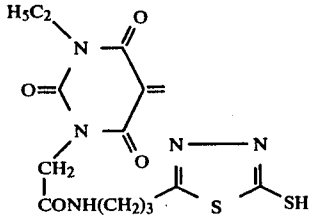 | 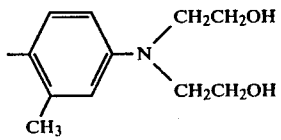 | =CH— |
| VI-29 | 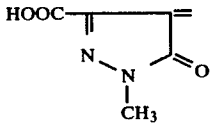 | 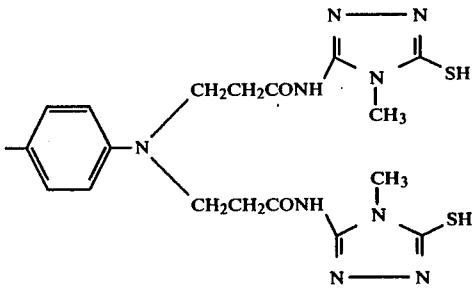 | =CH—CH=CH— |
| VI-30 | 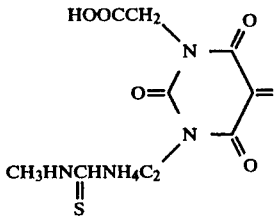 | 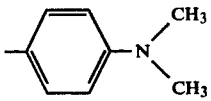 | =CH—CH=CH— |

-continued
| | | | |
|---|---|---|---|
| VI-31 | 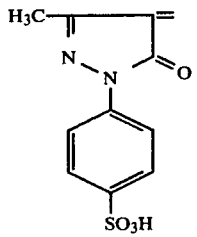 | 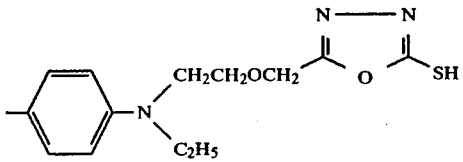 | =CH— |
| VI-32 | 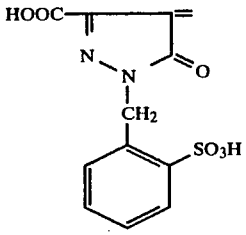 | 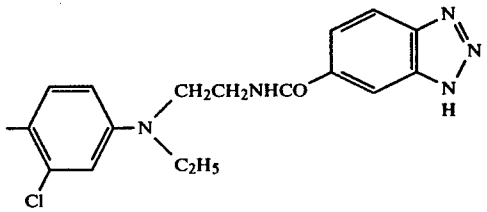 | =CH— |
| VI-33 | 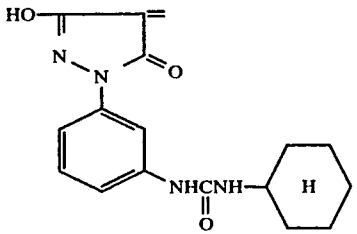 | 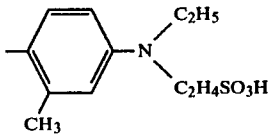 | =CH— |
$Q^{81}{=}(L^{81}{-}L^{82})_{l81}{=}(L^{83}{-}L^{84})_{l82}{=}L^{85}{-}Q^{82}$
| No. | $Q^{81}$ | $Q^{82}$ | $=(L^{81}-L^{82})_{l81}=(L^{83}-L^{84})_{l82}=L^{85}-$ |
|---|---|---|---|
| VI-34 | 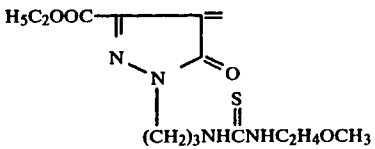 | 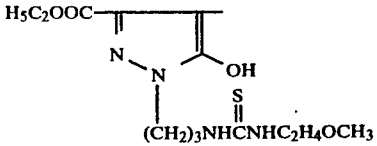 | =CH—CH=CH— |

-continued
| | | | |
|---|---|---|---|
| VI-35 | 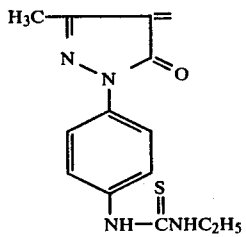 | 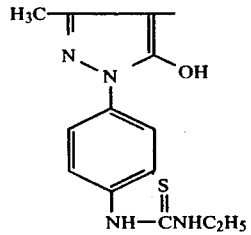 | =CH— |
| VI-36 | 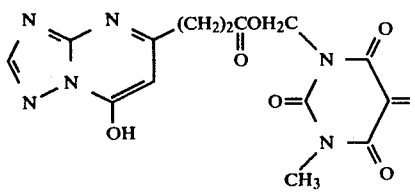 | 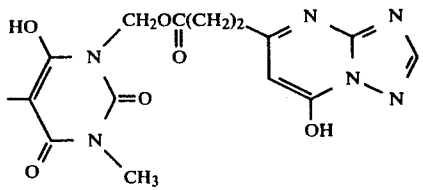 | =CH—CH=CH—CH=CH— |
| VI-37 | 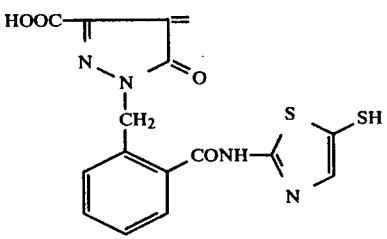 | 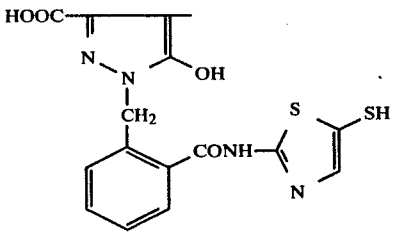 | =CH—CH=CH—CH=CH— |
| VI-38 | 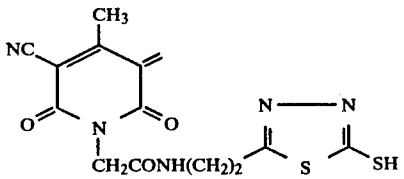 | 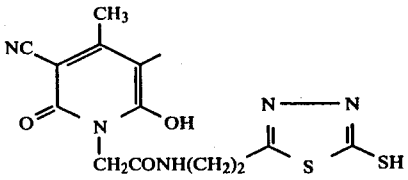 | =CH—CH=CH— |

-continued
| | | | |
|---|---|---|---|
| VI-39 | 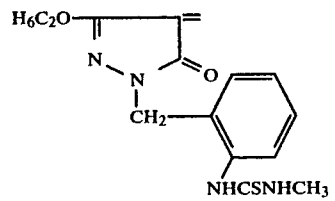 | 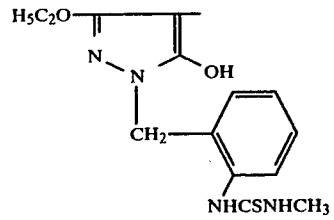 | =CH—CH=CH—CH=CH— |
| VI-40 | 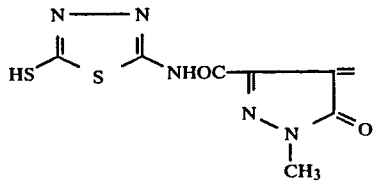 | 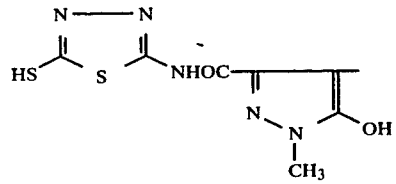 | =CH—CH=CH— |
| VI-41 | 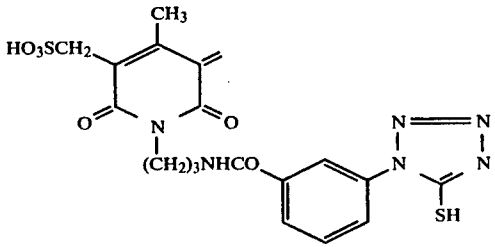 | 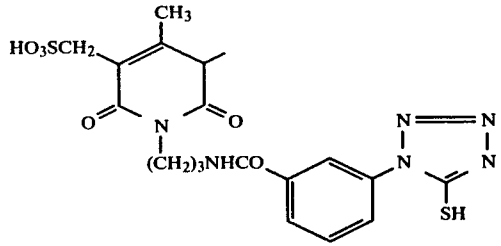 | =CH—CH=CH—CH=CH— |
| VI-42 | 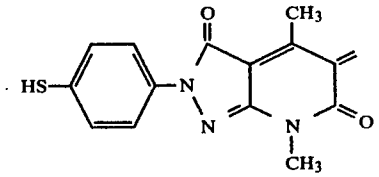 | 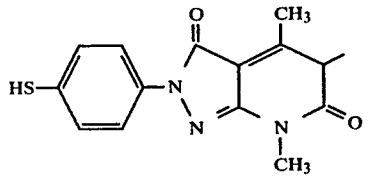 | =CH—CH=CH— |
| VI-43 | 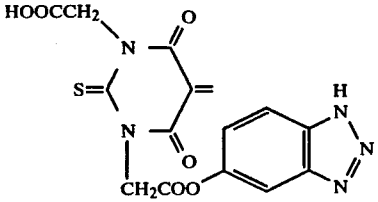 | 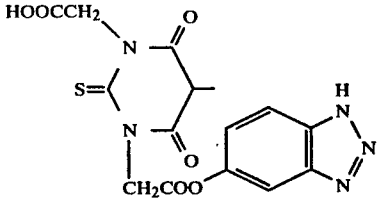 | =CH—CH=CH— |

-continued
VI-44
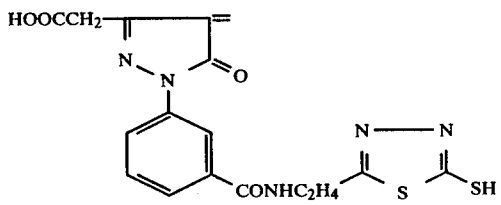
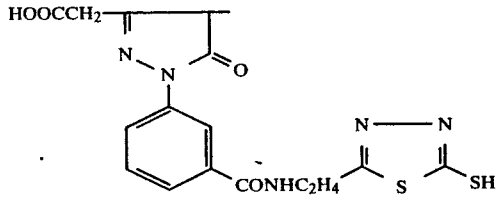
=CH—
VI-45
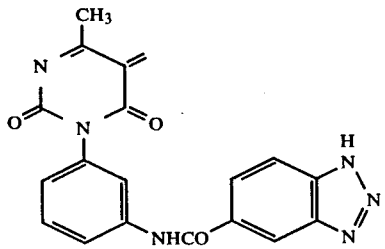
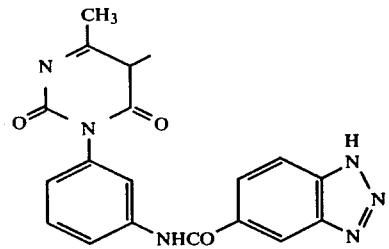
=CH—CH=CH—
VI-46
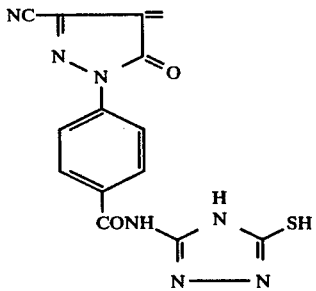
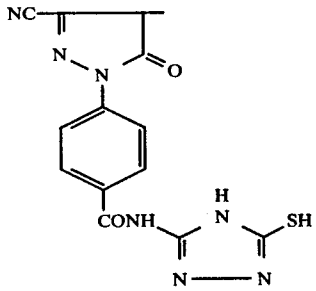
=CH—CH=CH—

-continued
VI-47
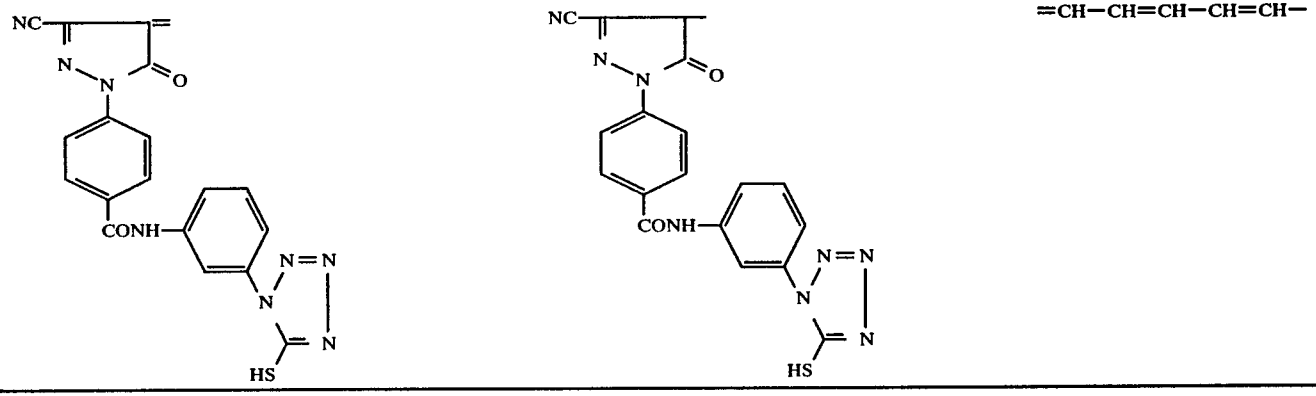
VI-48
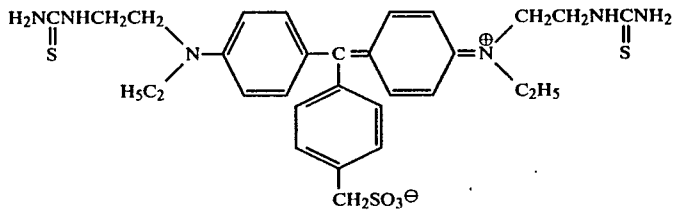
VI-49
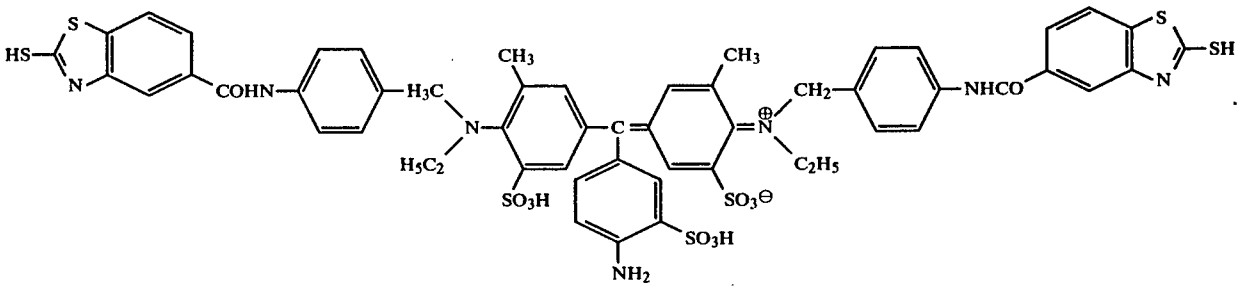

-continued
VI-50
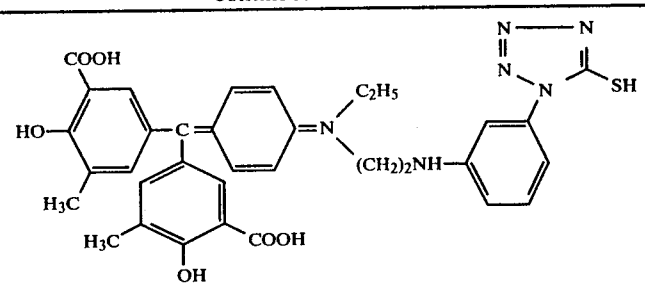
VI-51
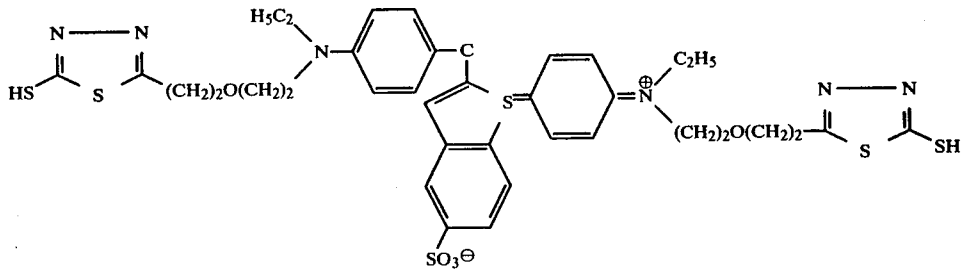
VI-52
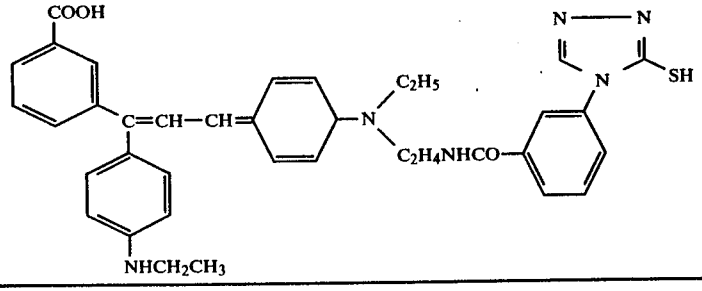

The methine compound relating to the present invention may be prepared by any of the method wherein the desired dye is synthesized from an intermediate material having a sparingly soluble silver salt forming group represented by Sal as a substituent formed therein and the method wherein a methine dye structural moiety represented by Dye and a Sal moiety are bound, which two methods may be optionally selected. Introduction of the Sal group may be achieved using various known binding reactions, including addition to an unsaturated group such as a vinyl group or a carbonyl group, and substitution between an active hydrogen substituent such as an amino group or a hydroxy group and a halogen derivative. These reactions can be carried out with reference to many books, including "Shin Jikken Kagaku Koza 14", Yuki Kagaku no Gosei to Hanno, Vols. I through V, edited by the Chemical Society of Japan, Maruzen (1962), "Organic Reactions", Vols. 1, 3, 12, John Wiley & Sons (New York, London), "The Chemistry of Functional Groups", John Wiley & Sons (New York, London), and L. F. Fieser and M. Fieser, "Advanced Organic Chemistry", Maruzen (1962).

These methine dyes relating to the present invention are reacted with an aqueous solution of a soluble silver salt to a sparingly soluble silver salt, which is then dispersed in the silver halide photographic light-sensitive material.

Among compounds represented by formulas I to VI and I' to V', those represented by formula I are most preferably used in the invention.

Next, the yellow coupler represented by formula Y-I is described below.

Formula Y-I

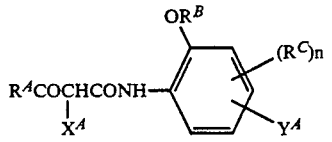

wherein $R^A$ represents an alkyl group or a cycloalkyl group; $R^B$ represents an alkyl group, a cycloalkyl group, an aryl group or an acyl group; $R^C$ represents a group capable of being a substituent of the benzene ring; n represents 0 or 1; $X^A$ represents a group capable of splitting off upon coupling with the oxidation product of a developing agent; $Y^A$ represents an organic group.

Examples of the alkyl group for $R^A$ in formula Y-I include a methyl group, an ethyl group, an isopropyl group, a t-butyl group and a dodecyl group. These alkyl groups for $R^A$ may have a substituent. Examples of the substituent include a halogen atom, an aryl group, an alkoxy group, an aryloxy group, an alkylsulfonyl group, an acylamino group and a hydroxyl group.

Examples of the cycloalkyl group for $R^A$ include a cyclopropyl group, a cyclohexyl group and an adamantyl group, with preference given to a branched alkyl group, more specifically a t-butyl group.

Examples of the alkyl group or cycloalkyl group for $R^B$ in formula Y-I include the same groups as those specified for $R^A$. Examples of the aryl group for $R^B$ include a phenyl group. These alkyl groups, cycloalkyl groups and aryl groups represented by $R^B$ include those having the same substituent as specified for $R^A$. Examples of the acyl group for $R^B$ include an acetyl group, a propionyl group, a butyryl group, a hexanoyl group and a benzoyl group. The group for $R^B$ is preferably an alkyl group or an aryl group, more preferably an alkyl group, and still more preferably a lower alkyl group having not more than 5 carbon atoms.

Examples of the group capable of being a substituent of the benzene ring, represented by $R^C$ in formula Y-I, include halogen atoms such as a chlorine atom, alkyl groups such as an ethyl group, an isopropyl group and a t-butyl group, alkoxy groups such as a methoxy group, aryloxy groups such as a phenyloxy group, acyloxy groups such as a methylcarbonyloxy group and a benzoyloxy group, acylamino groups such as an acetamido group and a phenylcarbonylamino group, carbamoyl groups such as an N-methylcarbamoyl group and an N-phenylcarbamoyl group, alkylsulfonylamino groups such as an ethylsulfonylamino group, arylsulfonylamino groups such as a phenylsulfonylamino group, sulfamoyl groups such as an N-propylsulfamoyl group and an N-phenylsulfamoyl group and imido groups such as a succinimido group and glutarimido group. n represents 0 or 1.

In formula Y-I, $Y^A$ represents an organic group without limitation, but preference is given to a group represented by the following formula Y-II.

$$-J-R^D \qquad \text{Formula Y-II}$$

wherein J represents $-N(R^E)-CO-$, $-CON(R^E)-$, $-COO-$, $-N(R^E)-SO_2-$ or $-SO_2-N(R^E)-$; $R^D$ and $R^E$ independently represent a hydrogen atom, an alkyl group, an aryl group or a heterocyclic group.

Examples of the alkyl groups for $R^D$ and $R^E$ include a methyl group, an ethyl group, an isopropyl group, a t-butyl group and a dodecyl group. Examples of the aryl groups for $R^D$ and $R^E$ include a phenyl group and a naphthyl group. These alkyl groups or aryl groups represented by $R^D$ and $R^E$ include those having a substituent. The substituent is not subject to limitation; typical examples thereof include halogen atoms such as a chlorine atom, alkyl groups such as an ethyl group and a t-butyl group, aryl groups such as a phenyl group, a p-methoxyphenyl group and a naphthyl group, alkoxy groups such as an ethoxy group and a benzyloxy group, aryloxy groups such as a phenoxy group, alkylthio groups such as an ethylthio group, arylthio groups such as a phenylthio group, alkylsulfonyl groups such as a β-hydroxyethylsulfonyl group and arylsulfonyl groups such as a phenylsulfonyl group. Examples also include acylamino groups such as an alkylcarbonylamino group, specifically an acetamido group, and an arylcarbonylamino group, specifically a phenylcarbonylamino group, carbamoyl groups, including those substituted by an alkyl group, an aryl group preferably a phenyl group or another substituent, such as an N-methylcarbamoyl group and an N-phenylcarbamoyl group, acyl groups such as an alkylcarbonyl group, specifically an acetyl group, and an arylcarbonyl group, specifically a benzoyl group, sulfonamide groups such as an alkylsulfonylamino group and an arylsulfonylamino group, specifically a methylsulfonylamino group and an benzenesulfonamide group, sulfamoyl groups, including those substituted by an alkyl group, an aryl group preferably a phenyl group or another substituent, specifically an N-propylsulfamoyl group and an N-phenylsulfamoyl group, a hydroxy group and a nitrile group.

The preferable group represented by $-J-R^D$ is $-NHCOR'^D$, wherein $R'^D$ represents an organic group, preferably a linear or branched alkyl group having 1 to 30 carbon atoms, such as a methyl group, an thyl group, an n-propyl group, an isopropyl group, a t-butyl group, an n-pentyl group, an n-hexyl group, a 2-ethylhexyl group, an n-octyl group, an n-decyl group, a linear or branched dodecyl group, a tridecyl group, a tetradecyl group, a pentadecyl group, a hexadecyl group, a heptadecyl group, an octadecyl group, a nonadecyl group, an eicosyl group, a docosyl group, a tetracosyl group and a hexacosyl group. Of these alkyl groups, those having 8 to 20 carbon atoms are particularly preferable.

In formula Y-I, $X^A$ represents a group splitting off upon coupling reaction with the oxidation product of a developing agent. Examples of such groups include those represented by the following formula Y-III or Y-IV, with preference given to those represented by formula Y-IV.

$$-OR^F \qquad \text{Formula Y-III}$$

wherein $R^F$ represents an aryl group or a heterocyclic group, both of which may have a substituent.

Formula Y-IV

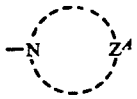

wherein $Z^A$ represents a group of non-metallic atoms necessary to form a 5- or 6-membered ring in cooperation with the nitrogen atom. Examples of the group of non-metallic atoms necessary to form the 5- or 6-membered ring include a methylene group, a methine group, a substituted methine group, $>C=O$, $>NR^G$, $R^G$ has the same definition as $R^E$ above, $-N=$, $-O-$, $-S-$ and $-SO_2-$.

The yellow coupler represented by formula Y-I may bind at the $R^A$, $R^C$ or $Y^A$ moiety to form a bis configuration.

Next, examples of the yellow coupler represented by formula Y-I are given below.

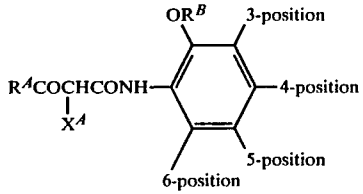
| No. | $R^A$ | $R^B$ | $X^A$ | 3-position | 4-position | 5-position | 6-position |
|---|---|---|---|---|---|---|---|
| Y-1 | (t)$C_4H_9$— | —$CH_3$ | 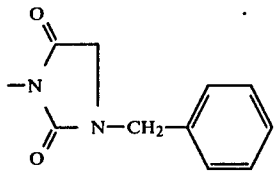 | —H | —H | 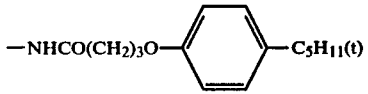 | —H |
| Y-2 | (t)$C_4H_9$— | —$CH_3$ | 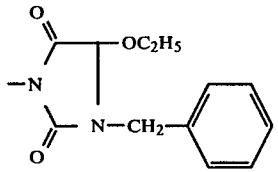 | —H | —H | 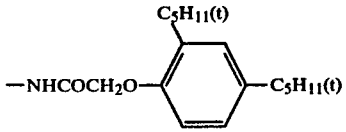 | —H |
| Y-3 | (t)$C_4H_9$— | —$CH_3$ | 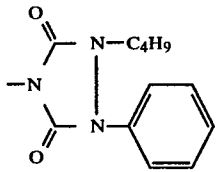 | —H | —H | 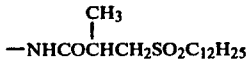 | —H |
| Y-4 | (t)$C_4H_9$— | —$CH_3$ | 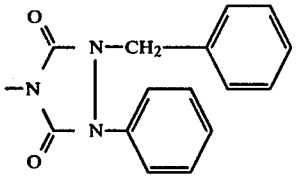 | —H | —H | 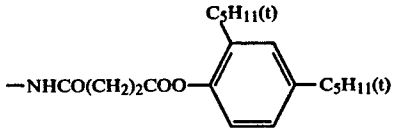 | —H |

-continued
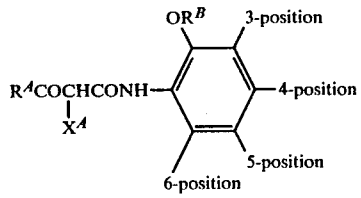
| No. | $R^A$ | $R^B$ | $X^A$ | 3-position | 4-position | 5-position | 6-position |
|---|---|---|---|---|---|---|---|
| Y-5 | (t)$C_4H_9$— | —$CH_3$ | 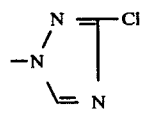 | —H | —H | 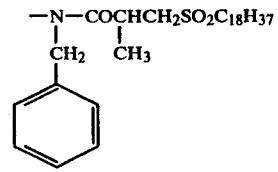 | —H |
| Y-6 | (t)$C_4H_9$— | —$CH_3$ | 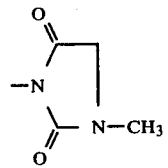 | —H | —H | —$NHCOCHCH_2SO_2C_{12}H_{25}$ (CH$_3$) | —H |
| Y-7 | (t)$C_4H_9$— | —$CH_3$ | 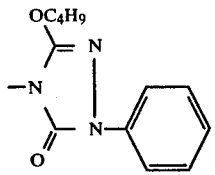 | —H | —H | —$NHCO(CH_2)_2CONC_{12}H_{25}$ ($C_2H_5$) | —H |
| Y-8 | (t)$C_4H_9$— | —$C_3H_7$(iso) | 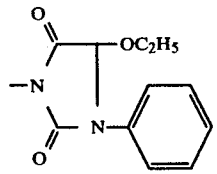 | —H | —H | 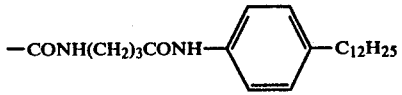 | —H |

-continued
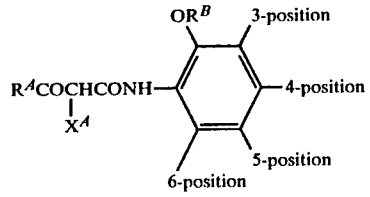
| No. | $R^A$ | $R^B$ | $X^A$ | 3-position | 4-position | 5-position | 6-position |
|---|---|---|---|---|---|---|---|
| Y-9 | (t)$C_4H_9$— | —$CH_3$ | 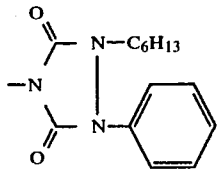 | —H | —H | —NHCO(CH$_3$)CHNHCO—C$_6$H$_4$—O$C_{12}H_{25}$ | —H |
| Y-10 | (t)$C_4H_9$— | —$CH_3$ | 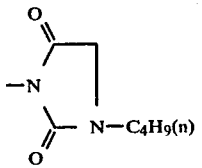 | —H | —H | —NHCO(CH$_3$)CH$_2$SO$_2$$C_{12}H_{25}$ | —H |
| Y-11 | (t)$C_4H_9$— | —$CH_3$ | 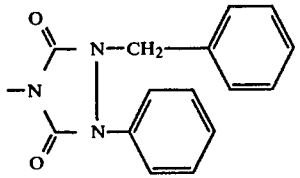 | —H | —H | —CONH(CH$_2$)$_2$NHSO$_2$$C_{12}H_{25}$ | —H |
| Y-12 | (t)$C_4H_9$— | —$CH_3$ | 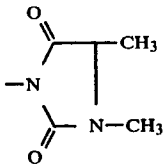 | —H | —H | —NHCO(CH$_3$)CH$_2$SO$_2$$C_{12}H_{25}$ | —H |

-continued
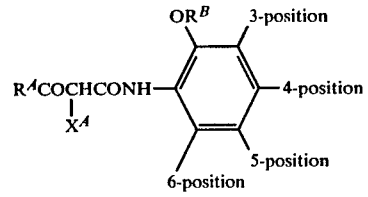
| No. | $R^A$ | $R^B$ | $X^A$ | 3-position | 4-position | 5-position | 6-position |
|---|---|---|---|---|---|---|---|
| Y-13 | (t)$C_4H_9$— | —$CH_3$ | 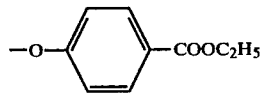 | —H | —H | 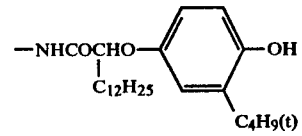 | —H |
| Y-14 | (t)$C_4H_9$— | —$C_{12}H_{25}$ | 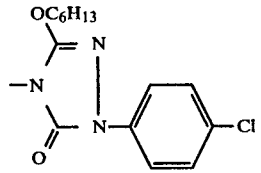 | —H | —H | —$NHCO(CH_2)_2SO_2NHCH_2CHC_4H_9$ \| $C_2H_5$ | —H |
| Y-15 | (t)$C_4H_9$— | —$C_2H_5$ | 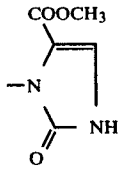 | —H | —H | 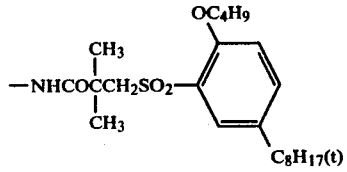 | —H |
| Y-16 | (t)$C_4H_9$— | —$CH_3$ | 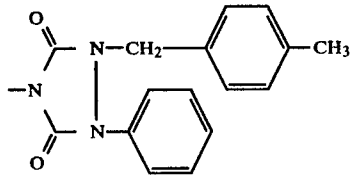 | —H | —H | —$COOC_{12}H_{25}$ | —H |

-continued
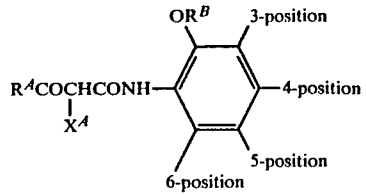
| No. | $R^A$ | $R^B$ | $X^A$ | 3-position | 4-position | 5-position | 6-position |
|---|---|---|---|---|---|---|---|
| Y-17 | 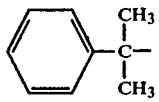 | $-C_{12}H_{25}$ | 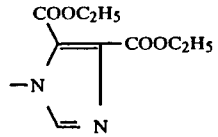 | —H | —H | $-NHCO(CH_2)_3NHCONHCH_2CH(C_2H_5)C_4H_9$ | —H |
| Y-18 | $(t)C_5H_{11}-$ | $-CH_3$ | 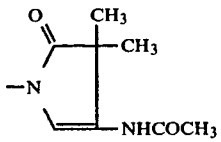 | —H | —H | 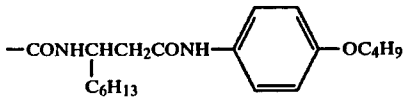 | —H |
| Y-19 | $(t)C_4H_9-$ | $-CH_3$ | 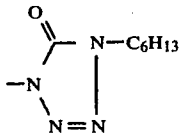 | —H | —H | $-NHCO(CH_2)_3NHCOCH_2CH(C_8H_{17})C_6H_{13}$ | —H |
| Y-20 | $(t)C_4H_9-$ | $-CH_3$ | 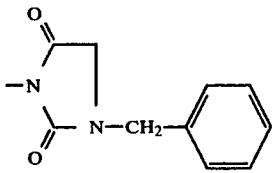 | —H | —H | $-NHCOC_{13}H_{27}(n)$ | —H |
| Y-21 | $(t)C_4H_9-$ | $-CH_3$ | 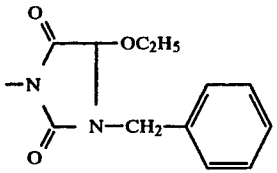 | —H | —H | $-CONHC_{14}H_{29}(n)$ | —H |

-continued
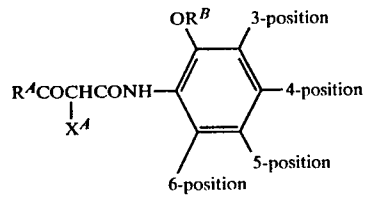
| No. | $R^A$ | $R^B$ | $X^A$ | 3-position | 4-position | 5-position | 6-position |
|---|---|---|---|---|---|---|---|
| Y-22 | (t)$C_4H_9$—  | —$CH_3$ | 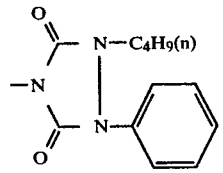 | —H | —H | —$NHCOC_{13}H_{27}$(n) | —H |
| Y-23 | (t)$C_4H_9$— | —$CH_3$ | 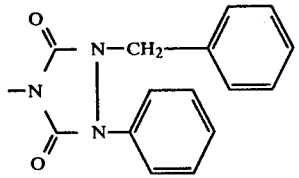 | —H | —H | —$NHCOC_{15}H_{31}$(n) | —H |
| Y-24 | (t)$C_4H_9$— | —$CH_3$ | 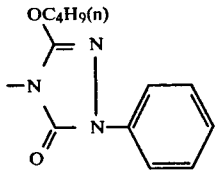 | —H | —H | —$NHCOC_{13}H_{27}$(n) | —H |
| Y-25 | (t)$C_4H_9$— | —$C_3H_7$(iso) | 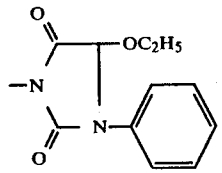 | —H | —H | —$CONHC_{14}H_{29}$(n) | —H |

-continued
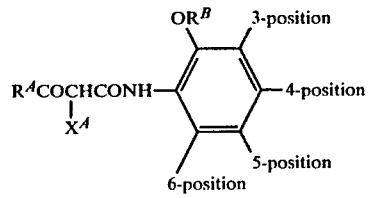
| No. | $R^A$ | $R^B$ | $X^A$ | 3-position | 4-position | 5-position | 6-position |
|---|---|---|---|---|---|---|---|
| Y-26 | (t)$C_4H_9$— | —$CH_3$ | 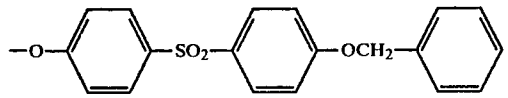 | —H | —H | —$CONHC_{14}H_{29}$(n) | —H |
| Y-27 | (t)$C_4H_9$— | —$C_{18}H_{37}$(n) | 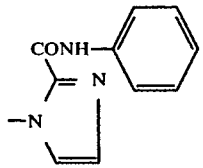 | —H | —H | —NHCO(CH$_3$)CH$_3$ | —H |
| Y-28 | (t)$C_4H_9$— | —$CH_3$ | 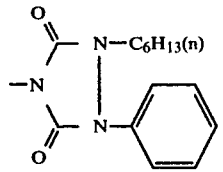 | —H | —H | —$NHCOC_9H_{19}$(n) | —H |
| Y-29 | (t)$C_4H_9$— | —$C_4H_9$ | 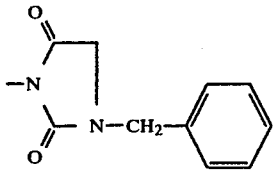 | —H | —H | —$NHCOC_{13}H_{27}$(n) | —H |

-continued
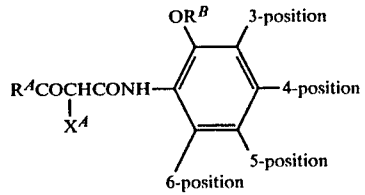
| No. | $R^A$ | $R^B$ | $X^A$ | 3-position | 4-position | 5-position | 6-position |
|---|---|---|---|---|---|---|---|
| Y-30 | (t)$C_4H_9$— | —$CH_3$ | 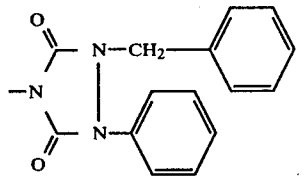 | —H | —H | —$CONHC_{14}H_{29}$(n) | —H |
| Y-31 | (t)$C_4H_9$— | —$C_{12}H_{25}$(n) | 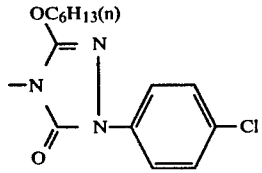 | —H | —H | —$NHCOC_{13}H_{27}$(n) | —H |
| Y-32 | (t)$C_4H_9$— | —$C_2H_5$ | 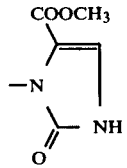 | —H | —H | —$NHCOC_{19}H_{39}$(n) | —H |
| Y-33 | (t)$C_4H_9$— | —$CH_3$ | 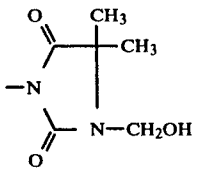 | —H | —H | —$CONHC_{16}H_{33}$(n) | —H |

-continued
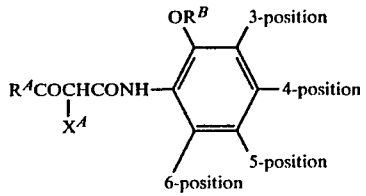
| No. | $R^A$ | $R^B$ | $X^A$ | 3-position | 4-position | 5-position | 6-position |
|---|---|---|---|---|---|---|---|
| Y-34 | (t)$C_4H_9$— | —$CH_3$ | 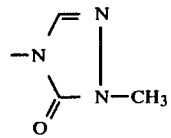 | —H | —H | —$CONHC_{14}H_{29}$(n) | —H |
| Y-35 | (t)$C_4H_9$— | —$CH_3$ | 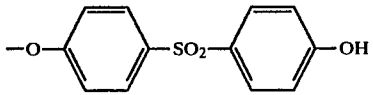 | —H | —Cl | —$NHCOC_{15}H_{31}$(i) | —H |
| Y-36 | (t)$C_4H_9$— | —$CH_3$ | 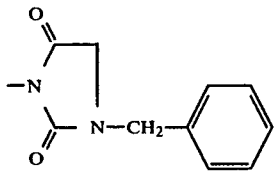 | —H | —H | —$NHCOC_{15}H_{31}$(n) | —H |
| Y-37 | (t)$C_4H_9$— | —$CH_3$ | 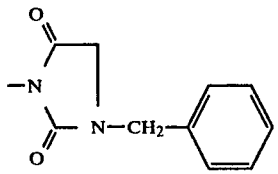 | —H | —H | —$NHCOC_{17}H_{35}$(n) | —H |
| Y-38 | (t)$C_4H_9$— | —$CH_3$ | 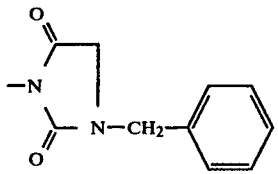 | —H | —H | —$NHCOCHC_{11}H_{23}$(n) $CH_3$ | —H |

-continued
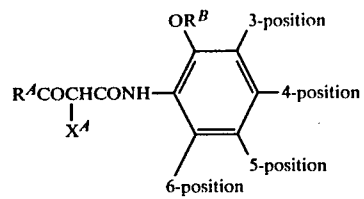
| No. | $R^A$ | $R^B$ | $X^A$ | 3-position | 4-position | 5-position | 6-position |
|---|---|---|---|---|---|---|---|
| Y-39 | (t)$C_4H_9$— | —$CH_3$ | 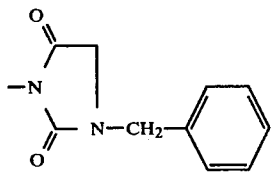 | —H | —H | —NHCO$CH_2$CH($C_6H_{13}$(n))($C_8H_{17}$(n)) | —H |
| Y-40 | (t)$C_4H_9$— | —$CH_3$ | 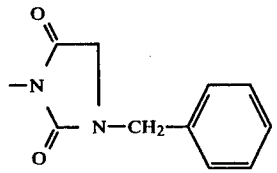 | —H | —H | —NHCO$C(CH_3)_2C_9H_{19}$(n) | —H |
| Y-41 | (t)$C_4H_9$— | —$CH_3$ | 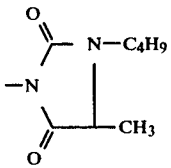 | —H | —H | —NHCO$C_{15}H_{31}$(i) | —H |
| Y-42 | (t)$C_4H_9$— | —$CH_3$ | 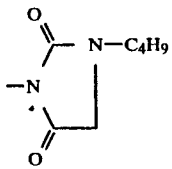 | —H | —H | —NHCO$C_{15}H_{31}$(i) | —H |

-continued
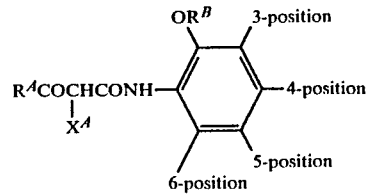
| No. | $R^A$ | $R^B$ | $X^A$ | 3-position | 4-position | 5-position | 6-position |
|---|---|---|---|---|---|---|---|
| Y-43 | (t)$C_4H_9$— | —$CH_3$ | 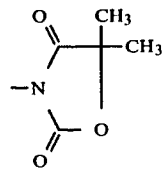 | —H | —H | 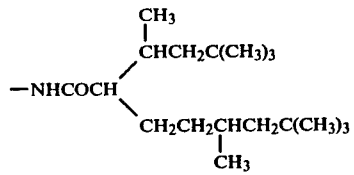 | —H |
| Y-44 | (t)$C_4H_9$— | —$CH_3$ | 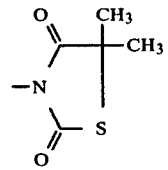 | —H | —H | —$NHSO_2C_{12}H_{25}$ | —H |
| Y-45 | (t)$C_4H_9$— | —$CH_3$ | 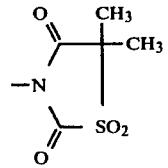 | —H | —Cl | —$COC_9H_{19}$ ‖ O | —H |
| Y-46 | (t)$C_4H_9$— | —$CH_3$ | 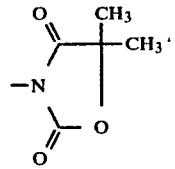 | —H | —H | —$COC_{14}H_{29}$ ‖ O | —H |

-continued
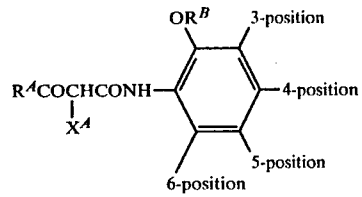
| No. | $R^A$ | $R^B$ | $X^A$ | 3-position | 4-position | 5-position | 6-position |
|---|---|---|---|---|---|---|---|
| Y-47 | (t)$C_4H_9$— | —$CH_3$ | 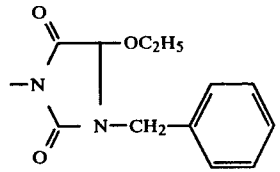 | —H | —H | —$COC_{12}H_{25}$ ‖ O | —H |
| Y-48 | (t)$C_4H_9$— | —$CH_3$ | 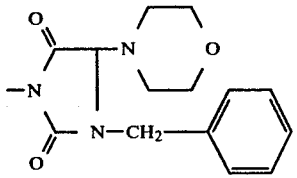 | —H | —H | —$COC_{14}H_{27}$ ‖ O | —H |
| Y-49 | (t)$C_4H_9$— | —$CH_3$ | 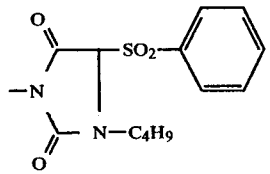 | —H | —H | 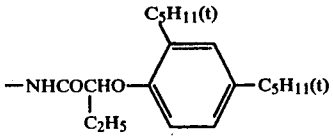 | —H |
| Y-50 | (t)$C_4H_9$— | —$CH_3$ | 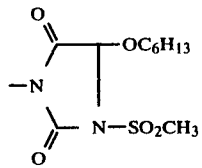 | —H | —H | —$NHCOCHCH_2SO_2C_{12}H_{25}$ \| $CH_3$ | —H |

These yellow couplers of the present invention, represented by formula Y-I, can easily be synthesized by the methods described in Japanese Patent O.P.I. Publication Nos. 123047/1988 and 9051/1992 and Japanese Patent Application No. 245949/1990.

The yellow couplers represented by formula Y-I relating to the present invention may be used singly or in combination, and may be used in combination with other kinds of yellow coupler.

In the present invention, the yellow coupler can be used in the content ratio of usually about $1\times10^{-3}$ to about 1 mol, preferably $1\times10^{-2}$ mol to $8\times10^{-1}$ mol per mol of silver halide.

Next, the magenta coupler represented by formula M-I is described below.

Formula M-I

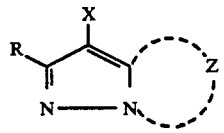

wherein Z represents a group of non-metallic atoms necessary to form a nitrogen-containing heterocyclic ring, which ring may have a substituent.

X represents a hydrogen atom or a group capable of splitting off upon reaction with the oxidation product of a developing agent.

R represents a hydrogen atom or a substituent.

Although there is no limitation on the substituent represented by R, typical examples thereof include alkyl groups, aryl groups, anilino groups, acylamino groups, sulfonamide groups, alkylthio groups, arylthio groups, alkenyl groups and cycloalkyl groups and halogen atoms, cycloalkenyl groups, alkynyl groups, heterocyclic rings, sulfonyl groups, sulfinyl groups, phosphonyl groups, acyl groups, carbamoyl groups, sulfamoyl groups, cyano groups, alkoxy groups, aryloxy groups, heterocyclic oxy groups, siloxy groups, acyloxy groups, carbamoyloxy groups, amino groups, alkylamino groups, imide groups, ureide groups, sulfamoylamino groups, alkoxycarbonylamino groups, aryloxycarbonylamino groups, alkoxycarbonyl groups, aryloxycarbonyl groups, heterocyclic thio groups, spiro compound residues and bridged hydrocarbon compound residues.

The alkyl group for R, whether linear or branched, preferably has 1 to 32 carbon atoms.

The aryl group for R is preferably a phenyl group.

Examples of the acylamino group for R include alkylcarbonylamino groups and arylcarbonylamino groups.

Examples of the sulfonamido group for R include alkylsulfonylamino groups and arylsulfonylamino groups.

The alkyl moiety and aryl moiety in the alkyl thio group and arylthio group represented by R include the alkyl groups and aryl groups specified for R above.

The alkenyl group for R preferably has 2 to 32 carbon atoms. The cycloalkyl group for R preferably has 3 to 12, particularly 5 to 7 carbon atoms. The alkenyl group may be linear or branched.

The cycloalkenyl group for R preferably has 3 to 12, particularly 5 to 7 carbon atoms.

Examples of the sulfonyl group for R include alkylsulfonyl groups and arylsulfonyl groups.

Examples of the sulfinyl group for R include alkylsulfinyl groups and arylsulfinyl groups.

Examples of the phosphonyl group for R include alkylphosphonyl groups, alkoxyphosphonyl groups, aryloxyphosphonyl groups and arylphosphonyl groups.

Examples of the acyl group for R include alkylcarbonyl groups and arylcarbonyl groups.

Examples of the carbamoyl group for R include alkylcarbamoyl groups and arylcarbamoyl groups.

Examples of the sulfamoyl group for R include alkylsulfamoyl groups and arylsulfamoyl groups.

Examples of the acyloxy group for R include alkylcarbonyloxy groups and arylcarbonyloxy groups.

Examples of the carbamoyloxy group for R include alkylcarbamoyloxy groups and arylcarbamoyloxy groups.

Examples of the ureido group for R include alkylureido groups and arylureido groups.

Examples of the sulfamoylamino group for R include alkylsulfamoylamino groups and arylsulfamoylamino groups.

The heterocyclic group for R is preferably a 5- to 7-membered ring, including a 2-furyl group, a 2-thienyl group, a 2-pyrimidinyl group and a 2-benzothiazolyl group.

The heterocyclic oxy group for R preferably has a 5- to 7-membered heterocyclic ring, including a 3,4,5,6-tetrahydropyranyl-2-oxy group and a 1-phenyltetrazol-5-oxy group.

The heterocyclic thio group for R is preferably a 5- to 7-membered heterocyclic thio group, including a 2-pyridylthio group, a 2-benzothiazolylthio group and a 2,4-diphenoxy-1,3,5-triazole-6-thio group.

Examples of the siloxy group for R include a trimethylsiloxy group, a triethylsiloxy group and a dimethylbutylsiloxy group.

Examples of the imido group for R include an succinimido group, a 3-heptadecylsuccinimido group, a phthalimido group and a glutarimido group.

Examples of the spiro compound group for R include spiro[3.3]heptan-1-yl.

Examples of the bridged hydrocarbon compound group for R include bicyclo[2.2.1]heptan-1-yl, tricyclo[3.3.1.1$^{3,7}$]decan-1-yl and 7,7-dimethyl-bicyclo[2.2.1-]heptan-1-yl.

Examples of the substituent capable of splitting off upon reaction with the oxidation product of a color developing agent, represented by X, include halogen atoms such as a chlorine atom, a bromine atom and a fluorine atom, alkoxy groups, aryloxy groups, heterocyclic oxy groups acyloxy groups, sulfonyloxy groups, alkoxycarbonyloxy groups, aryloxycarbonyl groups, alkyloxyaryloxy groups, alkoxyoxaryloxy groups, alkylthio groups, arylthio groups, heterocyclic thio groups, alkyloxythiocarbonylthio groups, acylamino groups, sulfonamido groups, nitrogen-containing heterocyclic rings bound via nitrogen atom, alkyloxycarbonylamino groups, aryloxycarbonylamino groups, carboxyl groups, and

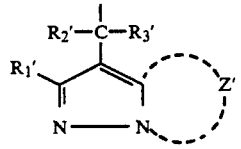

wherein $R_1'$ has the same definition as R above; Z' has the same definition as Z above; $R_2'$ and $R_3'$ independently represent a hydrogen atom, an aryl group, an alkyl group or a heterocyclic group. Preferably, X is a halogen atom, particularly a chlorine atom.

Examples of the nitrogen-containing heterocyclic ring formed by Z or Z' include a pyrazole ring, an imidazole ring, a triazole ring and a tetrazole ring. Examples of the substituent which may be present in said ring include those specified for R above.

The compound represented by Formula M-I is more specifically represented by the following formulas M-II through M-VII.

Formula M-II

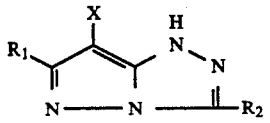

Formula M-III

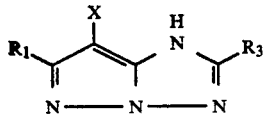

Formula M-IV

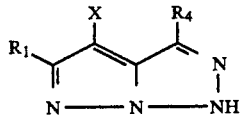

Formula M-V

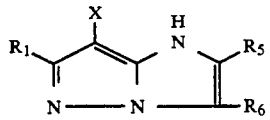

Formula M-VI

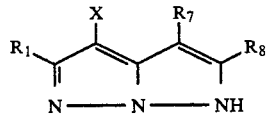

Formula M-VII

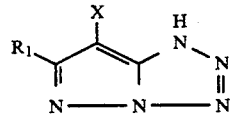

With respect to the above formulas M-II through M-VII, $R_1$ through $R_8$ and X have the same definitions as R and X above.

Of the compounds represented by formula M-I, those represented by the following formula M-VIII are preferred.

Formula VIII

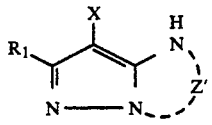

wherein $R_1$, X and $Z_1$ have the same definitions as R, X and Z in formula M-I.

Of the magenta couplers represented by the above formulas M-II through M-VII, those represented by the following formula M-II are preferred.

The substituents R and $R_1$ on the heterocyclic ring described above are most preferably represented by the following formula M-IX.

Formula IX

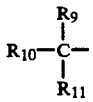

wherein $R_9$, $R_{10}$ and $R_{11}$ have the same definitions as R above.

Two of $R_9$, $R_{10}$ and $R_{11}$, e.g., $R_9$ and $R_{10}$, may bind to form a saturated or unsaturated ring, e.g., cycloalkane, cycloalkene or a heterocyclic ring, which ring may be further bound with $R_{11}$ to form a bridged hydrocarbon compound residue.

With respect to formula M-IX, the following two cases are preferred: (i) at least two of $R_9$ through $R_{11}$ are alkyl groups, (ii) one of $R_9$ through $R_{11}$, e.g., $R_{11}$, is a hydrogen atom, while the other two, $R_9$ and $R_{10}$, bind to form a cycloalkyl in cooperation with the base carbon atom.

With respect to case (i), it is preferable that two of $R_9$ through $R_{11}$ are alkyl groups, while the other one is a hydrogen atom or an alkyl group.

The ring formed by Z in formula M-I, the substituent which the ring formed by $Z_1$ in formula M-VIII may have, and $R_2$ through $R_8$ in formulas M-II through M-VI are preferably represented by the following formula M-X.

Formula M-X $$-R_{12}\text{-}SO_2\text{-}R_{13}$$

wherein $R_{12}$ represents an alkylene group; $R_{13}$ represents an alkyl group, a cycloalkyl group or an aryl group.

The alkylene group for $R_{12}$ preferably has not less than 2 carbon atoms, more preferably 3 to 6 carbon atoms in the linear chain moiety thereof, whether linear or branched.

The cycloalkyl group for $R_{13}$ preferably has 5 or 6 members.

Typical examples of the compound relating to the present invention are given below.

M-1

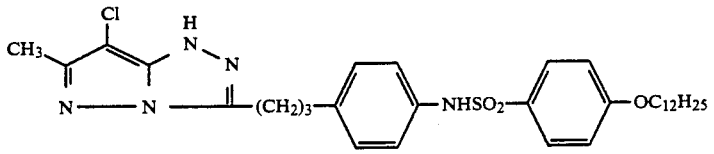

-continued
M-2
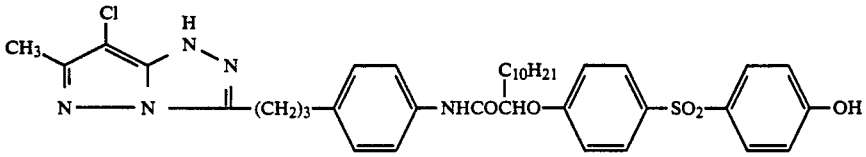
M-3
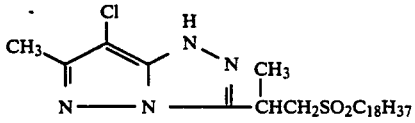
M-4
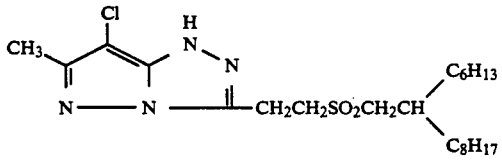
M-5
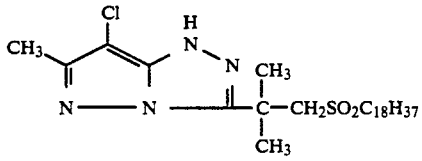
M-6
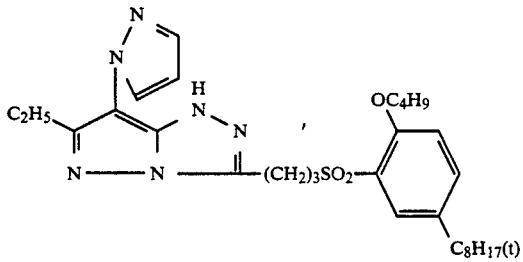
M-7
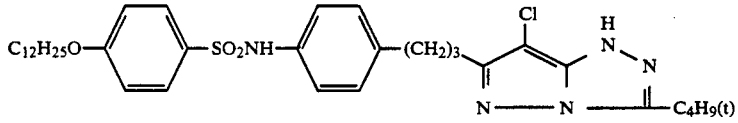
M-8
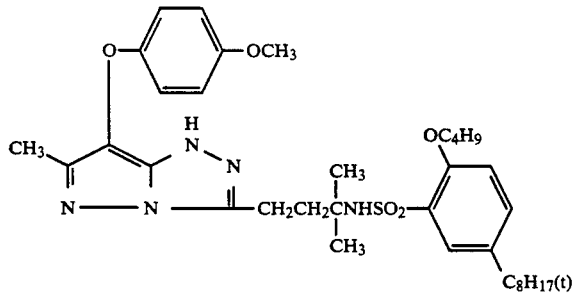
M-9
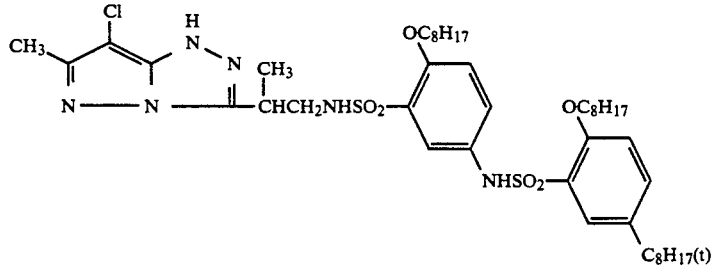

-continued
M-10
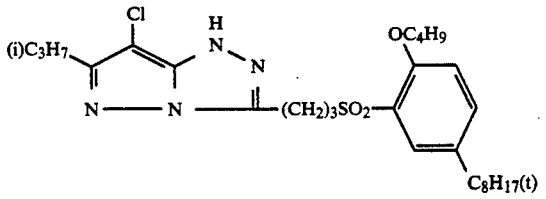
M-11
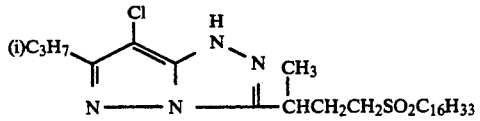
M-12
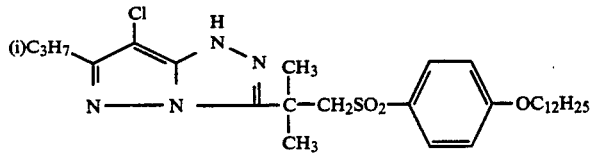
M-13
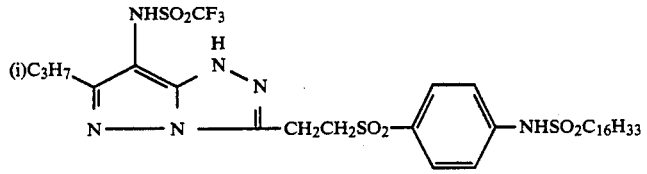
M-14
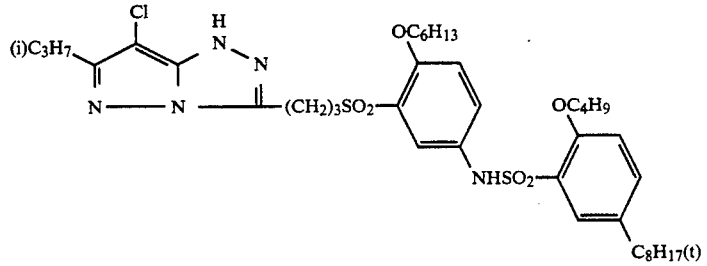
M-15
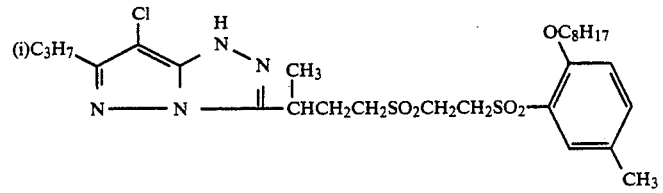
M-16
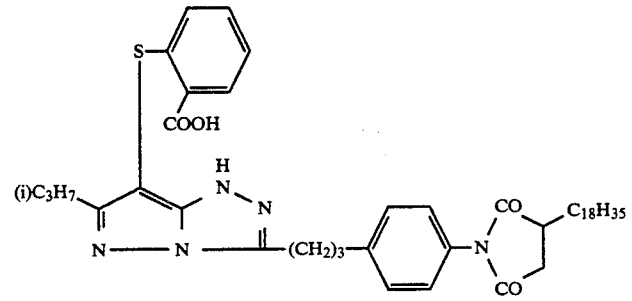
M-17
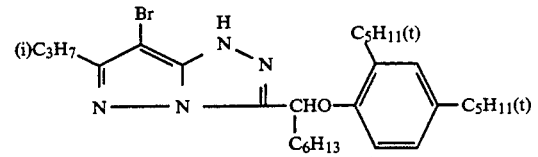

-continued
M-18
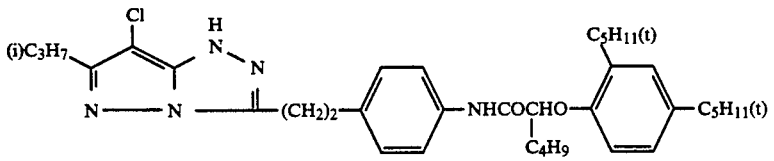
M-19
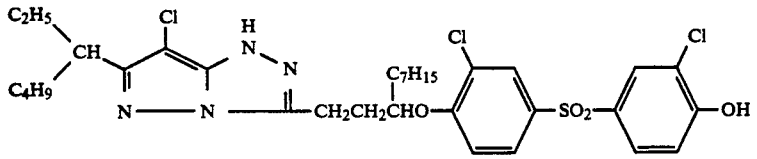
M-20
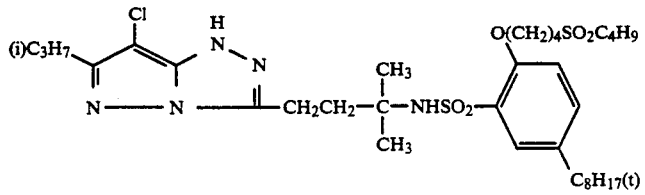
M-21
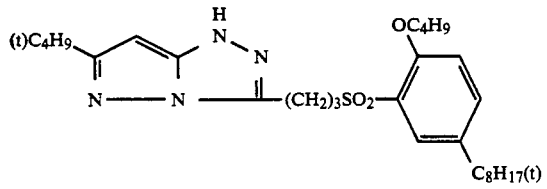
M-22
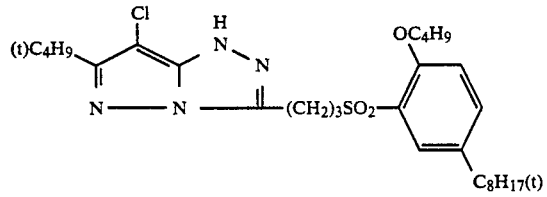
M-23
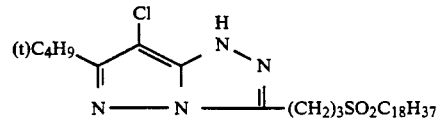
M-24
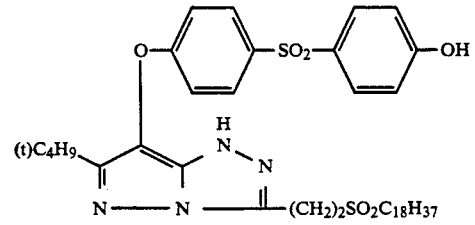
M-25
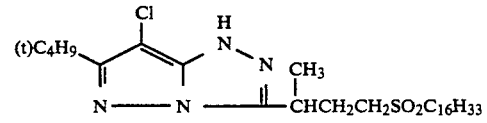
M-26
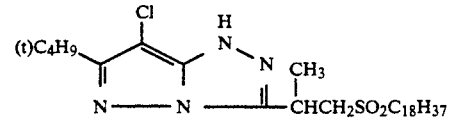

-continued
M-27
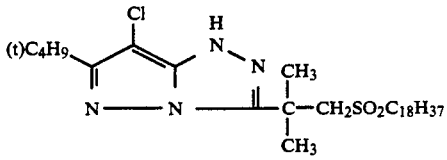
M-28
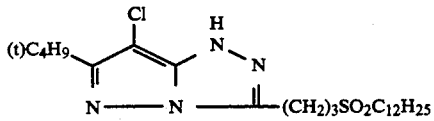
M-29
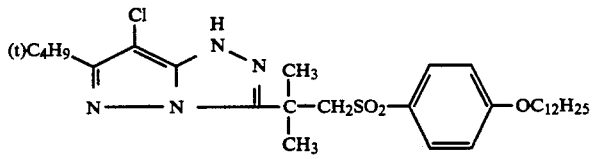
M-30
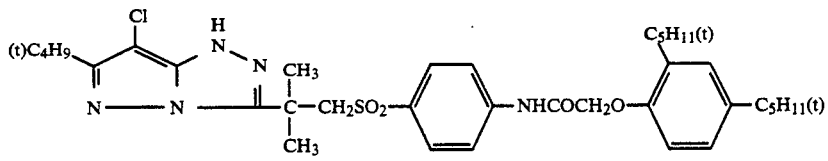
M-31
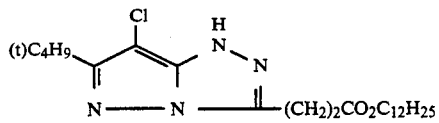
M-32
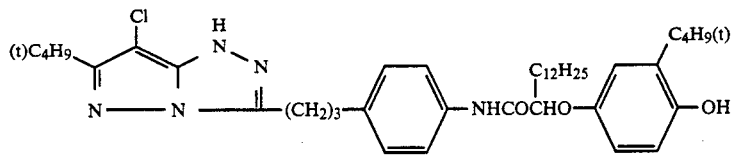
M-33
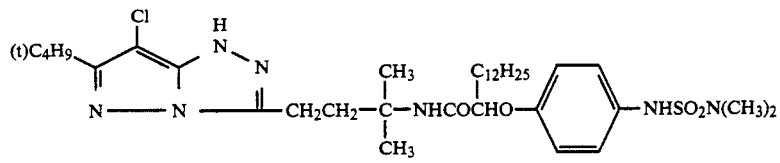
M-34
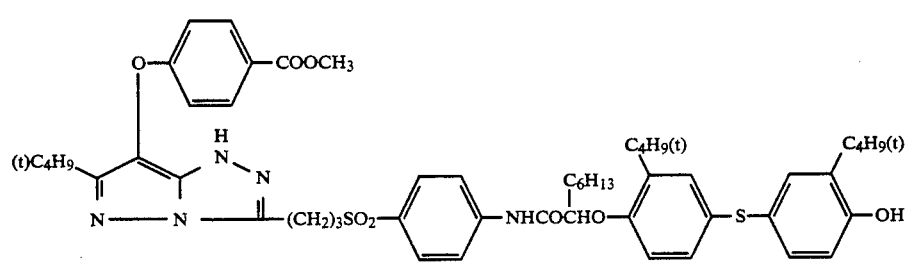
M-35
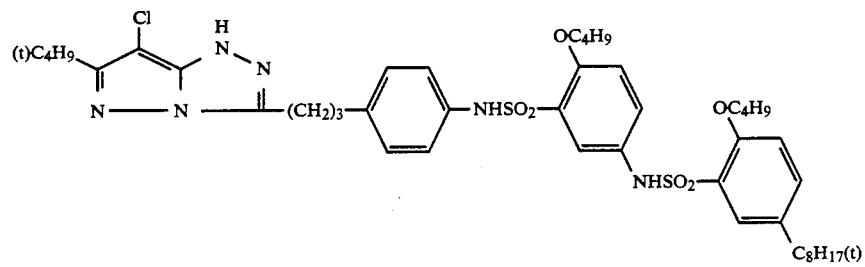

-continued
M-36
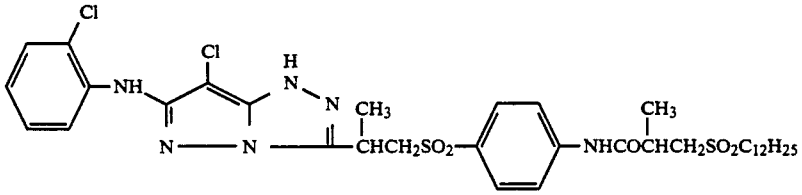
M-37
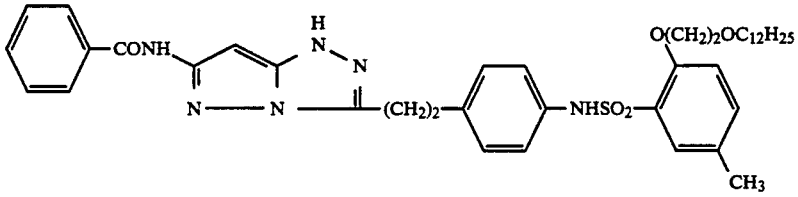
M-38
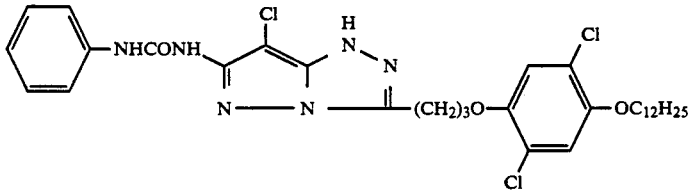
M-39
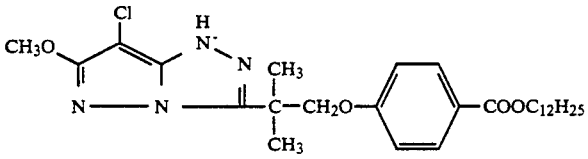
M-40
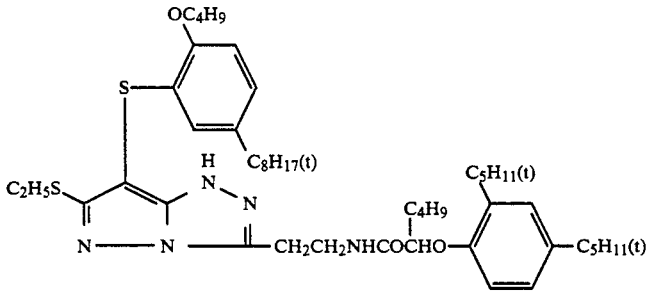
M-41
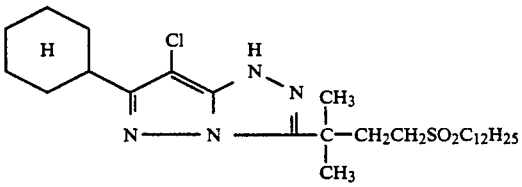
M-42
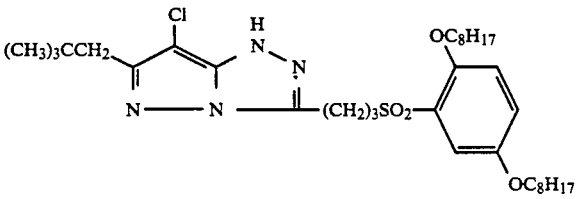

-continued
M-43
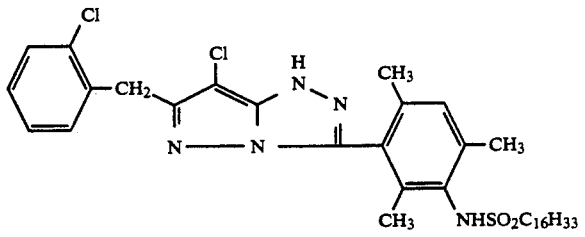
M-44
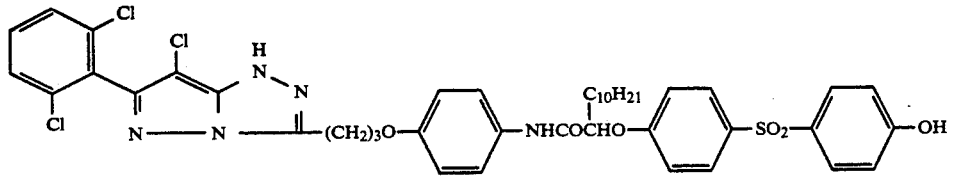
M-45
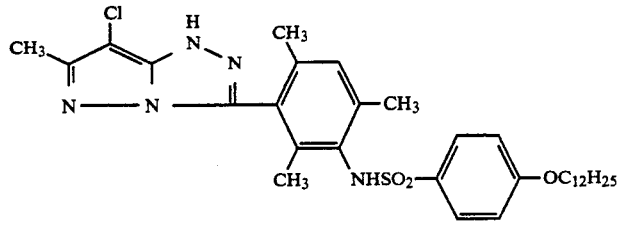
M-46
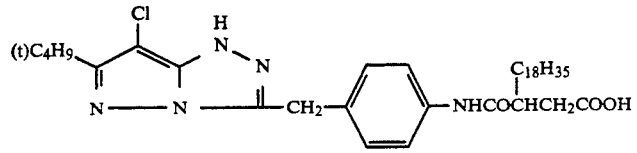
M-47
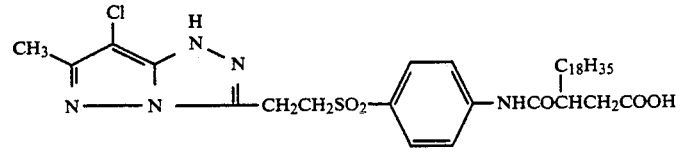
M-48
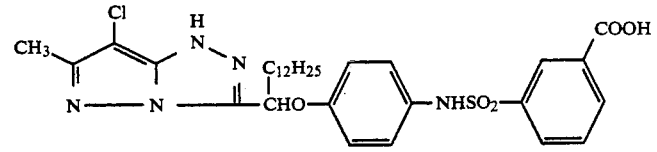
M-49
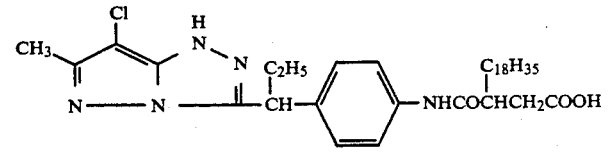
M-50
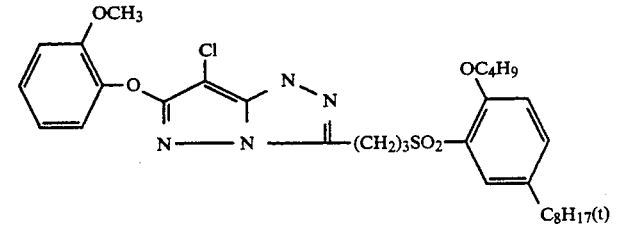

-continued
M-51
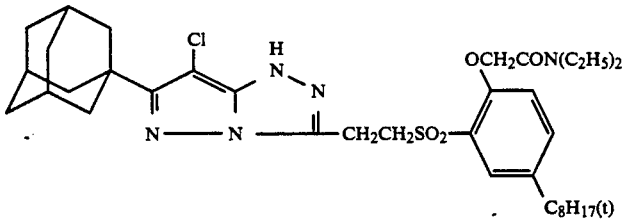
M-52
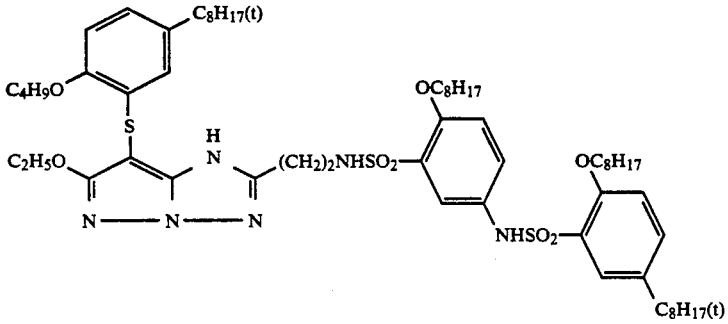
M-53
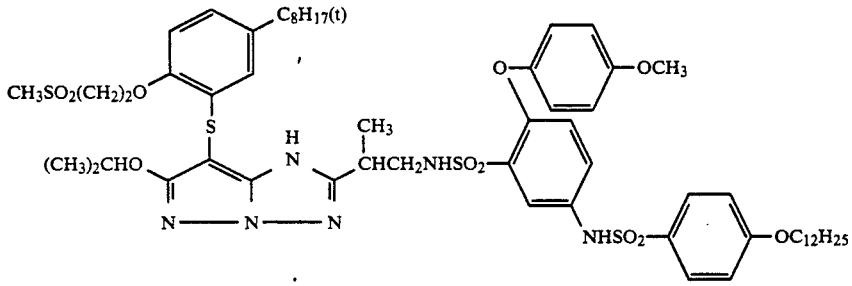
M-54
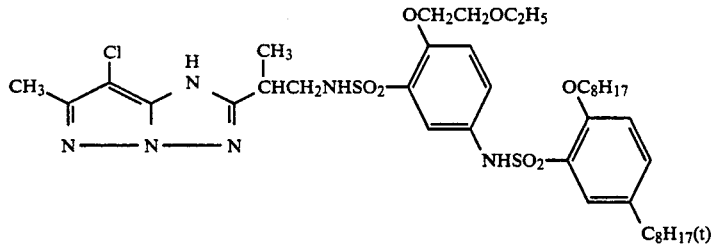
M-55
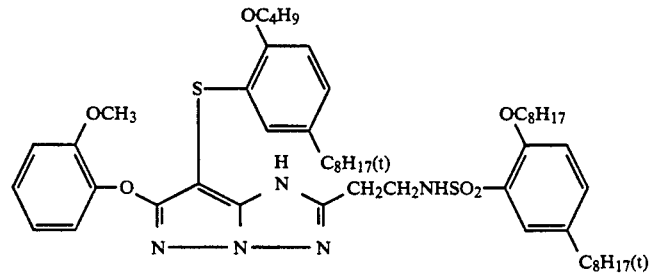

-continued
M-56
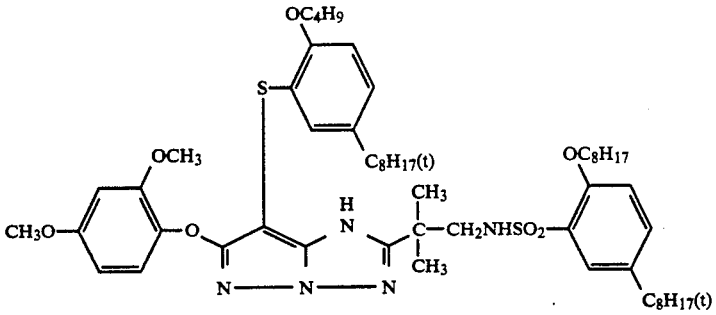
M-57
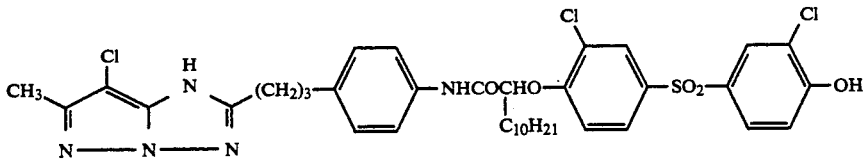
M-58
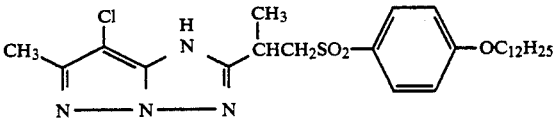
M-59
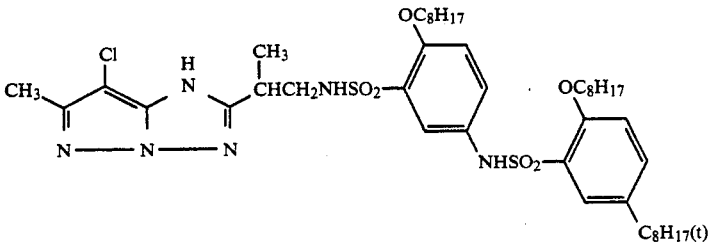
M-60
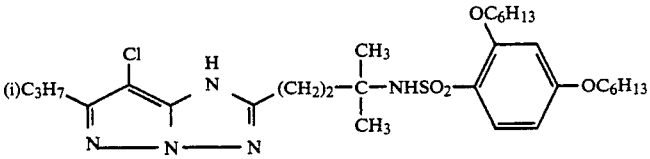
M-61
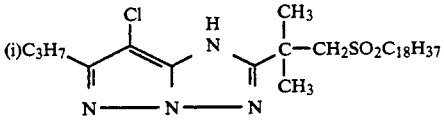
M-62
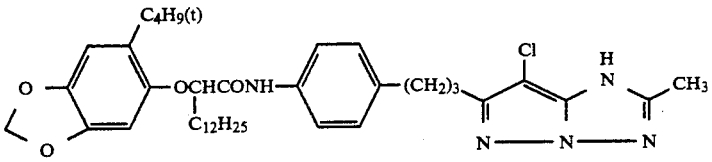
M-63
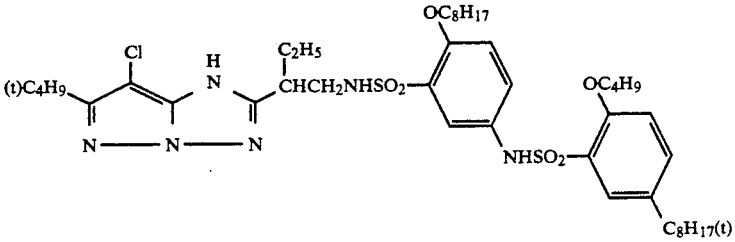

-continued
M-64
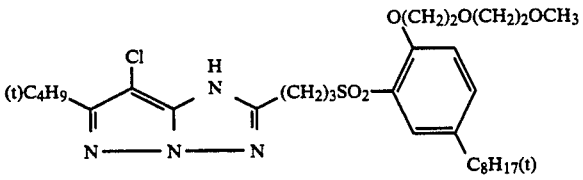
M-65
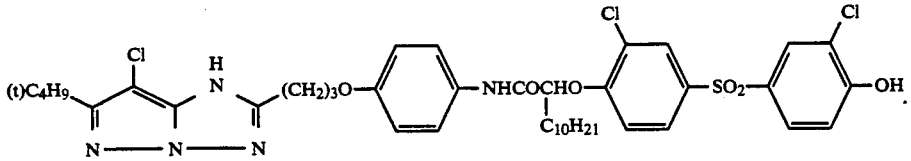
M-66
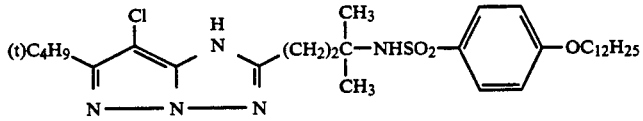
M-67
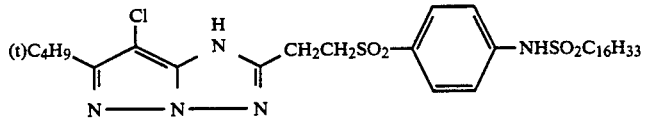
M-68
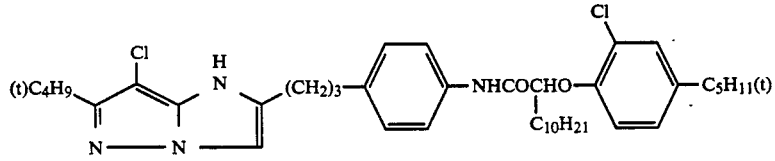
M-69
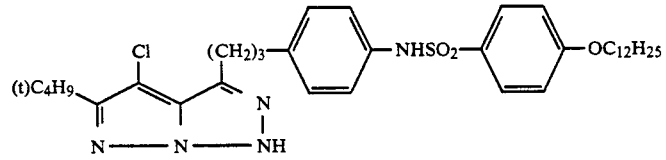
M-70
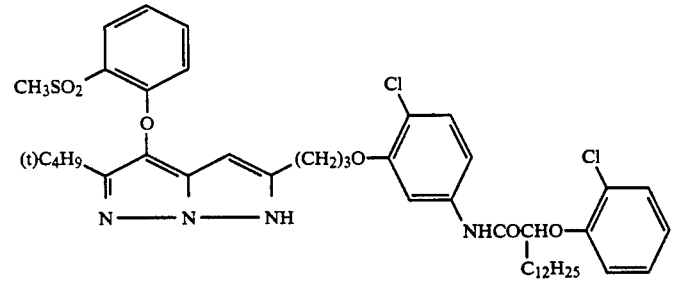
M-71
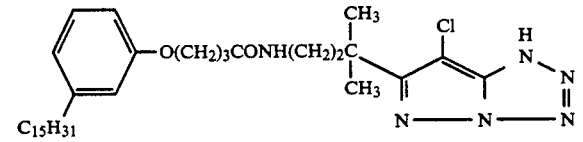
M-72
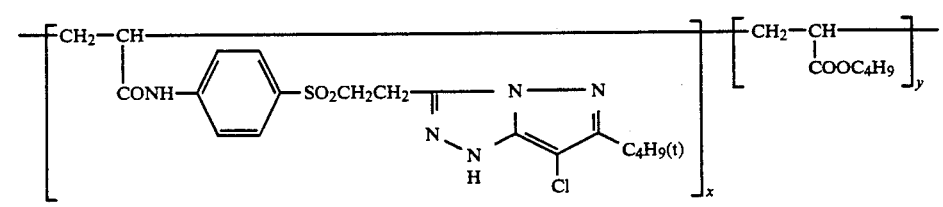
x:y = 50:50

-continued

M-73

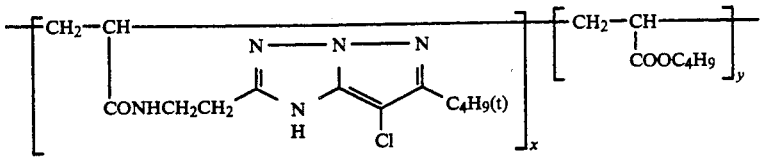

x:y = 50:50

In addition to the typical examples given above, compound Nos. 1 through 4, 6, 8 through 17, 19 through 24, 26 through 43, 45 through 59, 61 through 104, 106 through 121, 123 through 162 and 164 through 223 among those described in pages 18 through 32 of Japanese Patent O.P.I. Publication No. 166339/1987 may also be mentioned as examples of the compound relating to the present invention.

These couplers can be synthesized with reference to the Journal of the Chemical Society, Perkin I (1977), 2047-2052, U.S. Pat. No. 3,725,067 and Japanese Patent O.P.I. Publication Nos. 99437/1984, 42045/1983, 162548/1984, 171956/1984, 33552/1985, 43659/1985, 172982/1985, 190779/1985, 209457/1987 and 307453/1988.

The couplers of the present invention can be used in the content range usually from $1\times10^{-3}$ to 1 mol, preferably from $1\times10^{-2}$ to $8\times10^{-1}$ mol per mol of silver halide. The couplers of the present invention can also be used in combination with other kinds of magenta coupler.

Next, the cyan coupler represented by formula C-I is described below.

Formula C-I

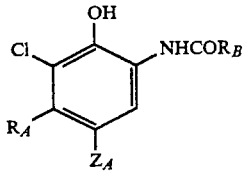

wherein $R_A$ represents an alkyl group having 2 to 6 carbon atoms; $R_B$ represents a ballast group; $Z_A$ represents a hydrogen atom or an atom or group capable of splitting off upon reaction with the oxidation product of a color developing agent.

The alkyl groups represented by $R_A$, whether linear or branched, include those having a substituent. The ballast group for $R_B$ is an organic group having a size and shape which provides the coupler molecule with sufficient bulkiness to make the coupler substantially incapable of diffusing from the layer to which it is added to another layer.

Said ballast group is preferably represented by the following formula.

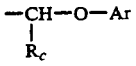

wherein $R_C$ represents an alkyl group having 1 to 12 carbon atoms; Ar represents an aryl group such as a phenyl group, which aryl group may have a substituent.

Examples of the cyan coupler represented by formula C-I are given below, which are not to be construed as limitative.

Formula C-I

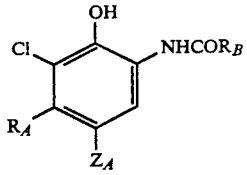

| Coupler | $R_A$ | $Z_A$ | $R_B$ |
|---|---|---|---|
| C-1 | $-C_2H_5$ | $-Cl$ | 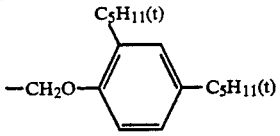 |
| C-2 | $-C_2H_5$ | 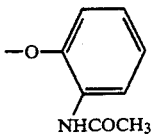 | 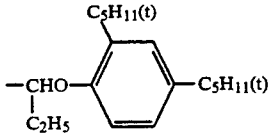 |

-continued
Formula C-I
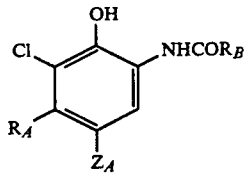
| Coupler | $R_A$ | $Z_A$ | $R_B$ |
|---|---|---|---|
| C-3 | $-CH(CH_3)_2$ | $-Cl$ | $-CH(C_2H_5)-C_6H_3(C_{15}H_{31})$ |
| C-4 | $-C_2H_5$ | $-Cl$ | $-CH(C_2H_5)-C_6H_3(C_5H_{11}(t))-C_5H_{11}(t)$ |
| C-5 | $-C_4H_9$ | $-F$ | $-CH(C_{12}H_{25})-C_6H_4-SO_2-C_6H_4-OH$ |
| C-6 | $-C_2H_5$ | $-F$ | $-CH(C_{12}H_{25})-C_6H_3(C_4H_9(t))-OH$ |
| C-7 | $-C_2H_5$ | $-Cl$ | $-(CH_2)_3O-C_6H_3(C_5H_{11}(t))-C_5H_{11}(t)$ |
| C-8 | $-C_2H_5$ | $-Cl$ | $-CH(C_{12}H_{25})-C_6H_4-NHSO_2C_4H_9$ |
| C-9 | $-C_2H_5$ | $-Cl$ | $-CH(C_{12}H_{25})-C_6H_2(Cl)_2-Cl$ |
| C-10 | $-CH(CH_3)_2$ | $-Cl$ | $-C_{18}H_{37}$ |
| C-11 | $-C_6H_{13}$ | $-Cl$ | $-CH(C_2H_5)-C_6H_3(C_5H_{11}(t))-C_5H_{11}(t)$ |
| C-12 | $-C_3H_7$ | $-Cl$ | $-C_6H_4-NHC(=O)CH(C_2H_5)-C_6H_3(C_5H_{11}(t))-C_5H_{11}(t)$ |

-continued

Formula C-I

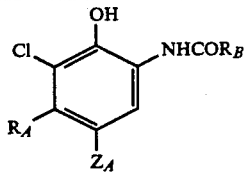

| Coupler | $R_A$ | $Z_A$ | $R_B$ |
|---|---|---|---|
| C-13 | $-C_2H_4NHCCH_3$ ‖ O | $-Cl$ | 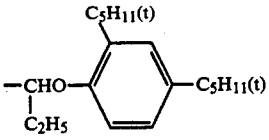 |
| C-14 | $-C_2H_4OCH_3$ | $-Cl$ | 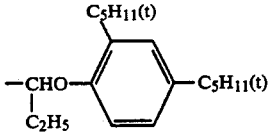 |
| C-15 | $-C_2H_5$ | $-Cl$ | 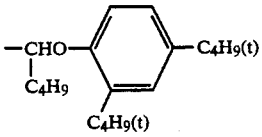 |
| C-16 | $-C_4H_9(t)$ | $-OCH_2CH_2SO_2CH_3$ | 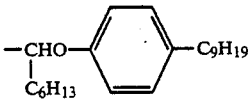 |
| C-17 | $-C_2H_5$ | $-Cl$ | 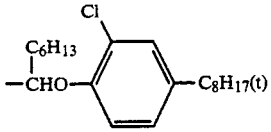 |
| C-18 | $-C_2H_5$ | $-Cl$ | 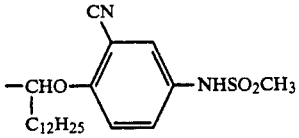 |
| C-19 | $-C_2H_5$ | $-Cl$ | 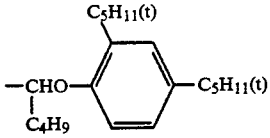 |
| C-20 | $-C_2H_5$ | $-Cl$ | $-C_{16}H_{31}(n)$ |

Examples of cyan couplers which can be used for the present invention, including the above cyan couplers, are described in Japanese Patent Examined Publication No. 11572/1974, Japanese Patent O.P.I. Publication Nos. 3142/1986, 9652/1986, 9653/1986, 39045/1986, 50136/1986, 99141/1986 and 105545/1986 and other publications.

The cyan coupler of the present invention, represented by formula C-I, can be used in the content range usually from $1\times10^{-3}$ to 1 mol, preferably from $1\times10^{-2}$ to $8\times10^{-1}$ mol per mol of silver halide.

In the present invention, the high-chloride silver halide emulsion means a silver chlorobromide, silver chloroiodobromide, silver chloroiodide or silver chloride emulsion comprising not less than 90 mol % of silver chloride. The silver iodide content is preferably not more than 1 mol %, with more preference given to the absence of silver iodide. The silver bromide content is preferably not more than 5 mol %, more preferably not more than 2 mol %, and still more preferably not more than 1 to 0.01 mol %.

Silver iodide and silver bromide are not subject to limitation with respect to their distribution in silver halide grains, whether they are localized in the core or surface of the grains or therebetween or uniformly distributed in the grains.

Silver halide grains may be prepared by any of the acid method, the neutral method, the ammoniacal method and other methods, all of which can be used preferably. A silver halide solvent not based on the ammoniacal method can also be used. The grains may be grown immediately or after seed grain formation. The methods of seed grain formation and growth may be identical or not.

The silver halide emulsion may be formed whether halide ions and silver ions are added simultaneously or one is added to a solution containing the other one.

The silver halide emulsion relating to the present invention may incorporate two or more separately formed silver halide emulsions of different kinds.

The grain size distribution of the silver halide grains used for the present invention may be polydispersed or monodispersed, with preference given to the latter.

The silver halide grains used for the present invention may be supplemented with metal ions using at least one kind selected from the group comprising a cadmium salt, a zinc salt, a lead salt, a thallium salt, an iridium salt or a complex salt thereof, a rhodium salt or a complex salt thereof and an iron salt or a complex salt thereof to contain such metal elements in and/or on the grains during formation and/or growth of silver halide grains. Also, reduction sensitization specks can be provided in and/or on the grains by bringing the grains in an appropriate reducing atmosphere.

The silver halide emulsion of the present invention may be treated to remove the undesirable soluble salts after completion of growth of silver halide grains or may retain said soluble salts. Removal of said salts can be achieved in accordance with the method described in Term II, Research Disclosure (hereinafter referred to as RD for short) No. 17643.

The average grain size of the silver halide grains of the present invention (the diameter of the grains, provided that they are spherical, or the diameter of the circle image with the same area as the projected image, provided that they are in a cubic or other non-spherical form) is preferably not more than 5 μm, more preferably not more than 1 μm.

The silver halide emulsion of the present invention can be chemically sensitized by a conventional method.

It is preferable to chemically sensitize the silver halide emulsion of the present invention as described in British Patent Nos. 618,061, 1,315,755 and 1,396,696, Japanese Patent Examined Publication No. 15748/1969, U.S. Pat. Nos. 1,574,944, 1,623,499, 1,673,522, 2,278,947, 2,399,083, 2,410,689, 2,419,974, 2,448,060, 2,487,850, 2,518,698, 2,521,926, 2,642,361, 2,694,637, 2,728,668, 2,739,060, 2,983,610, 3,021,215, 3,026,203, 3,297,446, 3,297,447, 3,361,564, 3,411,914, 3,554,757, 3,565,631, 3,565,633, 3,591,385, 3,656,955, 3,761,267, 3,772,031, 3,857,711, 3,891,446, 3,001,714, 3,904,415, 3,930,867, 3,984,249, 4,054,457 and 4,067,740, RD Nos. 12008, 13452 and 13564, and "The Theory of the Photographic Process", written by T. H. James, 4th ed. Macmillan, 1977, pp. 67–76.

The silver halide emulsion of the present invention can be optically sensitized in the desired wavelength band using a sensitizing dye.

Each of the red-sensitive, green-sensitive and blue-sensitive silver halide emulsion layers relating to the present invention may be configured with a single layer or two layers with high and low sensitivities, or three layers with high, moderate and low sensitivities, with preference given to two or more layers.

The total amount of silver contained in the sensitive layers is preferably 0.2 to 10 g/m$^2$, more preferably 1 to 8 g/m$^2$.

Total dry film thickness is preferably 8 to 30 μm, more preferably 10 to 25 μm at 23° C. and 55% relative humidity.

The silver halide emulsion may be supplemented with an antifogging agent, a stabilizer and other additives. It is advantageous to use gelatin as a binder for the emulsion.

The emulsion layers and other hydrophilic colloid layers may be hardened, and may contain a plasticizer and a dispersion or latex of a water-insoluble or sparingly soluble synthetic polymer.

The present invention is applicable to any color photographic light-sensitive material, such as color negative films, color reversal films, color printing paper, color positive films, color reversal paper, those for the color diffusion transfer process and those for the dye transfer process.

The emulsion layer of a color photographic light-sensitive material incorporates a coupler. It is also possible to use a colored coupler having a color correction effect, a competitive coupler, and a compound which releases a photographically useful fragment such as a developing accelerator, a bleaching accelerator, a developing agent, a silver halide solvent, a toning agent, a hardener, a fogging agent, an antifogging agent, a chemical sensitizer, a spectral sensitizer or a desensitizer upon coupling with the oxidation product of a developing agent.

The light-sensitive material may incorporate a formalin scavenger, a brightening agent, a matting agent, a lubricant, an image stabilizer, a surfactant, an antifogging agent, a developing accelerator, a developing retarder and a bleaching accelerator.

Examples of materials for the support include paper laminated with polyethylene etc., polyethylene terephthalate films, baryta paper and cellulose triacetate.

For obtaining a dye image using the light-sensitive material of the present invention, exposure is followed by a commonly known processing for color light-sensitive material.

EXAMPLES

Example 1

Layers with the compositions shown in Tables 1 and 2 were coated on a paper support, laminated with polyethylene on one face and titanium-oxide-containing polyethylene on the other face, to yield multiple-layered photographic light-sensitive material No. 1. The coating solutions were prepared as follows.

First layer coating solution 26.7 g of a yellow coupler Y-A, 10.0 g of a dye image stabilizer ST-1, 6.67 g of another dye image stabilizer ST-2, 0.67 g of an additive HQ-1 and 6.67 g of a high boiling organic solvent DNP were dissolved in 60 ml of ethyl acetate. This solution was dispersed in 220 ml of a 10% aqueous solution of gelatin containing 7 ml of 20% surfactant SU-1 using an ultrasonic homogenizer to yield a yellow coupler dispersion. This dispersion was mixed with a blue-sensitive silver chlorobromide emulsion (containing 8.68 g of silver) prepared under the following conditions to yield a first layer coating solution.

Second through seventh layer coating solutions were prepared in procedures similar to the first layer coating solution. Hardeners H-1 and H-2 were added to layers 2 and 4 and layer 7, respectively. Surfactants SU-2 and SU-3, as coating aids, were added to adjust surface tension. Figures for the amount of components of the silver halide photographic light-sensitive material are expressed in gram per $m^2$, unless otherwise stated.

TABLE 1

| Layer | Composition | Amount of addition ($g/m^2$) |
|---|---|---|
| Layer 7: Protective layer | Gelatin | 1.00 |
| | DIDP | 0.005 |
| | Additive HQ-2 | 0.002 |
| | Additive HQ-3 | 0.002 |
| | Additive HQ-4 | 0.004 |
| | Additive HQ-5 | 0.02 |
| | Compound F-1 | 0.002 |
| Layer 6: Ultraviolet absorbing layer | Gelatin | 0.40 |
| | UV absorbent UV-1 | 0.10 |
| | UV absorbent UV-2 | 0.04 |
| | UV absorbent UV-3 | 0.16 |
| | Additive HQ-5 | 0.04 |
| | DNP | 0.20 |
| | PVP | 0.03 |
| Layer 5: Red-sensitive layer | Gelatin | 1.30 |
| | Red-sensitive silver chlorobromide emulsion Em-R | 0.21 |
| | Cyan coupler C-A | 0.40 |
| | Dye image stabilizer ST-1 | 0.20 |
| | Additive HQ-1 | 0.01 |
| | HBS-1 | 0.20 |
| | DOP | 0.20 |
| Layer 4: Ultraviolet absorbing layer | Gelatin | 0.94 |
| | UV absorbent UV-1 | 0.28 |
| | UV absorbent UV-2 | 0.09 |

TABLE 1-continued

| Layer | Composition | Amount of addition ($g/m^2$) |
|---|---|---|
| | UV absorbent UV-3 | 0.38 |
| | Additive HQ-5 | 0.10 |
| | DNP | 0.40 |
| Layer 3: Green-sensitive layer | Gelatin | 1.40 |
| | Green-sensitive silver chlorobromide emulsion Em-G | 0.24 |
| | Magenta coupler M-A | 0.23 |
| | Dye image stabilizer ST-3 | 0.20 |
| | Dye image stabilizer ST-4 | 0.17 |
| | DIDP | 0.13 |
| | DBP | 0.13 |
| Layer 2: Interlayer | Gelatin | 1.20 |
| | Additive HQ-2 | 0.03 |
| | Additive HQ-3 | 0.03 |
| | Additive HQ-4 | 0.05 |
| | Additive HQ-5 | 0.23 |
| | DIDP | 0.06 |
| | Comoound F-1 | 0.002 |
| Layer 1: Blue-sensitive layer | Gelatin | 1.20 |
| | Blue-sensitive silver chlorobromide emulsion Em-B | 0.26 |
| | Yellow coupler Y-A | 0.80 |
| | Dye image stabilizer ST-1 | 0.30 |
| | Dye image stabilizer ST-2 | 0.20 |
| | Additive HQ-1 | 0.02 |
| | DNP | 0.20 |
| Support | Polyethylene-laminated paper | |

Figures for silver halide emulsions are expressed as the amount of silver.

Y-A

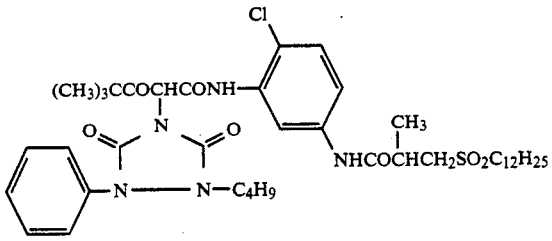

M-A

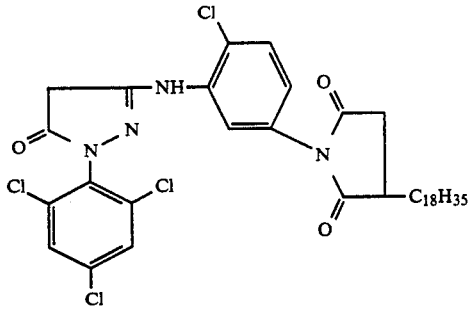

C-A

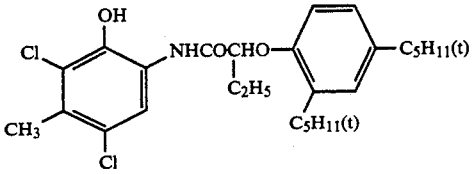

ST-1

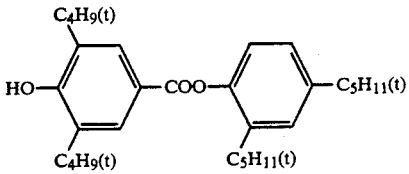

-continued
ST-2
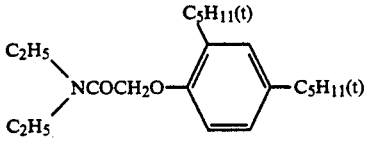
ST-3
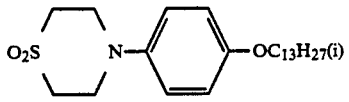
ST-4
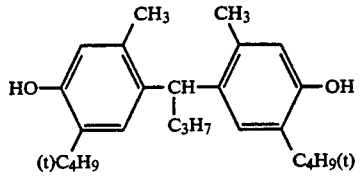
UV-1
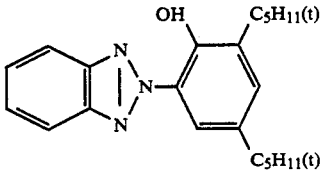
UV-2
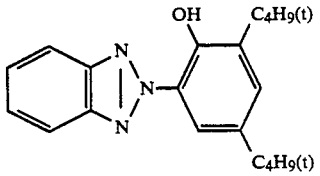
UV-3
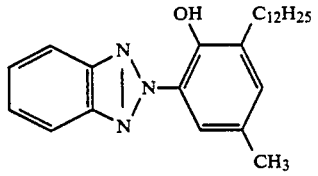
DBP: Dibutyl phthalate
DOP: Dioctyl phthalate
DNP: Dinonyl phthalate
DIDP: Diisodecyl phthalate
PVP: Polyvinylpyrrolidone
HQ-1
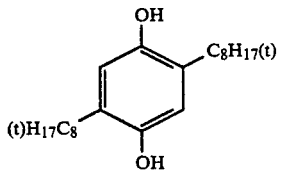
HQ-2
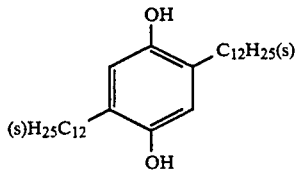

-continued
HQ-3
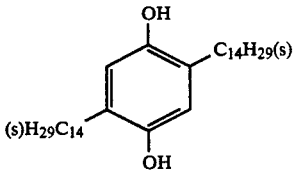
HQ-4
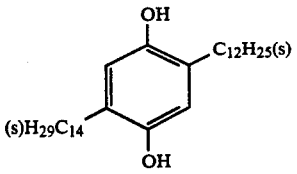
HQ-5
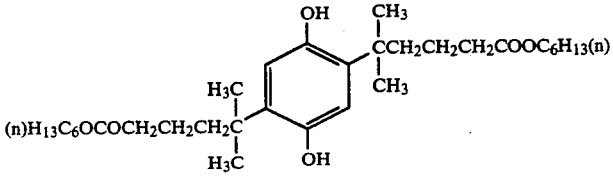
HBS-1
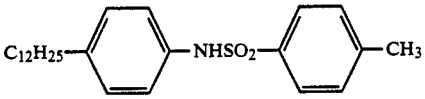
AI-1
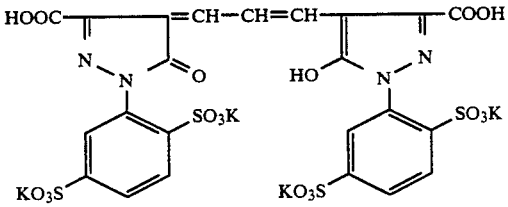
AI-2
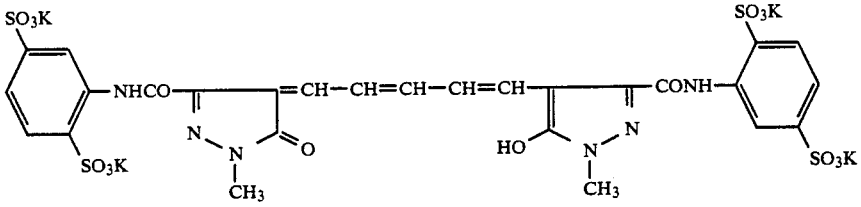
AI-3
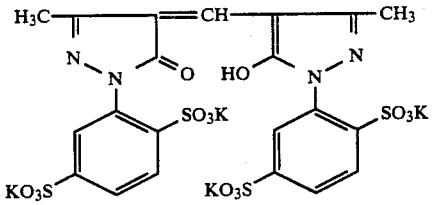
SU-1
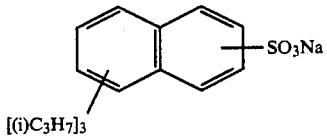
SU-2
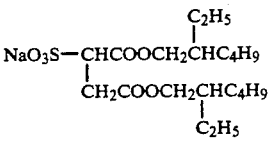

-continued

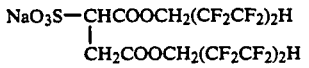

SU-3

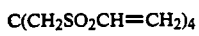

H-1

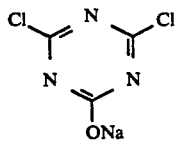

H-2

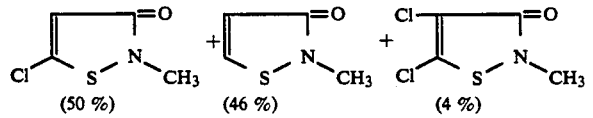

F-1

Preparation of blue-sensitive silver chlorobromide emulsion Em-B

To 1000 ml of a 2% aqueous solution of gelatin held at 40° C., the following solutions A and B were simultaneously added over a period of 30 minutes while maintaining a pAg of 6.5 and a pH of 3.0, after which the following solutions C and D were simultaneously added over a period of 180 minutes while maintaining a pAg of 7.3 and a pH of 5.5. pH was regulated using an aqueous solution of sulfuric acid or sodium hydroxide. pAg was regulated using a regulating solution comprising an aqueous solution of a halide mixture of sodium chloride and potassium bromide with a chloride and bromide ion ratio of 99.8:0.2. Regulating solution concentration was set at 0.1 mol/l in mixing solutions A and B and 1 mol/l in mixing solutions C and D.

| | |
|---|---|
| Solution A | |
| Sodium chloride | 3.42 g |
| Potassium bromide | 0.03 g |
| Water was added to make a total quantity of | 200 ml. |
| Solution B | |
| Silver nitrate | 10 g |
| Water was added to make a total quantity of | 200 ml. |
| Solution C | |
| Sodium chloride | 102.7 g |
| Potassium bromide | 1.0 g |
| Water was added to make a total quantity of | 600 ml. |
| Solution D | |
| Silver nitrate | 300 g |
| Water was added to make a total quantity of | 600 ml. |

After completion of the addition, the mixture was desalinized using a 5% aqueous solution of Demol N, a product of Kao Atlas, and a 20% aqueous solution of magnesium sulfate and then mixed with an aqueous solution of gelatin to yield a monodispersed emulsion EMP-1 comprising cubic grains having an average grain size of 0.85 μm, a coefficient of variance of 0.07 and a silver chloride content of 99.5 mol %.

The resulting emulsion EMP-1 was chemically ripened with the following compounds at 50° C. for 90 minutes to yield a blue-sensitive silver chlorobromide emulsion Em-B.

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |

-continued

| | |
|---|---|
| Sensitizing dye BS-1 | $4 \times 10^{-4}$ mol/mol AgX |
| Sensitizing dye BS-2 | $1 \times 10^{-4}$ mol/mol AgX |

Preparation of green-sensitive silver chlorobromide emulsion Em-G

A monodispersed emulsion EMP-2 comprising cubic grains having an average grain size of 0.43 μm, a coefficient of variance of 0.08 and a silver chloride content of 99.5 mol % was prepared in the same manner as with EMP-1 except that the addition time for solutions A and B and the addition time for solutions C and D were changed.

The resulting emulsion EMP-2 was chemically ripened with the following compounds at 55° C. for 120 minutes to yield a green-sensitive silver chlorobromide emulsion Em-G.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

Preparation of red-sensitive silver halide chlorobromide Em-R

A monodispersed emulsion EMP-3 comprising cubic grains having an average grain size of 0.50 μm, a coefficient of variance of 0.08 and a silver chloride content of 99.5 mol % was prepared in the same manner as with EMP-1 except that the addition time for solutions A and B and the addition time for solutions C and D were changed.

The resulting emulsion EMP-3 was chemically ripened with the following compounds at 60° C. for 90 minutes to yield a red-sensitive silver chlorobromide emulsion Em-R.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye RS-1 | $1 \times 10^{-4}$ mol/mol AgX |

The coefficient of variance of grain size is calculated as follows:

$$\text{Coefficient of variance } (S/\bar{r}) = \frac{\text{standard deviation of grain size distribution}}{\text{average grain size}}$$

$$\text{Grain size distribution standard deviation } (S) = \sqrt{\frac{\Sigma(\bar{r} - ri)^2 ni}{\Sigma ni}}$$

$$\text{Average grain size } (\bar{r}) = \frac{\Sigma niri}{\Sigma ni}$$

Here, ri represents the diameter of each grain; ni represents the number of grains. Grain size means the diameter of a grain, provided that the grain is a spherical silver halide grain, or the diameter of the circle with the same area converted from the projected area, provided that the grain is a cubic or otherwise non-spherical grain.

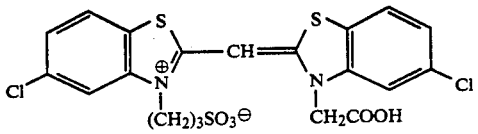

BS-1

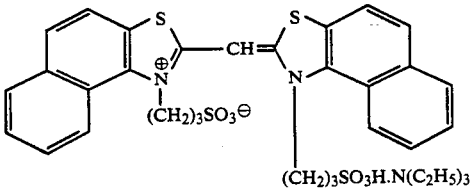

BS-2

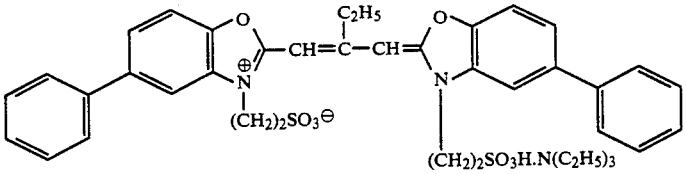

GS-1

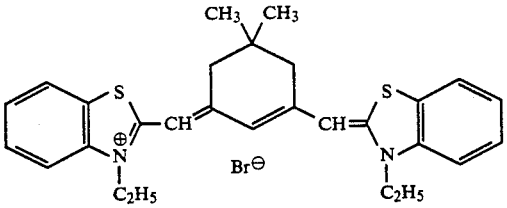

RS-1

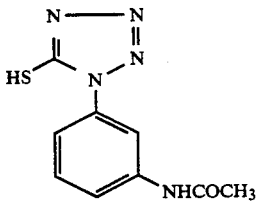

STAB-1

Further samples 2 to 20 were prepared in the same manner as in sample 1 except that comparative dyes or silver salts of inventive dyes were added to a layer of each samples as shown in Table 3. The silver salts of dyes of the invention were prepared as follows.

In 1000 ml of water 0.1 mol of the dye and 10.1 g (0.1 mol) of triethylamine were dissolved. While stirring this solution, 200 ml of a 1 mol/l aqueous solution of silver nitrate was added drop by drop. The resulting precipitate was collected by filtration, washed and dried to yield the desired silver salt of dye.

To 700 ml of a 3% aqueous solution of gelatin, 0.05 mol of the silver salt of dye obtained above and 30 ml of a 6.7% solution of surfactant Triton X-200 (produced by Rohm & Haas), and 2 kg of glass beads (1 mm diameter) were added, followed by pulverization using a stirring ball mill (Aquamizer QA-5, produced by Hosokawa Micron) for 8 hours to yield a dispersion of the silver salt of dye.

Sample Nos. 1 through 20 thus prepared were subjected to white light exposure through an optical wedge and then processes in the following procedures.

| Processing procedure | Temperature | Time |
|---|---|---|
| Color development | 35.0 ± 0.3° C. | 45 seconds |
| Bleach-fixation | 35.0 ± 0.5° C. | 45 seconds |
| Stabilization | 30 to 34° C. | 90 seconds |
| Drying | 60 to 80° C. | 60 seconds |

Color developer

| | |
|---|---|
| Water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphonic acid | 1.0 g |
| Ethylenediaminetetraacetic acid | 1.0 g |

-continued

| | |
|---|---|
| Disodium catechol-3,5-diphosphonate | 1.0 g |
| Diethylen glycol | 10 g |
| N-ethyl-N-β-methanesulfonamidoethyl-3-methyl-4-aminoaniline sulfate | 4.5 g |
| Brightening agent (4,4'-diaminostylbenedisulfonic acid derivative) | 1.0 g |
| Potassium carbonate | 27 g |
| Water was added to make a total quantity of 1 1, and the solution was adjusted to a pH of 10.10. | |
| Bleach-fixer | |
| Ferric ammonium ethylenediaminetetraacetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |
| Water was added to make a total quantity of 1 1, and potassium carbonate or glacial acetic acid was added to obtain a pH of 5.7. | |
| Stabilizer | |
| 5-chloro-2-methyl-4-isothiazolin-3-one | 0.2 g |
| 1,2-benzisothiazolin-3-one | 0.3 g |
| Ethylene glycol | 1.0 g |
| 1-hydroxyethylidene-1,1-diphosphonic acid | 2.0 g |
| Sodium o-phenylphenolate | 1.0 g |
| Ethylenediaminetetraacetic acid | 1.0 g |
| Ammonium hydroxide (20% aqueous solution) | 3.0 g |
| Brightening agent (4,4'-diaminostylbenedisulfonic acid derivative) | 1.5 g |
| Water was added to make a total quantity of 1 1, and sulfuric acid or potassium hydroxide was added to obtain a pH of 7.0. | |

Each sample thus processed was subjected to determine the sensitivity of each light-sensitive emulsion layer by an ordinary sensitometry method.

Sample Nos. 1 through 20 were separately exposed to blue, green and red light exposure through an optical wedge with a chart for MTF determination and processed in the same procedures as above.

Each sample thus processed was subjected to densitometry using a microdensitometer to determine the MTF (modulation transfer function) of each light-sensitive emulsion layer, and the figures for MTF obtained were compared at a space frequency of 5 lines/mm.

How to evaluate image sharpness by MTF, which is obvious to those skilled in the art, is described in pages 612 through 614, "The Theory of the Photographic Process", 4th edition, MacMillan, 1977. The results are shown in Table 3.

In Table 3 and the later-mentioned tables the amounts of components, sensitivity and MFT values are expresses as follows.

Figures for the amount of dye added are expressed in mg/m$^2$ interms of weight before silver salt formation.

Figures for silver salt of dye are expressed as the amount of dye before silver salt formation.

Figures for the amount of yellow coupler added are expressed in g/m$^2$.

Figures for sensitivity are expressed as percent ratio relative to the sensitivity of sample No. 1.

Figures for MTF are expressed as percent ratio relative to the MTF value of sample No. 1.

TABLE 3

| Sample No. | Dye: Compound | Dye: Target layer | Dye: Amount of addition | Sensitivity B | Sensitivity G | Sensitivity R | MTF B | MTF G | MTF R | Remark |
|---|---|---|---|---|---|---|---|---|---|---|
| 1 | — | — | — | 100 | 100 | 100 | 100 | 100 | 100 | Comparative |
| 2 | AI-3 | Layer 1 | 20 | 43 | 62 | 74 | 116 | 105 | 100 | Comparative |
| 3 | AI-I | Layer 3 | 40 | 56 | 39 | 60 | 110 | 121 | 107 | Comparative |
| 4 | AI-2 | Layer 5 | 30 | 62 | 54 | 35 | 106 | 111 | 129 | Comparative |
| 5 | I-1 | Layer 1 | 30 | 54 | 76 | 83 | 123 | 110 | 103 | Inventive |
| 6 | I-12 | Layer 1 | 30 | 56 | 75 | 84 | 123 | 109 | 104 | Inventive |
| 7 | II-3 | Layer 1 | 30 | 54 | 77 | 86 | 122 | 110 | 102 | Inventive |
| 8 | III-2 | Layer 1 | 30 | 56 | 76 | 85 | 123 | 109 | 101 | Inventive |
| 9 | I-3 | Layer 3 | 50 | 64 | 54 | 67 | 120 | 134 | 117 | Inventive |
| 10 | IV-5 | Layer 3 | 50 | 64 | 54 | 66 | 121 | 132 | 115 | Inventive |
| 11 | I'-2 | Layera 3 | 50 | 63 | 54 | 66 | 119 | 133 | 115 | Inventive |
| 12 | II'-2 | Layer 3 | 50 | 65 | 53 | 68 | 118 | 132 | 116 | Inventive |
| 13 | III'-7 | Layer 3 | 50 | 63 | 55 | 68 | 119 | 134 | 114 | Inventive |
| 14 | VI-3 | Layer 3 | 50 | 64 | 52 | 67 | 120 | 133 | 116 | Inventive |
| 15 | I-2 | Layer 5 | 40 | 68 | 60 | 51 | 109 | 121 | 142 | Inventive |
| 16 | I-15 | Layer 5 | 40 | 67 | 59 | 50 | 111 | 119 | 138 | Inventive |
| 17 | I'-3 | Layer 5 | 40 | 68 | 62 | 51 | 110 | 119 | 139 | Inventive |
| 18 | VI-4 | Layer 5 | 40 | 66 | 60 | 52 | 110 | 121 | 141 | Inventive |
| 19 | VI-20 | Layer 5 | 40 | 67 | 62 | 50 | 109 | 120 | 140 | Inventive |
| 20 | VI-47 | Layer 5 | 40 | 66 | 60 | 51 | 110 | 118 | 138 | Inventive |

As is evident from Table 3, sample No. 1, which contains no anti-irradiation dye, has insufficient sharpness, though its sensitivity is high, while sample Nos. 2 through 4, which contain a conventional water-soluble dye in layers 1, 3 and 5, respectively, have extremely reduced sensitivity, though they have somewhat improved sharpness. On the other hand, sample Nos. 5 through 20, which contain the silver salt of dye of the present invention in layer 1, 3 or 5, all have greatly improved sharpness with relatively little sensitivity reduction.

Example 2

Sample Nos. 21 through 40 were prepared in the same manner as sample No. 1 prepared in Example 1 except that yellow coupler Y-A in layer 1 was changed as shown in Table 4 and each of the comparative dyes shown in Table 4 or the silver salt of dye of the present invention was added to a layer shown in Table 4. Comparative dye AI-3 was added as an aqueous solution; the silver salt of dye of the present invention was prepared in the same manner as in Example 1 and added as a dispersion.

Sample Nos. 1, 2 and 21 through 40 were each subjected to white light exposure through an optical wedge and then processed in the same procedures as in Example 1.

Each sample thus processed was subjected to sensitometry to determine the sensitivity and fogging (density in the unexposed portion, as determined with blue light) of the blue-sensitive layer.

Sample Nos. 1, 2 and 21 through 40 were each subjected to blue light exposure through an optical wedge with a chart for MTF determination and then processed in the same procedures as above.

Each sample thus processed was subjected to densitometry using a microdensitometer to determine the MTF (modulation transfer function) of the blue-sensitive emulsion layer, and the figures for MTF obtained were compared at a space frequency of 5 lines/mm. The results are shown in Table 4.

TABLE 4

| | Dye | | | Yellow coupler | | Blue-sensitive layer performance | | | |
|---|---|---|---|---|---|---|---|---|---|
| Sample No. | Compound | Target layer | Amount of addition | Compound | Amount of addition | Sensitivity | Fogging | MTF | Remark |
| 1 | — | — | — | Y-A | 0.80 | 100 | 0.13 | 100 | Comparative |
| 2 | AI-3 | Layer 1 | 20 | Y-A | 0.80 | 43 | 0.14 | 116 | Comparative |
| 21 | — | — | — | Y-3 | 0.80 | 98 | 0.14 | 102 | Comparative |
| 22 | AI-3 | Layer 1 | 20 | Y-3 | 0.80 | 32 | 0.18 | 115 | Comparative |
| 23 | I-1 | Layer 1 | 30 | Y-3 | 0.80 | 50 | 0.15 | 122 | Invention |
| 24 | I-12 | Layer 1 | 30 | Y-3 | 0.80 | 52 | 0.15 | 122 | Inventive |
| 25 | II-3 | Layer 1 | 30 | Y-3 | 0.80 | 51 | 0.16 | 123 | Inventive |
| 26 | I'-1 | Layer 1 | 30 | Y-3 | 0.80 | 54 | 0.15 | 124 | Inventive |
| 27 | II'-3 | Layer 1 | 30 | Y-3 | 0.80 | 52 | 0.16 | 122 | Inventive |
| 28 | I-1 | Layer 1 | 30 | Y-2 | 0.85 | 51 | 0.14 | 125 | Inventive |
| 29 | I-12 | Layer 1 | 30 | Y-2 | 0.85 | 53 | 0.15 | 122 | Inventive |
| 30 | III'-1 | Layer 1 | 30 | Y-2 | 0.85 | 51 | 0.15 | 122 | Inventive |
| 31 | IV'-1 | Layer 1 | 30 | Y-2 | 0.85 | 54 | 0.16 | 124 | Inventive |
| 32 | I-1 | Layer 1 | 30 | Y-21 | 0.85 | 52 | 0.16 | 123 | Inventive |
| 33 | V-4 | Layer 1 | 30 | Y-21 | 0.85 | 52 | 0.15 | 123 | Inventive |
| 34 | VI-17 | Layer 1 | 30 | Y-21 | 0.85 | 51 | 0.15 | 124 | Inventive |
| 35 | VI-25 | Lyaer 1 | 30 | Y-21 | 0.85 | 51 | 0.16 | 122 | Inventive |
| 36 | I-12 | Layer 1 | 30 | Y-36 | 0.75 | 52 | 0.16 | 123 | Inventive |
| 37 | II-3 | Layer 1 | 30 | Y-36 | 0.75 | 50 | 0.14 | 123 | Inventive |
| 38 | III'-1 | Layer 1 | 30 | Y-36 | 0.75 | 53 | 0.15 | 122 | Inventive |
| 39 | V-2 | Layer 1 | 30 | Y-36 | 0.75 | 52 | 0.15 | 122 | Inventive |
| 40 | VI-25 | Layer 1 | 30 | Y-36 | 0.75 | 53 | 0.15 | 123 | Inventive |

As is evident from Table 4, sample Nos. 1 and 21, which contain no anti-irradiation dye, have insufficient sharpness, though their sensitivity is high, while sample Nos. 2 and 22, which contain a conventional water-soluble dye in layer 1, have extremely reduced sensitivity, though they have somewhat improved sharpness, with considerably increased fogging noted in sample No. 22. On the other hand, sample Nos. 23 through 40, which contain the silver salt of the dye of the present invention in layer 1, all have greatly improved sharpness with relatively little sensitivity reduction and less fogging.

Example 3

Sample Nos. 41 through 60 were prepared in the same manner as sample No. 21 prepared in Example 2 except that magenta coupler M-A in layer 3 was changed as shown in Tables 5 and 6 and each of the comparative dyes shown in Tables 5 and 6 or the silver salt of dye of the present invention was added to an layer shown in Tables 5 and 6. Comparative dye AI-1 was added as an aqueous solution; the silver salt of dye of the present invention was prepared in the same manner as in Example 1 and added as a dispersion.

Sample Nos. 1, 3 and 41 through 60 were each subjected to white light exposure through an optical wedge and then processed in the same procedures as in Example 1.

Each sample thus processed was subjected to sensitometry to determine the sensitivity and fogging (density in the unexposed portion, as determined with green light) of the green-sensitive emulsion layer (characteristics on the day of preparation).

Sample Nos. 1, 3 and 41 through 60 were each kept at 55° C. and 80% relative humidity for 7 days for forced deterioration, after which they were processed in the same manner as above to determine the sensitivity and fogging of the green-sensitive emulsion layer to evaluate the storage stability.

Sample Nos. 1, 3 and 41 through 60 were each subjected to green light exposure through an optical wedge for MTF determination and then processed in the same procedures as above.

Each sample thus processed was subjected to densitometry using a microdensitometer to determine the MTF (modulation transfer function) of the green-sensitive emulsion layer, and the figures for MTF obtained were compared at a space frequency of 5 lines/mm. The results are shown in Tables 5 and 6.

TABLE 5

| | Dye | | | Magenta coupler | | Characteristics on the day of preparation | | Storage stability | | | |
|---|---|---|---|---|---|---|---|---|---|---|---|
| Sample | Compound | Target layer | Amount of addition | Compound | Amount of addition | Sensitivity | Fogging | Sensitivity | Fogging | MTF | Remark |
| 1 | — | — | — | M-A | 0.23 | 100 | 0.16 | 94 | 0.18 | 100 | Comparative |
| 3 | AI-1 | Layer 3 | 40 | M-A | 0.23 | 39 | 0.17 | 92 | 0.21 | 121 | Comparative |
| 41 | — | — | — | M-1 | 0.23 | 98 | 0.17 | 96 | 0.20 | 104 | Comparative |
| 42 | AI-1 | Layer 3 | 40 | M-1 | 0.23 | 32 | 0.19 | 87 | 0.25 | 115 | Comparative |
| 43 | I-3 | Layer 3 | 50 | M-1 | 0.23 | 53 | 0.17 | 92 | 0.22 | 133 | Inventive |
| 44 | II-4 | Layer 3 | 50 | M-1 | 0.23 | 55 | 0.17 | 93 | 0.20 | 135 | Inventive |
| 45 | IV-5 | Layer 3 | 50 | M-1 | 0.23 | 54 | 0.18 | 93 | 0.20 | 134 | Inventive |

TABLE 5-continued

| Sample | Dye Compound | Dye Target layer | Dye Amount of addition | Magenta coupler Compound | Magenta coupler Amount of addition | Characteristics on the day of preparation Sensitivity | Characteristics on the day of preparation Fogging | Storage stability Sensitivity | Storage stability Fogging | MTF | Remark |
|---|---|---|---|---|---|---|---|---|---|---|---|
| 46 | I'-2 | Layer 3 | 50 | M-1 | 0.23 | 53 | 0.28 | 95 | 0.21 | 136 | Inventive |
| 47 | II'-7 | Layer 3 | 50 | M-1 | 0.23 | 56 | 0.18 | 92 | 0.21 | 133 | Inventive |
| 48 | III'-7 | Layer 3 | 50 | M-1 | 0.23 | 56 | 0.17 | 92 | 0.22 | 132 | Inventive |
| 49 | V'-5 | Layer 3 | 50 | M-1 | 0.23 | 54 | 0.17 | 94 | 0.22 | 133 | Inventive |
| 50 | VI-13 | Layer 3 | 50 | M-1 | 0.23 | 55 | 0.18 | 95 | 0.22 | 135 | Inventive |
| 51 | I-3 | Layer 3 | 50 | M-10 | 0.25 | 55 | 0.17 | 95 | 0.21 | 133 | Inventive |
| 52 | II-4 | Layer 3 | 50 | M-10 | 0.25 | 53 | 0.18 | 93 | 0.20 | 132 | Inventive |
| 53 | VI-29 | Layer 3 | 50 | M-10 | 0.25 | 53 | 0.18 | 93 | 0.21 | 131 | Inventive |
| 54 | I-3 | Layer 3 | 50 | M-54 | 0.30 | 56 | 0.18 | 94 | 0.21 | 135 | Inventive |

TABLE 6

| Sample | Dye Compound | Dye Target layer | Dye Amount of addition | Magenta coupler Compound | Magenta coupler Amount of addition | Characteristics on the day of preparation Sensitivity | Characteristics on the day of preparation Fogging | Storage stability Sensitivity | Storage stability Fogging | MTF | Remark |
|---|---|---|---|---|---|---|---|---|---|---|---|
| 55 | II-4 | Layer 3 | 50 | M-54 | 0.30 | 52 | 0.18 | 93 | 0.22 | 135 | Inventive |
| 56 | IV-5 | Layer 3 | 50 | M-54 | 0.30 | 53 | 0.17 | 93 | 0.22 | 134 | Inventive |
| 57 | V'-5 | Layer 3 | 50 | M-54 | 0.30 | 54 | 0.17 | 95 | 0.22 | 133 | Inventive |
| 58 | I-3 | Layer 3 | 50 | M-55 | 0.28 | 54 | 0.17 | 94 | 0.20 | 133 | Inventive |
| 59 | II-4 | Layer 3 | 50 | M-55 | 0.28 | 53 | 0.18 | 94 | 0.21 | 132 | Inventive |
| 60 | V'-5 | Layer 3 | 50 | M-55 | 0.28 | 56 | 0.18 | 92 | 0.21 | 135 | Inventive |

Figures for sensitivity after storage are expressed as percent ratio relative to the sensitivity on the day of preparation.

As is evident from Tables 5 and 6, sample Nos. 1 and 41, which contain no anti-irradiation dye, have insufficient sharpness, though their sensitivity is high, while sample Nos. 3 and 42, which contain a conventional water-soluble dye in layer 3, have extremely reduced sensitivity, though they have somewhat improved sharpness. Sample No. 42 also have higher fogging on the day of preparation, considerably reduced sensitivity and considerably increased fogging after storage. On the other hand, sample Nos. 43 through 60, which contain the silver salt of the dye of the present invention in layer 3, all have greatly improved sharpness with relatively little sensitivity reduction on the day of preparation and have less sensitivity reduction and less increase in fogging after storage.

Example 4

Sample Nos. 61 through 80 were prepared in the same manner as sample No. 41 prepared in Example 3 except that cyan coupler C-A in layer 5 was changed as shown in Tables 7 and 8 and each of the comparative dyes shown in Tables 7 and 8 or the silver salt of dye of the present invention was added to an layer shown in Tables 7 and 8. Comparative dye AI-2 was added as an aqueous solution; the silver salt of dye of the present invention were prepared in the same manner as in Example 1 and added as a dispersion.

Sample Nos. 1, 4 and 61 through 80 were each subjected to white light exposure through an optical wedge and then processed in the same procedures as in Example 1.

Each sample thus processed was subjected to sensitometry to determine the sensitivity and fogging (density in the unexposed portion, as determined with red light) of the red-sensitive emulsion layer (characteristics on the day of preparation).

Sample Nos. 1, 4 and 61 through 80 were each kept at 55° C. and 80% relative humidity for 7 days for forced deterioration, after which they were processed in the same manner as above to determine the sensitivity and fogging of the red-sensitive emulsion layer to evaluate the storage stability.

Sample Nos. 1, 4 and 61 through 80 were each subjected to red light exposure through an optical wedge with a chart for MTF determination and then processed in the same procedures as above.

Each sample thus processed was subjected to densitometry using a microdensitometer to determine the MTF (modulation transfer function) of the red-sensitive emulsion layer, and the figures for MTF obtained were compared at a space frequency of 5 lines/mm. The results are shown in Tables 7 and 8.

TABLE 7

| Sample | Dye Compound | Dye Target layer | Dye Amount of addition | Cyan coupler Compound | Cyan coupler Amount of addition | Characteristics on the day of preparation Sensitivity | Characteristics on the day of preparation Fogging | Storage stability Sensitivity | Storage stability Fogging | MTF | Remark |
|---|---|---|---|---|---|---|---|---|---|---|---|
| 1 | — | — | — | C-A | 0.40 | 100 | 0.13 | 95 | 0.15 | 100 | Comparative |
| 4 | AI-2 | Layer 5 | 30 | C-A | 0.40 | 35 | 0.14 | 91 | 0.18 | 129 | Comparative |
| 61 | — | — | — | C-4 | 0.42 | 97 | 0.14 | 94 | 0.17 | 104 | Comparative |
| 62 | AI-2 | Layer 5 | 30 | C-4 | 0.42 | 29 | 0.16 | 86 | 0.21 | 115 | Comparative |
| 63 | I-2 | Layer 5 | 40 | C-4 | 0.42 | 39 | j0.14 | 92 | 0.17 | 138 | Inventive |
| 64 | I-15 | Layer 5 | 40 | C-4 | 0.42 | 38 | 0.15 | 93 | 0.18 | 139 | Inventive |
| 65 | I'-3 | Layer 5 | 40 | C-4 | 0.42 | 39 | 0.15 | 94 | 0.19 | 140 | Inventive |

TABLE 7-continued

| Sample | Dye Compound | Dye Target layer | Dye Amount of addition | Cyan coupler Compound | Cyan coupler Amount of addition | Characteristics on the day of preparation Sensitivity | Characteristics on the day of preparation Fogging | Storage stability Sensitivity | Storage stability Fogging | MTF | Remark |
|---|---|---|---|---|---|---|---|---|---|---|---|
| 66 | VI-4 | Layer 5 | 40 | C-4 | 0.42 | 36 | 0.15 | 93 | 0.18 | 143 | Inventive |
| 67 | I'-8 | Layer 5 | 40 | C-4 | 0.42 | 37 | 0.14 | 94 | 0.18 | 143 | Inventive |
| 68 | VI-20 | Layer 5 | 40 | C-4 | 0.42 | 39 | 0.14 | 92 | 0.19 | 138 | Inventive |
| 69 | VI-47 | Layer 5 | 40 | C-4 | 0.42 | 35 | 0.15: | 94 | 0.17 | 138 | Inventive |
| 70 | I'-8 | Layer 5 | 40 | C-4 | 0.42 | 39 | 0.14 | 93 | 0.17 | 139 | Inventive |
| 71 | I-2 | Layer 5 | 40 | C-15 | 0.44 | 38 | 0.14 | 92 | 0.18 | 140 | Inventive |
| 72 | I-15 | Layer 5 | 40 | C-15 | 0.44 | 40 | 0.15 | 91 | 0.18 | 141 | Inventive |
| 73 | I'-3 | Layer 5 | 40 | C-15 | 0.44 | 35 | 0.15 | 94 | 0.19 | 141 | Inventive |
| 74 | VI-4 | Layer 5 | 40 | C-15 | 0.44 | 36 | 0.14 | 94 | 0.17 | 140 | Inventive |

TABLE 8

| Sample | Dye Compound | Dye Target layer | Dye Amount of addition | Cyan coupler Compound | Cyan coupler Amount of addition | Characteristics on the day of preparation Sensitivity | Characteristics on the day of preparation Fogging | Storage stability Sensitivity | Storage stability Fogging | MTF | Remark |
|---|---|---|---|---|---|---|---|---|---|---|---|
| 75 | I-2 | Layer 5 | 40 | C-19 | 0.44 | 36 | 0.14 | 91 | 0.18 | 140 | Inventive |
| 76 | I-15 | Layer 5 | 40 | C-19 | 0.44 | 38 | 0.14 | 92 | 0.18 | 142 | Inventive |
| 77 | I'-3 | Layer 5 | C-19 | 0.44 | 39 | 0.15 | 92 | 0.19 | 139 | Inventive | |
| 78 | VI-4 | Layer 5 | 40 | C-19 | 0.44 | j 37 | 0.15 | 93 | 0.18 | 139 | Inventive |
| 79 | VI-20 | Layer 5 | 40 | C-19 | 0.44 | 37 | 0.15 | 92 | 0.18 | 140 | Inventive |
| 80 | VI-47 | Layer 5 | 40 | C-19 | 0.44 | 39 | 0.14 | 94 | 0.17 | 142 | Inventive |

Figures for sensitivity after storage are expressed as percent ratio relative to the sensitivity on the day of preparation.

As is evident from Tables 7 and 8, sample Nos. 1 and 61, which contain no anti-irradiation dye, have insufficient sharpness, though their sensitivity is high, while sample Nos. 4 and 62, which contain a conventional water-soluble dye in layer 5, have extremely reduced sensitivity, though they have somewhat improved sharpness. Sample No. 62 also have higher fogging on the day of preparation and considerably reduced sensitivity and considerably increased fogging after storage. On the other hand, sample Nos. 63 through 80, which contain the silver salt of the dye of the present invention in layer 5, all have greatly improved sharpness with relatively little sensitivity reduction on the day of preparation and have less sensitivity reduction and less increase in fogging after storage.

Example 5

Sample Nos. 81 through 100 were prepared in the same manner as with sample No. 61 prepared in Example 4 except that the silver chloride contents of silver chlorobromide in layers 1, 3 and 5 were changed as shown in Tables 9, 10 and 11, the couplers added to these layers were changed as shown in Tables 9, 10 and 11 and each of the comparative dyes shown in Tables 9, 10 and 11 or the silver salt of dye of the present invention was added to these layers. Comparative dyes AI-1 through AI-3 were each added as an aqueous solution; the silver salt of dye of the present invention was prepared in the same manner as in Example 1 and added as a dispersion.

Sample Nos. 81 through 100 thus prepared were each subjected to white light exposure through an optical wedge and then processed in the same procedures as in Example 1.

Each sample thus processed was subjected to determine the sensitivity and fogging of each light-sensitive layer with an ordinary sensitometry method.

Sample Nos. 81 through 100 were each subjected to blue, green and red light resolved exposure through an optical wedge for MTF determination and then processed in the same procedures as above.

Each sample thus processed was subjected to densitometry using a microdensitometer to determine the MTF (modulation transfer function) of the each light-sensitive emulsion layer, and the figures for MTF obtained were compared at a space frequency of 5 lines/mm. The results are shown in Table 12.

TABLE 9

| Sample | Layer 1 (blue-sensitive emulsion layer) Silver chloride content | Dye Compound | Dye Amount of addition | Yellow coupler Compound | Yellow coupler Amount of addition |
|---|---|---|---|---|---|
| 81 | 99.5 mol % | AI-3 | 20 | Y-3 | 0.80 |
| 82 | 80.0 mol % | AI-3 | 20 | Y-3 | 0.80 |
| 83 | 99.5 mol % | I-1 | 30 | Y-3 | 0.80 |
| 84 | 99.5 mol % | I-12 | 30 | Y-3 | 0.80 |
| 85 | 99.5 mol % | I-12 | 30 | Y-3 | 0.80 |
| 86 | 99.5 mol % | I-12 | 30 | Y-3 | 0.80 |
| 87 | 99.5 mol % | II-3 | 30 | Y-3 | 0.80 |
| 88 | 99.5 mol % | VI-17 | 30 | Y-3 | 0.80 |
| 89 | 99.5 mol % | VI-17 | 30 | Y-2 | 0.85 |
| 90 | 99.5 mol % | I-12 | 30 | Y-21 | 0.85 |
| 91 | 99.5 mol % | I-12 | 30 | Y-21 | 0.85 |
| 92 | 99.5 mol % | I-12 | 30 | Y-36 | 0.75 |
| 93 | 99.5 mol % | I-12 | 30 | Y-36 | 0.75 |
| 94 | 95.0 mol % | I-1 | 30 | Y-2 | 0.85 |
| 95 | 95.0 mol % | I-12 | 30 | Y-2 | 0.85 |
| 96 | 95.0 mol % | I-12 | 30 | Y-3 | 0.80 |
| 97 | 95.0 mol % | I-12 | 30 | Y-3 | 0.80 |
| 98 | 95.0 mol % | II-3 | 30 | Y-21 | 0.85 |
| 99 | 95.0 mol % | I-12 | 30 | Y-36 | 0.75 |
| 100 | 95.0 mol % | VI-25 | 30 | Y-36 | 0.75 |

TABLE 10

| Sample | Layer 1 (green-sensitive emulsion layer) Silver chloride content | Dye Compound | Dye Amount of addition | Magenta coupler Compound | Magenta coupler Amount of addition |
|---|---|---|---|---|---|
| 81 | 99.5 mol % | AI-1 | 40 | M-1 | 0.23 |

TABLE 10-continued

| Sample | Layer 1 (green-sensitive emulsion layer) Silver chloride content | Dye Compound | Dye Amount of addition | Magenta coupler Compound | Magenta coupler Amount of addition |
|---|---|---|---|---|---|
| 82 | 80.0 mol % | AI-1 | 40 | M-1 | 0.23 |
| 83 | 99.5 mol % | I-3 | 50 | M-1 | 0.23 |
| 84 | 99.5 mol % | I-3 | 50 | M-1 | 0.23 |
| 85 | 99.5 mol % | II-4 | 50 | M-1 | 0.23 |
| 86 | 99.5 mol % | I-3 | 50 | M-1 | 0.23 |
| 87 | 99.5 mol % | I-3 | 50 | M-1 | 0.23 |
| 88 | 99.5 mol % | I-3 | 50 | M-1 | 0.23 |
| 89 | 99.5 mol % | VI-13 | 50 | M-54 | 0.30 |
| 90 | 99.5 mol % | I-3 | 50 | M-54 | 0.30 |
| 91 | 99.5 mol % | I-3 | 50 | M-54 | 0.30 |
| 92 | 99.5 mol % | II'-7 | 50 | M-55 | 0.28 |
| 93 | 99.5 mol % | III'-7 | 50 | M-55 | 0.28 |
| 94 | 95.0 mol % | I-3 | 50 | M-1 | 0.23 |
| 95 | 95.0 mol % | I-3 | 50 | M-1 | 0.23 |
| 96 | 95.0 mol % | I-3 | 50 | M-54 | 0.30 |
| 97 | 95.0 mol % | I-3 | 50 | M-54 | 0.30 |
| 98 | 95.0 mol % | I-3 | 50 | M-55 | 0.28 |
| 99 | 95.0 mol % | I'-2 | 50 | M-55 | 0.28 |
| 100 | 95.0 mol % | V'-5 | 50 | M-63 | 0.27 |

TABLE 11

| Sample | Layer 1 (red-sensitive emulsion layer) Silver chloride content | Dye Compound | Dye Amount of addition | Cyan coupler Compound | Cyan coupler Amount of addition |
|---|---|---|---|---|---|
| 81 | 99.5 mol % | AI-2 | 30 | C-4 | 0.42 |
| 82 | 80.0 mol % | AI-2 | 30 | C-4 | 0.42 |
| 83 | 99.5 mol % | I-15 | 40 | C-4 | 0.42 |
| 84 | 99.5 mol % | I-15 | 40 | C-4 | 0.42 |
| 85 | 99.5 mol % | I-15 | 40 | C-4 | 0.42 |
| 86 | 99.5 mol % | I-2 | 40 | C-4 | 0.42 |
| 87 | 99.5 mol % | I-2 | 40 | C-4 | 0.42 |
| 88 | 99.5 mol % | I-15 | 40 | C-4 | 0.42 |
| 89 | 99.5 mol % | I-15 | 40 | C-19 | 0.44 |
| 90 | 99.5 mol % | I-15 | 40 | C-19 | 0.44 |
| 91 | 99.5 mol % | I-2 | 40 | C-19 | 0.44 |
| 92 | 99.5 mol % | I-15 | 40 | C-19 | 0.44 |
| 93 | 99.5 mol % | II-15 | 40 | C-19 | 0.44 |
| 94 | 95.0 mol % | I-15 | 40 | C-4 | 0.42 |
| 95 | 95.0 mol % | I-15 | 40 | C-4 | 0.42 |
| 96 | 95.0 mol % | I-15 | 40 | C-19 | 0.44 |
| 97 | 95.0 mol % | I-2 | 40 | C-19 | 0.44 |
| 98 | 95.0 mol % | I'-3 | 40 | C-19 | 0.44 |
| 99 | 95.0 mol % | I'-8 | 40 | C-19 | 0.44 |
| 100 | 95.0 mol % | VI-4 | 40 | C-15 | 0.44 |

TABLE 12

| Sample | Blue-sensitive emulsion layer Sensitivity | Blue-sensitive emulsion layer Fogging | Blue-sensitive emulsion layer MTF | Green-sensitive emulsion layer Sensitivity | Green-sensitive emulsion layer Fogging | Green-sensitive emulsion layer MTF | Red-sensitive emulsion layer Sensitivity | Red-sensitive emulsion layer Fogging | Red-sensitive emulsion layer MTF | Remark |
|---|---|---|---|---|---|---|---|---|---|---|
| 81 | 100 | 0.21 | 100 | 100 | 0.22 | 100 | 100 | 0.19 | 100 | Comparative |
| 82 | 62 | 0.20 | 99 | 79 | 0.21 | 101 | 83 | 0.19 | 100 | Comparative |
| 83 | 122 | 0.15 | 110 | 124 | 0.17 | 111 | 113 | 0.16 | 112 | Inventive |
| 84 | 125 | 0.16 | 113 | 126 | 0.17 | 113 | 116 | 0.15 | 110 | Inventive |
| 85 | 128 | 0.16 | 115 | 128 | 0.17 | 112 | 118 | 0.16 | 115 | Inventive |
| 86 | 123 | 0.18 | 112 | 129 | 0.18 | 112 | 118 | 0.15 | 112 | Inventive |
| 87 | 125 | 0.16 | 110 | 131 | 0.18 | 115 | 119 | 0.17 | 113 | Inventive |
| 88 | 122 | 0.15 | 115 | 131 | 0.19 | 114 | 115 | 0.17 | 115 | Inventive |
| 89 | 125 | 0.15 | 114 | 128 | 0.18 | 113 | 112 | 0.15 | 111 | Inventive |
| 90 | 121 | 0.18 | 113 | 129 | 0.17 | 115 | 116 | 0.16 | 114 | Inventive |
| 91 | 128 | 0.18 | 112 | 128 | 0.17 | 112 | 114 | 0.15 | 112 | Inventive |
| 92 | 128 | 0.17 | 114 | 127 | 0.18 | 111 | 117 | 0.15 | 114 | Inventive |
| 93 | 125 | 0.17 | 114 | 127 | 0.18 | 115 | 114 | 0.17 | 115 | Inventive |
| 94 | 122 | 0.18 | 115 | 128 | 0.19 | 114 | 118 | 0.15 | 113 | Inventive |
| 95 | 124 | 0.16 | 112 | 129 | 0.19 | 115 | 115 | 0.16 | 114 | Inventive |
| 96 | 126 | 0.15 | 112 | 128 | 0.18 | 112 | 112 | 0.17 | 115 | Inventive |
| 97 | 125 | 0.15 | 111 | 125 | 0.17 | 113 | 113 | 0.15 | 112 | Inventive |
| 98 | 124 | 0.16 | 113 | 126 | 0.19 | 112 | 115 | 0.16 | 115 | Inventive |
| 99 | 124 | 0.18 | 114 | 124 | 01.8 | 111 | 117 | 0.15 | 115 | Inventive |
| 100 | 123 | 0.17 | 112 | 126 | 0.19 | 115 | 118 | 0.17 | 113 | Inventive |

Figures for sensitivity are expressed as percent ratio relative to the sensitivity of sample No. 81.

Figures for MTF are expressed as percent ratio relative to the MTF value of sample No. 81.

As is evident from Tables 9 through 12, sample No. 81, which contains a conventional water-soluble anti-irradiation dye, has high fogging, and sample No. 82, wherein the silver chloride content of the silver halide emulsion in each light-sensitive layer is 80 mol % (the other 20% is silver bromide), has low sensitivity; both are unsatisfactory as to performance. On the other hand, sample Nos. 83 through 100 of the present invention, all of which contain the silver salt of dye of the present invention and a high-chloride silver halide emulsion, have excellent sensitivity and excellent sharpness with little fogging.

What is claimed is:

1. A silver halide color photographic light-sensitive material comprising a support having thereon a blue-sensitive silver halide emulsion layer, a green-sensitive silver halide emulsion layer and a red-sensitive silver halide emulsion layer wherein said blue-sensitive silver halide emulsion layer contains a silver salt of a dye represented by the following Formulae I, II, III, IV, V, I', II', III', IV', V', or VI, and a yellow coupler represented by the following formula (Y-I); said green-sensitive silver halide emulsion layer contains a silver salt of a dye represented by the following formulae I, II, III, IV, V, I', II', III', IV', V', or VI, and a magenta coupler represented by the following Formula (M-I); and said red-sensitive silver halide emulsion layer contains a silver salt of a dye represented by the following Formulae I, II, IV, V, I', II', III', IV', V', or VI, and a cyan coupler represented by the following Formula (C-I);

(I)

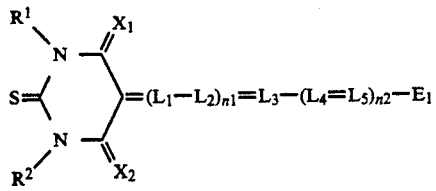

wherein $R^1$ and $R^2$ are each a hydrogen atom, an alkyl group, an alkenyl group, an aryl group or a heterocyclic group; $X_1$ and $X_2$ are each an oxygen atom or a sulfur atom; $L_1$, $L_2$ $L_3$ $L_4$ and $L_5$ are each a methine group; $n_1$ and $n_2$ are each an integer of 0 to 2; and $E_1$ is a group having an acidic nucleus;

(II)

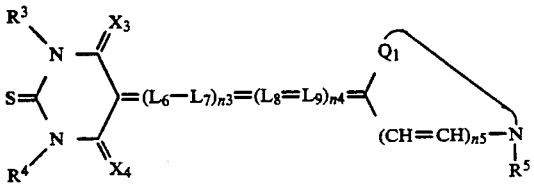

wherein $R^3$ and $R^4$ are each a hydrogen atom, an alkyl group, an alkenyl group, an aryl group or a heterocyclic group; $X_3$ and $X_4$ are each an oxygen atom or a sulfur atom; $L_6$, $L_7$ $L_8$ and $L_9$ are each a methine group; $n_3$, $n_4$ and $n_5$ are each an integer of 0 to 2; $R^5$ is an alkyl group or an alkenyl group; and $Q_1$ is a group of atoms necessary for forming a five-member or six-member heterocyclic ring;

(III)

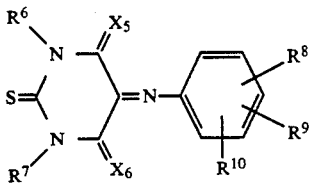

wherein $R^6$ and $R^7$ are the same as $R^3$ and $R^4$ in Formula II; $X_5$ and $X_6$ are the same as $X_3$ and $X_4$ in Formula II; $R^8$, $R^9$ and $R^{10}$ are each a hydrogen atom, an alkyl group, an alkenyl group, an aryl group, a heterocyclic group, a halogen atom, a cyano group, a sulfo group, a $-COR^{11}$ group, a $-CON(R^{11})(R^{12})$ group, $-N(R^{11})(R^{12})$ group, a $-OR^{11}$ group, a $-SO_2R^{11}$ group, a $-SO_2N(R^{11})(R^{12})$ group, a $-N(R^{11})COR^{12}$ group, a $-N(R^{11})SO_2R^{12}$ group, a $-N(R^{11})CON(R^{12})(R^{13})$ group, $-SR^{11}$ group or a $-COOR^{11}$ group, in which $R^{11}$, $R^{12}$ and $R^{13}$ are each a hydrogen atom, an alkyl group, an alkenyl group, an aryl group or a heterocyclic group;

(IV)

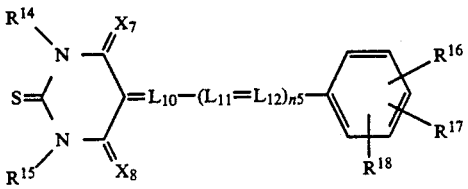

wherein $R^{14}$ and $R^{15}$ are the same as $R^3$ and $R^4$ in Formula II; $X_7$ and $X_8$ are the same as $X_3$ and $X_4$ in Formula II; $L_{10}$, $L_{11}$ and $L_{12}$ are each a methine group; $n_6$ is an integer of 0 to 2; and $R^{16}$, $R^{17}$ and $R^{18}$ are the same as $R^8$, $R^9$ and $R^{10}$ in Formula III;

(V)

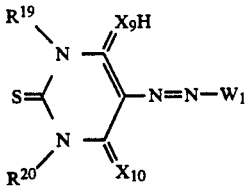

wherein $R^{19}$ and $R^{20}$ are the same as $R^3$ and $R^4$ in Formula II; $X_9$ and $X_{10}$ are the same as $X_3$ and $X_4$ in Formula II; and $W_1$ is an aryl group or a heterocyclic group;

(I')

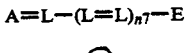

(II')

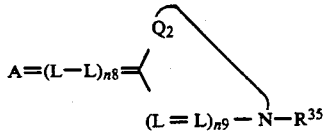

(III')

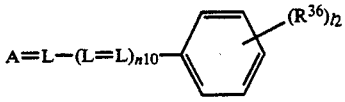

(IV')

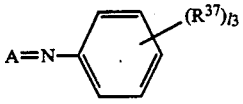

(V')

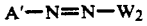

wherein $R^{35}$ is an alkyl group or an alkenyl group; $R^{36}$ and $R^{37}$ are independently an alkyl group, an alkenyl group, an aryl group, a heterocyclic group, a halogen atom, a cyano group, sulfo group, $-COR^{38}$, $-CON(R^{38})(R^{39})$, $-N(R^{38})(R^{39})$, $-OR^{38}$, $-SOR^{38}$, $-SO_2R^{38}$, $-SO_2N(R^{38})(R^{39})$, $-N(R^{38})COR^{39}$, $-NR^{38}SO_2R^{39}$, $-N(R^{38})CON(R^{39})(R^{40})$, $-SR^{38}$ or $-COOR^{38}$; $R^{38}$, $R^{39}$ and $R^{40}$ are independently a hydrogen atom, an alkyl group, an alkenyl group, an aryl group or a heterocyclic group; $n_7$ and $n_8$ independently represent an integer of 0 to 3; $n_9$ and $n_{10}$ independently represent an integer of 0 to 2; A is a group of the following Formulae $A_1$, $A_2$, $A_3$ or $A_4$; A' is a group of the Formula $A'_1$, $A'_2$, $A'_3$ or $A'_4$, ($A_3$)

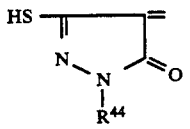

($A_4$)

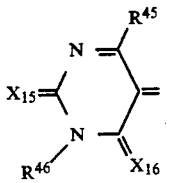

-continued (A1)

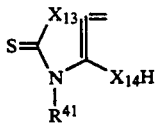

(A'2)

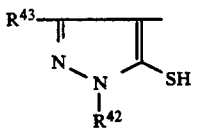

(A'3)

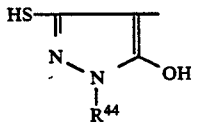

(A'4)

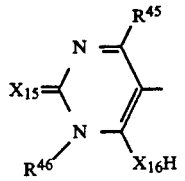

(A1)

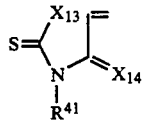

(A2)

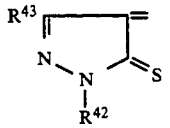

wherein $R^{41}$, $R^{42}$, $R^{44}$ and $R^{46}$ are independently a hydrogen atom, an alkyl group, an alkenyl group, an aryl group or a heterocyclic group; $R^{43}$ is an alkyl group, an alkenyl group, an aryl group, a heterocyclic group, a cyano group, $—COR^{47}$, $—CON(R^{47})(R^{48})$, $—N(R^{47})(R^{48})$, $—OR^{47}$, $SOR^{47}$, $SO_2R^{47}$, $SO_2N(R^{47})(R^{48})$, $—N(R^{47})COR^{48}$, $—N(R^{47})SO_2R^{48}$, $—N(R^{47})(CON(R^{48})(R^{49})$, $—SR^{47}$ or $—COOR^{47}$, $R^{47}$, $R^{48}$ and $R^{49}$ are independently a hydrogen atom, an alkyl group, an alkenyl group, an aryl group, or a heterocyclic group, $R^{45}$ is the same as $R^{36}$ and $R^{37}$; $X_{13}$ is an oxygen atom, a sulfur atom, a selenium atom or $=N—R^{50}$; $R^{50}$ is the same as $R^{41}$; $X_{14}$, $X_{15}$ and $X_{16}$ are each an oxygen atom or a sulfur atom; L is a methine group; E is an acidic nucleus; $Q_2$ is a group of non-metallic atoms necessary to form a heterocyclic ring; $W_2$ is an aryl group or a heterocyclic group; and $l_2$ and $l_3$ are each an integer of 0 to 3;

$$(Dye)\text{-}l_5[\text{-}(J)m_1\text{-}Sal]n_{11} \qquad (VI)$$

wherein Dye is a group of atoms having a structure of a methine dye; J is a divalent linking group comprising one or more atoms selected from carbon atom, nitrogen atom, oxygen atom and sulfur atom; Sal is a group forming a sparingly soluble salt with a silver ion; $l_5$ is an integer of 1 or 2; $m_1$ is an integer of 0 or 1; and $n_{11}$ is an integer of 1, 2, 3 or 4;

(Y-1)

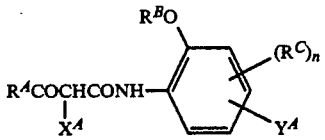

wherein $R^A$ is an alkyl group or a cycloalkyl group; $R^B$ is an alkyl; group, a cycloalkyl group or an acyl group; $R^C$ is a substituent; n is 0 or 1; $X^A$ is a substituent capable of splitting off upon coupling with the oxidation product of a color developing agent; and $Y^A$ is an organic group;

(M-I)

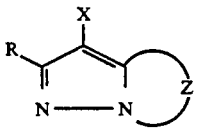

wherein R is a hydrogen atom; and Z is a group of non-metallic atoms necessary for forming a nitrogen-containing heterocyclic ring which ring may contain a substituent, and X is a hydrogen atom or a substituent capable of splitting off upon coupling with the oxidation product of a color developing agent; and (C-I)

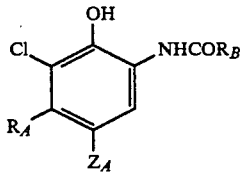

wherein $R_A$ is an alkyl group having 2 to 6 carbon atoms; $R_B$ is a ballast group; and $Z_A$ is a hydrogen atom or a substituent capable of splitting off upon coupling with the oxidation product of a color developing agent.

2. The light-sensitive material of claim 1, wherein said dye is a compound represented by said formula I.

3. The light-sensitive material of claim 1, wherein a silver halide emulsion layer containing said silver salt of dye comprises a silver halide emulsion having a silver chloride content of not less than 90 mol %.

* * * * *

UNITED STATES PATENT AND TRADEMARK OFFICE

CERTIFICATE OF CORRECTION

PATENT NO. : 5,324,625

DATED : July 6, 1994

INVENTOR(S) : Shigeto HIRABAYASHI, et al.

It is certified that error appears in the above-indentified patent and that said Letters Patent is hereby corrected as shown below:

Title Page,
Attorneys, Agent, or Firm, front page after "Henderson" insert --,--.

Claim 1, column 132, line 62 change "formulae" to --Formulae--;

column 133, line 13 change "$L_1$, $L_2$ $L_3$ $L_4$ and $L_5$" to --$L_1$, $L_2$, $L_3$, $L_4$ and $L_5$--;

column 133, line 29 change "$L_6$, $L_7$ $L_8$ and $L_9$ to --$L_6$, $L_7$, $L_8$ and $L_9$--;

UNITED STATES PATENT AND TRADEMARK OFFICE

CERTIFICATE OF CORRECTION

PATENT NO. : 5,324,625

DATED : July 6, 1994

INVENTOR(S) : Shigeto HIRABAYASHI, et al.

It is certified that error appears in the above-indentified patent and that said Letters Patent is hereby corrected as shown below:

column 135, line 5, change

"S 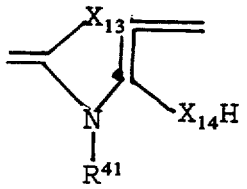 (A 1) "

to

--S 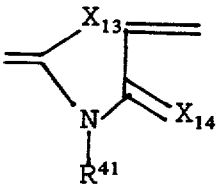 (A 1) -- column 135, line 45 ")" is missing from "(Con".

Signed and Sealed this

Eleventh Day of April, 1995

*Attest:*

BRUCE LEHMAN

*Attesting Officer*

*Commissioner of Patents and Trademarks*